US012753001B2

(12) United States Patent
Morrison

(10) Patent No.: US 12,753,001 B2
(45) Date of Patent: Oct. 6, 2026

(54) SPRAY NOZZLE APPARATUS

(71) Applicant: RUST-OLEUM CORPORATION, Vernon Hills, IL (US)

(72) Inventor: Adam Peter Morrison, Vernon Hills, IL (US)

(73) Assignee: Rust-Oleum Corporation, Vernon Hills, IL (US)

( * ) Notice: Subject to any disclaimer, the term of this patent is extended or adjusted under 35 U.S.C. 154(b) by 317 days.

(21) Appl. No.: 18/657,452

(22) Filed: May 7, 2024

(65) Prior Publication Data

US 2024/0327103 A1 Oct. 3, 2024

Related U.S. Application Data

(63) Continuation-in-part of application No. 17/801,177, filed as application No. PCT/US2021/058609 on Nov. 9, 2021, now Pat. No. 11,975,912.

(60) Provisional application No. 63/111,439, filed on Nov. 9, 2020.

(51) Int. Cl.
*B65D 83/14* (2025.01)

(52) U.S. Cl.
CPC ..... *B65D 83/7532* (2013.01)

(58) Field of Classification Search
CPC ..... B05B 1/1654; B05B 1/169; B05B 9/0833; B05B 11/3011; B65D 83/20; B65D 83/7532; B65D 83/164
See application file for complete search history.

(56) References Cited

U.S. PATENT DOCUMENTS

| | | | |
|---|---|---|---|
| 2,797,965 A | 7/1957 | Mckernan | |
| 2,997,243 A | 8/1961 | Kolb | |
| 3,083,872 A | 4/1963 | Meshberg | |
| 3,176,888 A | 4/1965 | Focht | |
| 3,180,536 A | 4/1965 | Meshberg | |
| 3,246,850 A | 4/1966 | Bourke | |
| 3,703,994 A | 11/1972 | Nigro | |
| 3,711,030 A | 1/1973 | Jones | |

(Continued)

FOREIGN PATENT DOCUMENTS

| | | | |
|---|---|---|---|
| JP | H10113585 A * | 5/1998 | ..... B05B 11/3011 |
| WO | 2022/099191 A1 | 5/2022 | |

OTHER PUBLICATIONS

JP H10113585 A translation (Year: 1998).*
ISA/US, PCT/US21/058609, PCT Search Report and Written Opinion mailed Jan. 31, 2022, Harry Kim (8 pgs).

*Primary Examiner* — Steven M Cernoch
(74) *Attorney, Agent, or Firm* — Mueting Raasch Group

(57) ABSTRACT

Aspects of the disclosure are directed to apparatuses and/or methods involving a rotatable dial and a plurality of nozzles therein. The dial aligns each nozzle with a fluid supply channel. In some instances, a gear coupled to the dial has cogs and gaps between adjacent ones of the cogs along a rotational path of the gear. Certain aspects involve force feedback in which a flexible tab located in the rotational path of the gear engages with the cogs for providing resistive feedback. Other aspects involve audible feedback in which a flexible tab flexes in response to contact with the gear as it rotates, and snaps back into place after the gear is rotated past the flexible tab, creating an audible noise. Certain particular aspects involve utilization of the gears to prevent fluid from being dispensed when the nozzles are not aligned with the channel.

20 Claims, 57 Drawing Sheets

(56) References Cited

U.S. PATENT DOCUMENTS

| | | | | |
|---|---|---|---|---|
| 3,795,366 | A * | 3/1974 | McGhie | B65D 83/20 222/402.11 |
| 3,913,804 | A | 10/1975 | Laauwe | |
| 5,385,303 | A | 1/1995 | Gosselin et al. | |
| 5,901,907 | A | 5/1999 | Hildebrandt | |
| 7,080,795 | B2 * | 7/2006 | Chen | B05B 1/1654 239/394 |
| 7,621,468 | B2 | 11/2009 | Smith et al. | |
| 8,201,757 | B2 | 6/2012 | Suzuki | |
| 8,701,944 | B2 | 4/2014 | Tryon | |
| 9,126,212 | B2 | 9/2015 | Pirshafiey | |
| 9,156,042 | B2 | 10/2015 | Hanson et al. | |
| 9,248,457 | B2 | 2/2016 | Hanson et al. | |
| 9,957,100 | B2 | 5/2018 | Jasper et al. | |
| 11,975,912 | B2 | 5/2024 | Morrison | |
| 2005/0274826 | A1 | 12/2005 | Chen | |
| 2008/0017672 | A1 | 1/2008 | Ohshima | |
| 2008/0190968 | A1 | 8/2008 | Heirman | |
| 2010/0044400 | A1 | 2/2010 | Laidler | |
| 2010/0219211 | A1 | 9/2010 | Smith et al. | |
| 2010/0301130 | A1 | 12/2010 | Townsend | |
| 2011/0114756 | A1 | 5/2011 | Munn | |
| 2014/0306032 | A1 | 10/2014 | Su et al. | |

* cited by examiner

SPRAY NOZZLE APPARATUS

BACKGROUND

Liquid spray dispensers, such as aerosol dispensers, can be utilized in a variety of applications. For instance, aerosol spray cans can be used to dispense coatings such as paint, household cleaners, industrial products, personal care products, agricultural products, and insect repellants. Aerosol spray cans may utilize a propellant to propel liquid through a nozzle, in response to actuation of a valve that results in pressurized liquid being propelled out of the spray can. For instance, a trigger or other mechanism may be used to actuate the valve, with liquid in the can being propelled through a nozzle.

While useful for a variety of applications, aerosol dispensers may suffer from leakage and/or inadvertent dispensing. For instance, triggers may inadvertently be actuated when handling or transporting aerosol spray paint cans, resulting in unwanted dispensing of paint. Further, many such dispensers are limited in the manner in which liquid is dispensed, for example such as limiting a pattern in which paint is sprayed from an aerosol spray paint can.

These and other matters have presented challenges to the manufacture and implementation of liquid spray dispensers, for a variety of applications.

SUMMARY

Various example embodiments are directed to locking spray nozzle apparatuses and methods, which may address various challenges including those noted above.

In accordance with a more particular embodiment, an apparatus comprises a dial having a planar surface, a fluid supply channel, a plurality of nozzles recessed within the surface of the dial, a gear coupled to the dial and configured to rotate with the dial, and a flexible tab. Each of the nozzles has a fluid channel extending in a direction that is aligned in parallel with the fluid channels of the other nozzles, the dial being configured to rotate for selectively aligning each of the respective nozzles with the fluid supply channel. The gear has a plurality of cogs coupled to a rib, each cog and rib being separated by spaces along a rotation path. The flexible tab extends into the rotation path of the ribs and is configured and arranged to flex from a relaxed position into a flexed position in response to one of the ribs being rotated with the dial into contact with the flexible tab. The flexible tab is further configured to snap back to the relaxed position and generate an audible noise indicating that rib has moved past the flexible tab, in response to the one of the ribs being further rotated with the dial to a position in which the rib moves out of contact with the flexible tab.

Another embodiment is directed to an apparatus comprising a dial having a plurality of nozzles and a gear, and a flexible tab. The dial is configured to rotate for selectively aligning each of the respective nozzles for receiving fluid to be dispensed via the nozzles. The gear has a plurality of cogs coupled to a rib, each cog and rib being separated by spaces along a rotation path. The flexible tab extends into the rotation path of the ribs and is configured and arranged to flex from a relaxed position into a flexed position in response to one of the ribs being rotated with the dial into contact with the flexible tab. The flexible tab is further configured and arranged to snap back to the relaxed position and generate an audible noise indicating that rib has moved past the flexible tab, in response to the one of the ribs being further rotated with the dial to a position in which the rib moves out of contact with the flexible tab.

Another embodiment is directed to an apparatus including a channel, an actuator, a mechanical stop, and a dial having nozzles and a gear. The dial is operable to rotate for selectively aligning each of the respective nozzles with the channel. The gear has a plurality of cogs and recessed regions between adjacent ones of the cogs, and is configured and arranged with the mechanical stop to prevent movement of the actuator when the dial is positioned with the nozzles out of alignment with the channel. Such an apparatus may be useful, for example, to prevent unintentional actuation and therein prevent unintentional dispensing of fluid via the nozzles.

Another embodiment is directed to an apparatus having a liquid supply channel, a rotatable dial, an actuator and a locking mechanism. The rotatable dial has a plurality of nozzles, separated from one another by a portion of the rotatable dial. The rotatable dial is further configured to selectively align each of the respective nozzles with the channel for receiving and spraying propelled liquid received via the channel. The actuator is configured and arranged to release the propelled liquid into the channel by actuating a valve. The locking mechanism is configured with the rotatable dial to, in response to the rotatable dial being positioned with the nozzles out of alignment with the channel, prevent actuation of the valve and block delivery of the propelled liquid to the channel by preventing movement of the actuator. The locking mechanism is further configured with the rotatable dial to, in response to the rotatable dial being positioned with one of the nozzles aligned with the channel, facilitate movement of the actuator for actuating the valve and delivering the propelled liquid to the one of the nozzles via the channel.

The above discussion/summary is not intended to describe each embodiment or every implementation of the present disclosure. The figures and detailed description that follow exemplify various embodiments.

BRIEF DESCRIPTION OF FIGURES

Various example embodiments may be more completely understood in consideration of the following detailed description and in connection with the accompanying drawings, in which.

Figure 1:
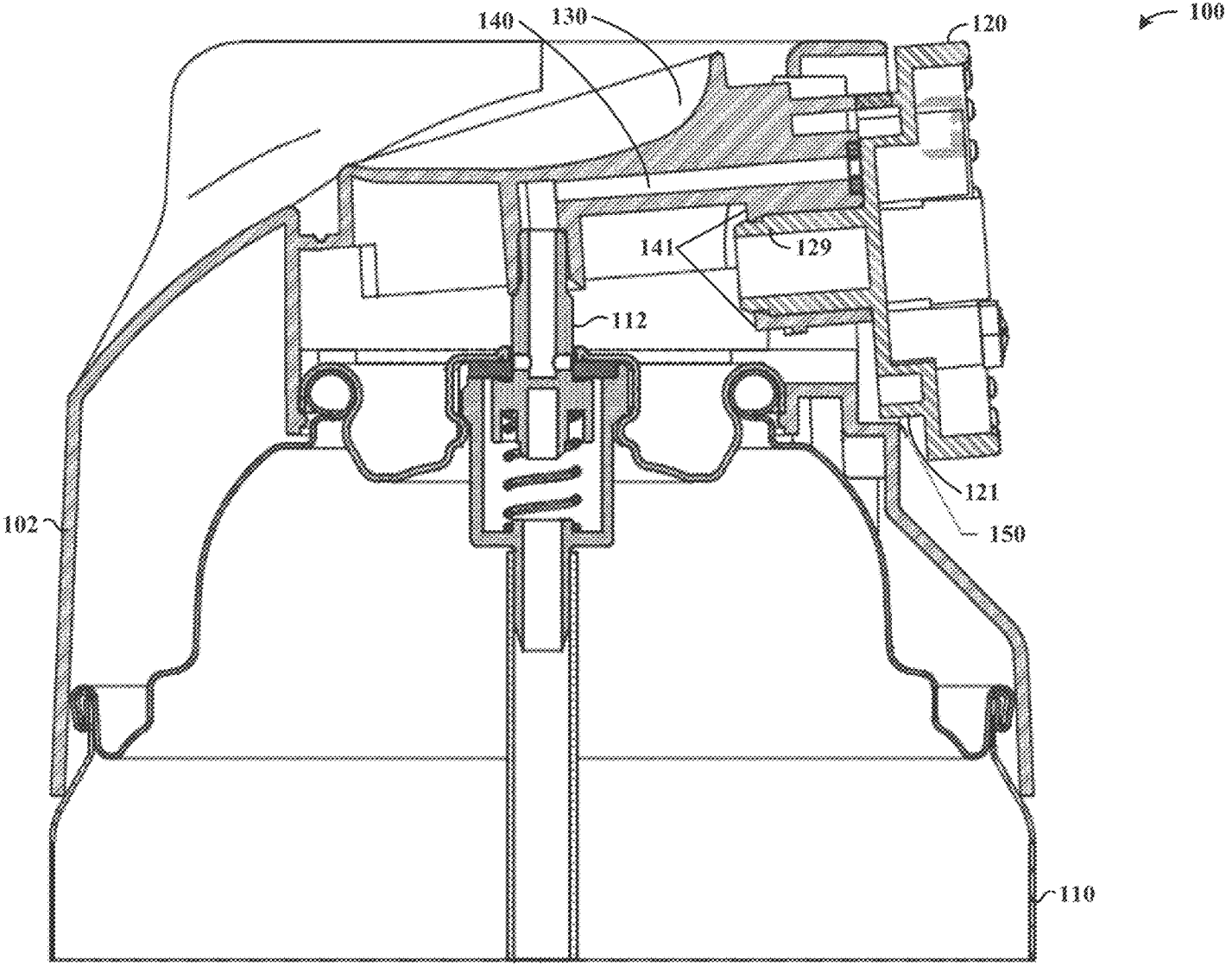
FIG. 1 shows a cross sectional view of an apparatus having a rotatable spray nozzle dial with multiple apertures and a corresponding locking mechanism, with the apparatus in a locked position and coupled to an aerosol can, as may be implemented in accordance with various embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims.

DETAILED DESCRIPTION

Aspects of the present disclosure are believed to be applicable to a variety of different types of apparatuses, systems and methods involving dispensing of liquid, such as for dispensing aerosols from pressurized containers. Various embodiments are directed to an apparatus having selectable nozzle apertures and a related locking (or blocking) mechanism that operates to lock and unlock the apparatus for spraying applications. In particular embodiments, a rotatable dial has multiple nozzles and features/cogs that operate to limit or prevent actuation of a trigger mechanism to positions in which the nozzles are aligned for dispensing liquid. While not necessarily so limited, embodiments are characterized in this context.

In a particular embodiment, an aerosol spray cap has multiple spray nozzles coupled to a rotatable structure such as a dial or disk. The rotatable structure operates to selectively align each of the spray nozzles to a channel for receiving and spraying propelled liquid. The spray cap includes an actuator such as a trigger or button coupled to move with the rotatable structure, and which operates to dispense propelled liquid when actuated. The rotatable structure and body of the spray cap have mechanical features that interact to limit movement of the actuator such that the propelled liquid is prevented from being dispensed when one of the spray nozzles is not aligned to the channel.

For instance, the disk may employ a gear and tooth mechanism with gears aligned with the nozzles and a tooth on the cap such that the actuator is allowed to move when one of the gears is aligned to mesh with one of the teeth. The gear is configured relative to the nozzles such that such alignment occurs only when one of the nozzles are aligned to the channel. For positions in which one of the nozzles is not so aligned to the channel, the gear does not mesh with the tooth, and the tooth prevents movement of the gear (and actuator) in a direction toward the tooth. Such a position may effect an "off" or "shipping" position in which the spray cap is inoperable for dispensing liquid.

In a particular embodiment, the spray nozzles are located at respective angular positions around the rotating structure, with a gap between the spray nozzles. The mechanical features may be located such that movement of the actuator is limited when the rotating structure is rotated so that a position between two of the nozzles is aligned with the channel, and such that the actuator is allowed to dispense the propelled liquid when one of the nozzles is aligned to the channel. In this context, the propelled liquid may thus be dispensed via movement of the actuator (and rotatable structure) only when one of the nozzles is aligned to the channel.

In some embodiments, the actuator button may be pivoted from a location opposite to the location of the disk (relative to the actuator button). Pivoting the actuator button may also result actuation of the disk, such as by depressing the disk vertically and/or pivoting the disk. As such, when one of the nozzles is aligned to the channel and force is applied to the actuator, propelled liquid may be dispensed through one of the nozzles. When the disk is rotated such that a position between the nozzles is aligned to the channel, the disk prevents pivoting of the actuator and depression of the disk, preventing dispensing of the propelled liquid. For instance, when coupled to a spray canister such as a spray paint can having a valve, the actuator may be implemented as a button that, when actuated, opens the valve and allows fluid from the spray canister to spray through the channel to a nozzle in the disk that is aligned to the channel.

Certain embodiments are directed to aspects of a spray cap having a rotatable dial with respective nozzles, such as characterized herein, that facilitate vertical movement of an actuator. This may involve movement of a dial and fluid channel in accordance with depression of a button in the vertical direction and/or via a pivot that facilitates vertical movement of the dial and fluid channel relative to the button, and that opens a valve for delivery of fluid for spraying through one of the nozzles. The fluid channel includes a portion extending in the vertical direction and another portion extending horizontally aligned to the nozzles. The button may be attached to the cap (e.g., by a hinge), may be part of the fluid channel, or may be an independent/separate component. Further, the vertical movement/mobility facilitated herewith may be greater than vertical movement utilized to actuate the valve for dispensing the fluid.

The valve may be implemented with a valve stem, for example as utilized with a pressurized container, which opens in response to the valve stem being moved toward the canister and/or otherwise relative to the valve. In such instances, the spray cap has a portion thereof that engages with the valve stem to selectively release fluid into the fluid channel. The spray cap may engage and disengage with such a valve stem, for example utilizing a parallel slip fit, which may facilitate vertical motion that may exceed that utilized to operate the valve for dispensing liquid.

In certain more particular embodiments, a dial as characterized herein may operate to engage and disengage the fluid channel with a valve stem of a can or other component that provides pressurized liquid for spraying. For instance, a valve stem may seal on the fluid channel by locking in a top edge with a small taper that provides a seal while force is applied and is separated when no force is applied. Vertical force may be applied by rotation of the dial, for instance using gears coupled to the dial with pockets that can align a gear in the cap. By rotating the dial, the dial applies force to the angled sides of the gear in the cap and lifts the dial thus raising the spray channel. When the pockets are aligned, the dial and thus spray channel are locked into a vertical groove of the cap which is allowed to slide vertically. This vertical movement disengages/engages the spray cannel from the stem.

The respective nozzles may be implemented in a variety of manners. For instance, each nozzle may be designed to spray a particular type of coating appropriately for corresponding air vapor pressure and fluid properties. In some implementations, a flow restrictor can be used to reduce the pressure applied to a particular nozzle and/or for all nozzles in the dial. This restriction, along with the availability of different nozzles, can provide for a greater range of fluid such as paint, with a single design. In these contexts, a flow restrictor may be placed in the fluid channel for all nozzles, in line for a specific nozzle, or a combination of both.

Certain embodiments involve a rotational feedback system, for instance to provide an indication of alignment of nozzles to a user rotating the dial, so that the user can more readily identify when a nozzle is aligned for spraying. Such feedback may be visual, tactile and/or audible. Visual signifiers may include, for example, indicators such as arrows, numbers, letters or other shapes molded onto the top surface of the cap. Such numbers or letters may correspond to icons explaining characteristics of the nozzle to which they apply.

Tactile identifiers may include a resistive component that provides resistance while the dial is turned, and that provides varied resistance as the dial turns, indicating when the dial is aligned. For instance, the resistance may be greatest between nozzle positions such that as a dial is initially rotated away from an aligned position, the resistance grows until the dial passes half way between two aligned positions and at which point the resistance falls. The resistance may become less or even go negative as the dial reaches the next aligned position. This helps communicate to the user that the dial is in position when it moving out of position or is mid-way between positions.

Resistive or force feedback may be provided in a variety of manners. For instance, when the dial is rotated resistance to rotating the dial between two positions is provided. This force feedback is designed into the product to give the consumer a sense of whether they are in the right position or between positions, with higher force indicative of being between positions and a reduced force being indicative of being in an aligned position for spraying. Such aspects may be implemented with a structural component that extends out from the top of a spray channel and normally sits between two gears on the dial. When the structural component is between the two gears it acts as a lock, resisting the movement of the dial. When enough rotational forces is applied, the structural component is pushed above the gears, allowing the dial to rotate. It may ride along the top face of the gear before slotting into the next groove between two gears, where it again resists or stops the rotation of the dial.

In some embodiments, an elongated post is provided on the front side of the fluid channel that protrudes into the path of the dial. The rear surface of the dial has openings to allow the gear to align with the openings that orientates the dial for spraying. The elongated post on the spray channel slots between theses openings. The post, which may be molded, may be provided with sufficient elasticity and memory that it can move out of the way, as the dial is turned and back into place as the dial moves past it. In such an approach, the dial may be of a material that does not deform, in which the post deforms (bends) and is driven out of the way of the dial as the dial rotates. This approach may be implemented as in the aforementioned embodiment to provide increased resistance as the dial turns between respective nozzle openings, and less resistance once it slots into a new opening (and may hold the dial in place). This system may be bidirectional and provide similar feedback when rotating in either direction.

Various embodiments involve providing an audible sound, such as a "click" sound (e.g., like the sound made by a ratchet as it is turned), as an indicator of nozzle positioning. The sound indicates that the dial is moving between two spray positions or between a spray position and a lock position. The sound may be made whether the dial is turned clockwise or counterclockwise. In a particular embodiment, the sound is made by a small mechanical component that protrudes into the arc of the dial. This mechanical component protrudes from the front edge of the spray channel and interferes with the rotation of the dial. As the dial rotates, the mechanical component is pushed out of the way and when it snaps back into position, it makes a sound.

A more particular audible feedback approach is implemented as follows, in accordance with various embodiments. A small post is provided extending from the fluid channel and placed so that it engages with respective protrusions providing sound/feedback of the dial as the dial is rotated. There may be one such portion to each segmentation (and corresponding nozzle) of the dial. As the dial turns, the post may be bent when it engages with a protrusion until it is released past the protrusion and then snaps back into position. This snap makes an audible sound or "click" that indicates that the dial has passed between positions and has turned into a new position. This feature may also be bidirectional relative to rotation of the dial in respective directions.

Another embodiment is directed to an apparatus including a dial having a planar surface, a fluid supply channel, a plurality of nozzles recessed within the surface of the dial, a gear coupled to the dial and configured to rotate with the dial, and a flexible tab. Each of the nozzles has a fluid channel extending in a direction that is aligned in parallel with the fluid channels of the other nozzles. The dial rotates for selectively aligning each of the respective nozzles with the fluid supply channel. The gear has a plurality of cogs coupled to a rib, each cog and rib being separated by spaces along a rotation path. The flexible tab extends into the rotation path of the ribs and flexes from a relaxed position into a flexed position, in response to one of the ribs being rotated with the dial into contact with the flexible tab. The flexible tab snaps back to the relaxed position and generates an audible noise, in response to the one of the ribs being further rotated with the dial to a position in which the rib moves out of contact with the flexible tab.

In some implementations, the dial, fluid supply channel, gear and flexible tab are configured to operate in a dispensing mode in which fluid is dispensed from the fluid supply channel through the nozzles, by moving collectively together in response to pressure applied to the apparatus in a downward direction parallel to the planar surface of the dial.

In some implementations, the fluid supply channel includes a portion extending in the vertical direction and another portion extending horizontally aligned to the nozzles, and moves vertically with the dial in response to force applied thereto, for spraying fluid through one of the nozzles in the horizontal direction.

The gear may be implemented in one or more of a variety of manners. For instance, the gear may interact with a fixed component of the apparatus, such as a mechanical stop, to selectively dispense fluid from the fluid supply channel or to prevent the fluid from dispensing from the fluid supply channel. In a more particular application, the gear prevents passage of fluid from the fluid supply channel when the dial is positioned with the nozzles out of alignment with the channel, and facilitates dispensing of fluid from the fluid supply channel through one of the nozzles when the dial is positioned such that the fluid channel of the one of the nozzles is aligned with the fluid supply channel. Where the mechanical stop is implemented, the stop may engage one of the cogs to prevent the passage of the fluid from the fluid supply channel when the dial is positioned with the nozzles out of alignment with the channel. The mechanical stop may further align with one of the spaces between the cogs to facilitate the dispensing of the fluid from the fluid supply channel through the one of the nozzles, when the dial is positioned such that the fluid channel of the one of the nozzles is aligned with the fluid supply channel. An actuator may be coupled to the dial to facilitate dispensing of the fluid from the fluid supply channel through the one of the nozzles, via movement of the actuator and dial for dispensing the fluid when the cogs are aligned such that one of the spaces between the cogs is engaged with the mechanical stop.

The flexible tab may be implemented in a variety of manners. In one embodiment, the flexible tab includes a fixed end that is fixed in place relative to the dial, and a free end that contacts the ribs as they are rotated into the flexible tab. The free end flexes to the flexed position while the fixed end remains fixed in place. The apparatus may include a spray cap configured to couple to an aerosol can for receiving fluid into the fluid supply channel, with the fixed end of the flexible tab anchored to a portion of the spray cap that remains fixed in place relative to the dial as the dial is rotated.

The apparatus may further include an actuator to actuate a valve to release propelled liquid through the fluid supply channel into one of the nozzles aligned to the fluid supply channel. In such instances, the fluid supply channel may include a portion extending in the vertical direction and another portion extending horizontally aligned to the nozzles, and move vertically with the dial in response to force applied thereto via the actuator for actuating the valve and releasing the propelled liquid.

In a more particular embodiment, the apparatus includes a second flexible tab extending into the rotation path and operable as follows. In response to one of the cogs being rotated with the dial into contact with the second flexible tab, the second flexible tab flexes from a relaxed position into a flexed position and apply resistance to rotation of the dial via contact with the one of the cogs. In response to the one of the cogs being further rotated with the dial to a position in which the cog moves out of contact with the second flexible tab, the second flexible tab returns to the relaxed position in which the second flexible tab resides between the one of the cogs and another one of the cogs. In certain implementations, the second flexible tab includes a fixed end that is fixed in place relative to the dial, and a free end that contacts the cogs of the dial as they are rotated into the second flexible tab, and that flexes to the flexed position while the fixed end remains fixed in place. The apparatus may further include a spray cap that couples to an aerosol can for receiving fluid into the fluid supply channel, with the fixed end anchored to a portion of the spray cap that remains fixed in place relative to the dial as the dial is rotated. The spaces defined by the cogs may have a consistent width, and the second flexible tab may have a width corresponding to the consistent width such that the second flexible tab resides in the space between two of the cogs when aligned to the space with one of the plurality of nozzles aligned to the fluid supply channel. In a further implementation, the second flexible tab applies a force to the cogs that resists rotation of the dial, by engaging edges of the second flexible tab with the cogs adjacent the second flexible tab when the flexible tab is aligned to the space, therein facilitating alignment of the nozzles to the fluid supply channel.

Another embodiment is directed to an apparatus including a dial having a plurality of nozzles and a gear, and a flexible tab. The dial rotates for selectively aligning each of the respective nozzles for receiving fluid to be dispensed via the nozzles. The gear has cogs coupled to a rib, each cog and rib being separated by spaces along a rotation path. The flexible tab extends into the rotation path of the ribs and flexes from a relaxed position into a flexed position in response to one of the ribs being rotated with the dial into contact with the flexible tab. The flexible tab snaps back to the relaxed position and generates an audible noise indicating that rib has moved past the flexible tab, in response to the one of the ribs being further rotated with the dial to a position in which the rib moves out of contact with the flexible tab. In some implementations, the dial has a planar surface and each of the nozzles has a fluid channel extending in a direction aligned in parallel with the fluid channels of the other nozzles, for example to facilitate spraying fluid from the planar surface in a direction perpendicular thereto.

In a more particular implementation, the apparatus further includes a spray cap, with the dial coupled to the spray cap via an interface that facilitates rotation of the dial relative to the spray cap. The flexible tab is anchored to the spray cap and extends therefrom into the rotation path of the ribs, with the dial coupled to the spray cap. The spray cap includes a fluid supply channel to supply the fluid, and an actuator for moving the dial, flexible tab and fluid supply channel in the vertical direction in response to pressure applied thereto, for dispensing fluid via one of the nozzles aligned to the horizontal portion of the fluid supply channel. The fluid supply channel includes a horizontal portion extending in parallel with the nozzles and a vertical portion feeding the horizontal portion. The dial selectively aligns each of the respective nozzles to the horizontal portion for receiving the fluid.

The cogs may further operate as follows. In response to one of the nozzles being aligned to receive fluid from the fluid supply channel, the cogs permit movement of the dial, flexible tab and fluid supply channel via the actuator for dispensing the fluid. In response to none of the nozzles being aligned to receive fluid from the fluid supply channel, the cogs prevent movement of the dial, flexible tab and fluid supply channel via the actuator and therein preventing fluid from being dispensed via the nozzles. In a further implementation, the spray cap includes a mechanical stop configured to interface with the cogs to facilitate the selective dispensing of fluid. For instance, the mechanic stop and cogs may be configured such that when one of the nozzles is aligned to receive fluid from the fluid supply channel, a gap between the cogs is aligned to the mechanical stop to permit movement of the dial, flexible tab and fluid supply channel vertically via the actuator. When one of the cogs is aligned vertically over the mechanical stop, the mechanical stop may prevent vertical movement of the dial, flexible tab and fluid supply channel by engaging with the one of the cogs.

Another embodiment is directed to an apparatus having a liquid supply channel, a rotatable dial, an actuator and a locking mechanism. The rotatable dial has a plurality of nozzles, separated from one another by a portion of the rotatable dial, and is operable to align each of the respective nozzles with the channel for receiving and spraying propelled liquid received via the channel. For instance, the apparatus may include a sleeve coupled to the channel and actuator, with the rotatable dial having a shaft coupled to the sleeve and configured to rotate within the sleeve. The actuator is operable to release the propelled liquid into the channel by actuating a valve. The locking mechanism operates with the rotatable dial to prevent actuation of the valve and block delivery of the propelled liquid to the channel, by preventing movement of the actuator when the rotatable dial is positioned so that the nozzles are not aligned with the channel. The locking mechanism further operates with the rotatable dial to allow the actuator to move for actuating the valve and delivering the propelled liquid to the one of the nozzles via the channel, when the rotatable dial is positioned with one of the nozzles aligned with the channel. Accordingly, the locking mechanism may operate to prevent unwanted dispensing of liquid, for instance while rotating the dial for aligning a nozzle having a particular size, or while stored or shipped.

The actuator may be implemented in a variety of manners. In some embodiments, the actuator includes a button mechanism, such as a spray button for a spray can, which opens the valve when depressed with the rotatable dial positioned such that one of the nozzles is aligned with the channel. The locking mechanism thus facilitates the movement of the actuator when the nozzle is so aligned. The button mechanism, dial and channel may be coupled and move together in response to depression of the button. In certain implementations, a pivot structure is coupled to the button mechanism. The pivot structure operates to facilitate movement of the actuator by pivoting the button mechanism about the pivot structure, therein actuating the dial and channel (e.g., downward to dispense propelled liquid from a canister).

In some embodiments, the locking mechanism includes a mechanical stop and a gear coupled to rotate with the dial (or the gear may be part of the dial). The gear has cogs and recessed regions between the cogs located relative to the nozzles and the mechanical stop, so that one of the cogs is aligned to the mechanical stop and prevents the button from pivoting to actuate the valve when the rotatable dial is positioned with the nozzles out of alignment with the channel. When the rotatable dial is positioned with one of the nozzles aligned with the channel, one of the recessed regions is aligned for meshing with the mechanical stop, which allows the button to pivot about the pivot structure and actuate the valve for delivering the propelled liquid to the one of the nozzles via the channel.

The cogs may include a cog corresponding to each space between adjacent ones of the nozzles, such that one of the cogs is aligned to the mechanical stop at all instances in which space between any adjacent ones of the nozzles is aligned to the channel. One of the recessed regions may further be aligned to mesh with the mechanical stop for allowing movement of the button for actuating the valve at all instances in which one of the nozzles is aligned to the channel.

In certain implementations, the locking mechanism includes a mechanical stop and a gear coupled to rotate with the dial. The gear operates with the mechanical stop to prevent actuation of the actuator when the nozzles are not aligned to the channel. The gear may include a recessed region configured to mesh with the mechanical stop. Further, the locking mechanism may include a pivot arm coupled to the actuator. The pivot arm operates with the cog and gear to actuate the valve when the recessed region is meshed with the mechanical stop.

The apparatus may include the valve and a liquid container coupled to the valve. The liquid supply channel, rotatable dial, actuator and locking mechanism may be part of a cap coupled to the container. The cap may operate to spray liquid from the container through one of the nozzles in response to the actuator being depressed, when the nozzle is aligned to the channel, by actuating the valve and therein causing the container to propel liquid through the valve, channel and nozzle.

The button may be coupled to a pivot and further be operable to actuate the valve in response to force applied to the button that causes the button to pivot and depress the channel, dial and valve vertically. This depression causes the propelled liquid to be dispensed when the rotatable dial is positioned with one of the nozzles aligned with the channel.

In certain embodiments, the channel, dial and actuator may be coupled to a pivot and operable to actuate the valve in response to force applied to the actuator, which causes the channel, dial and actuator to rotate about the pivot when the rotatable dial is positioned with one of the nozzles aligned with the channel.

Another embodiment is directed toward a nozzle apparatus having a channel, an actuator, a mechanical stop, and a dial having nozzles and a gear. The dial is operable to rotate for selectively aligning each of the respective nozzles with the channel. The gear has a plurality of cogs and recessed regions between adjacent ones of the cogs, and operates with the mechanical stop to prevent movement of the actuator when the dial is positioned such that none of the nozzles is aligned with the channel. For instance, the gear may be operable to mesh one of the recessed regions with the mechanical stop to facilitate movement of the actuator when the dial is positioned with one of the nozzles aligned with the channel. Such an apparatus may be useful, for example, to prevent unintentional actuation and therein prevent unintentional dispensing of fluid via the nozzles.

The nozzle apparatus may be implemented in a variety of manners. For instance, the cogs may be aligned relative to the nozzles so that one of the recessed regions is aligned to mesh with the mechanical stop and therein facilitate movement of the actuator, when one of the nozzles is aligned to the channel. When none of the nozzles is aligned to the channel, one of the cogs is aligned to engage with the mechanical stop and therein prevent movement of the actuator. The actuator may include a button that is part of a pivot arm coupled to a pivot point, with the pivot arm being operable to pivot about the pivot point in response to pressure applied to the button when one of the recessed regions is aligned to mesh with the mechanical stop. This pivoting may cause movement of the actuator such that the dial moves vertically which opens a valve for dispensing propelled liquid. The nozzle apparatus may include a fluid container and such a valve coupled to the actuator for dispensing fluid from the container into the channel, in response to movement of the actuator. For instance, paint may be dispensed from the fluid container, in response to depression of a button as noted above, which causes downward movement of the actuator and opens the valve.

In a more particular embodiment, the dial of the nozzle apparatus operates to selectively align each of the respective nozzles with the channel for receiving and spraying propelled liquid received via the channel. The actuator operates to release the propelled liquid into the channel by actuating a valve. The gear and mechanical stop form a locking mechanism that operates with the dial to prevent actuation of the valve and block delivery of the propelled liquid to the channel, by preventing movement of the actuator when the dial is positioned with the nozzles out of alignment with the channel. The locking mechanism further operates to facilitate movement of the actuator to actuate the valve and deliver the propelled liquid to the one of the nozzles via the channel, when the dial is positioned with one of the nozzles aligned with the channel.

Figure 2:
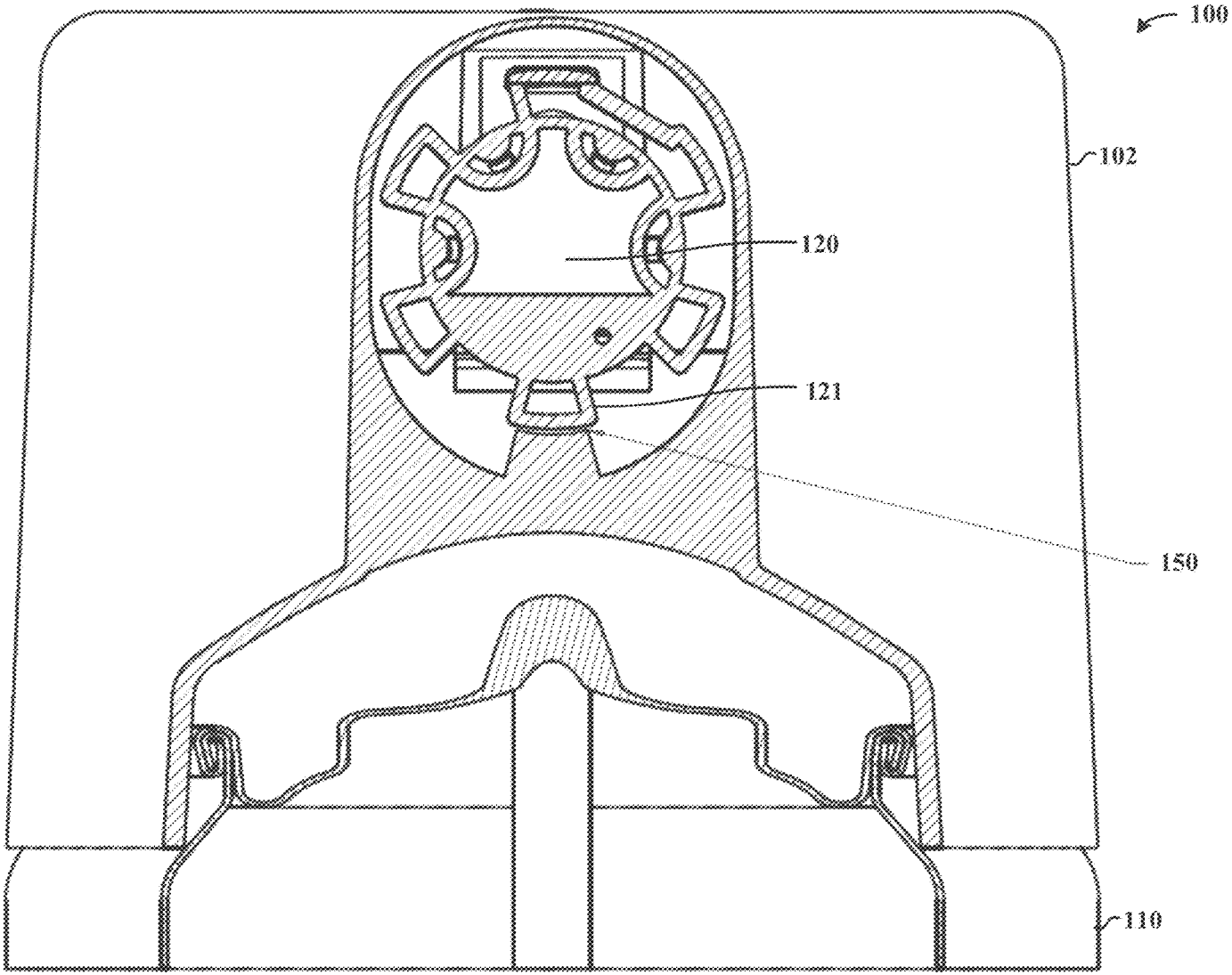
FIG. 2 shows a cross sectional view of the nozzle in the apparatus in the locking position as shown in FIG. 1, in accordance with an example embodiment.
Figure 3:
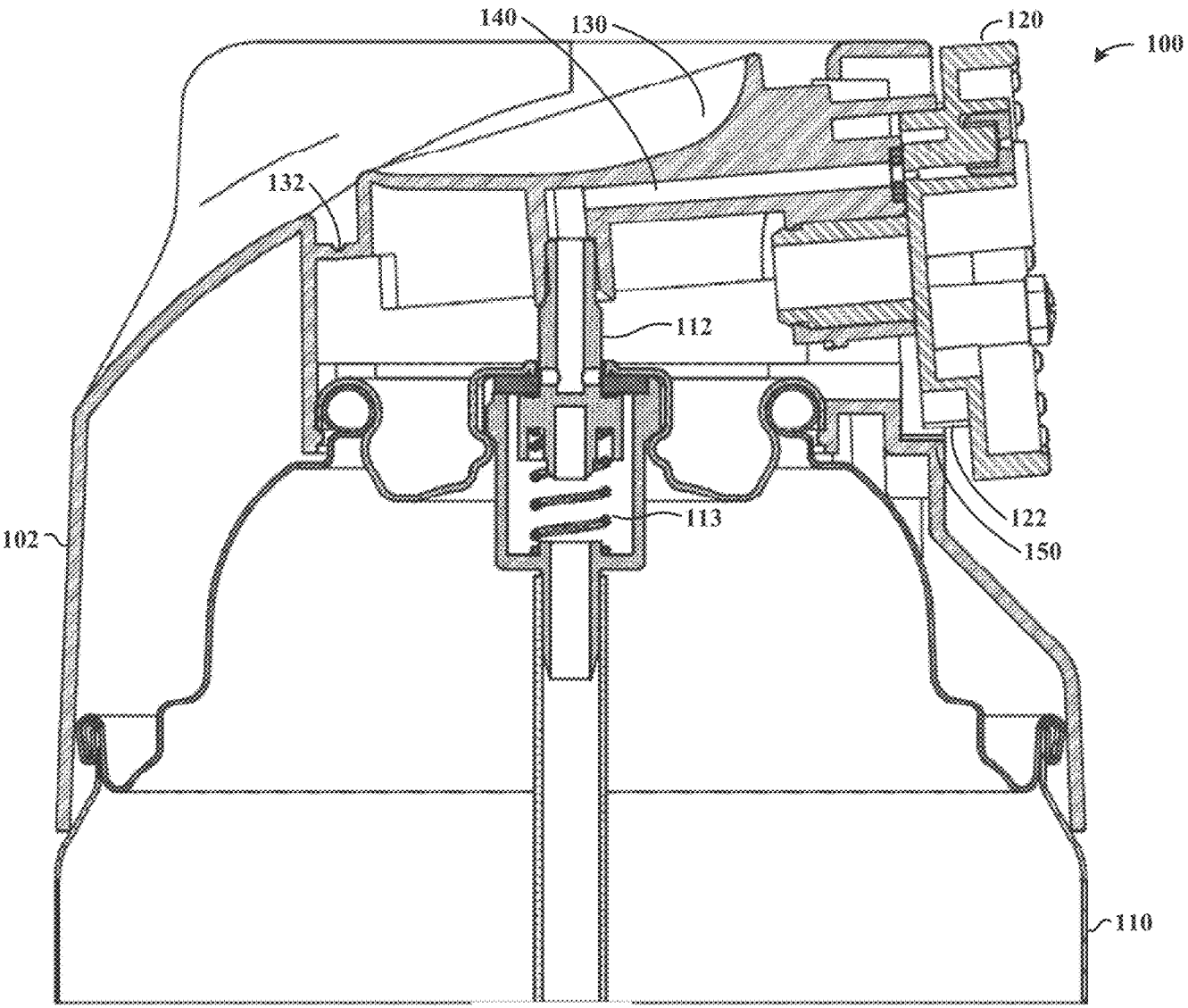
FIG. 3 shows a cross sectional view of the apparatus in FIG. 1, in an unlocked position, in accordance with an example embodiment.
Figure 4:
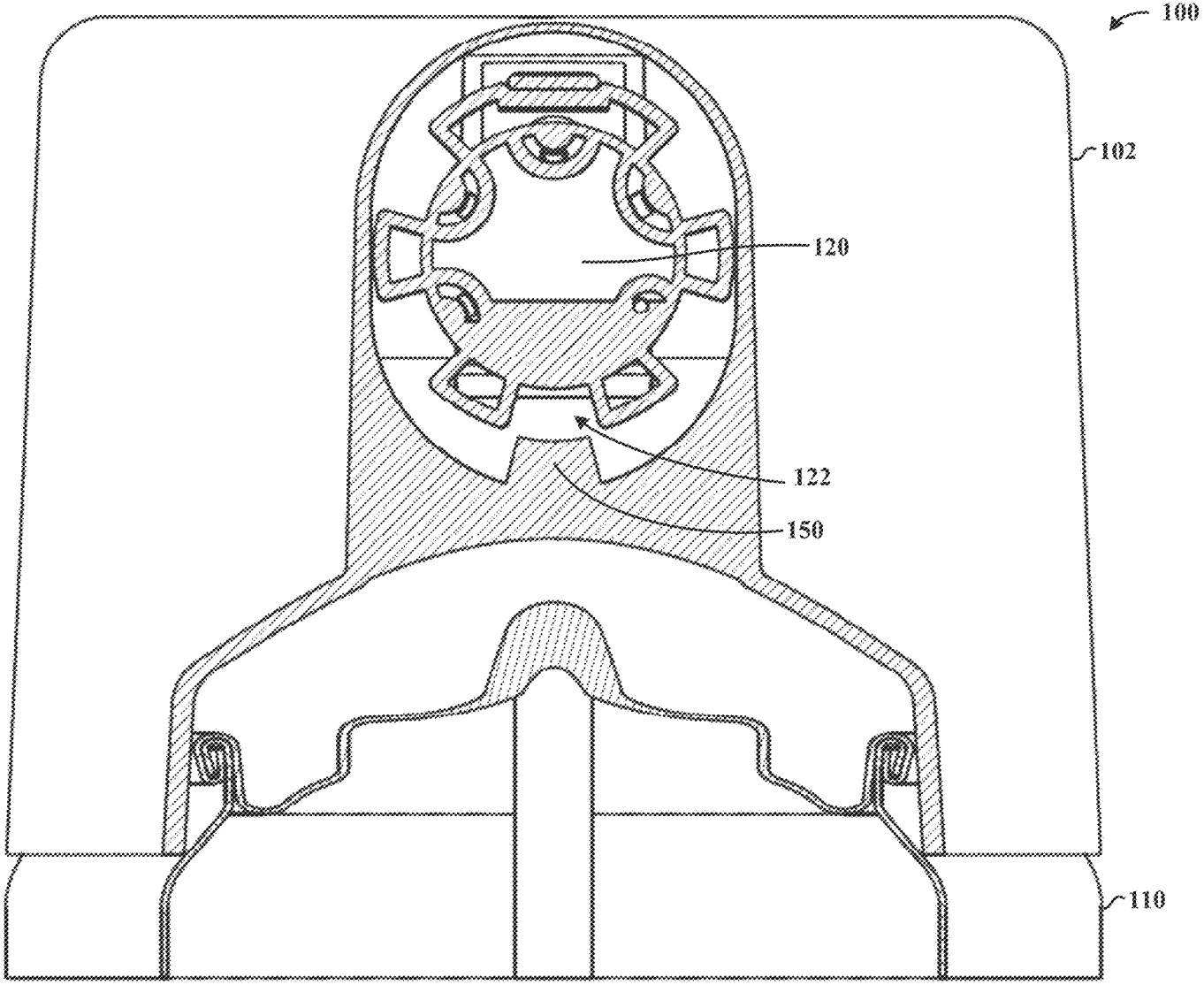
FIG. 4 shows a cross sectional view of the nozzle in the apparatus in the unlocked position as shown in FIG. 3, in accordance with an example embodiment.
Figure 5:
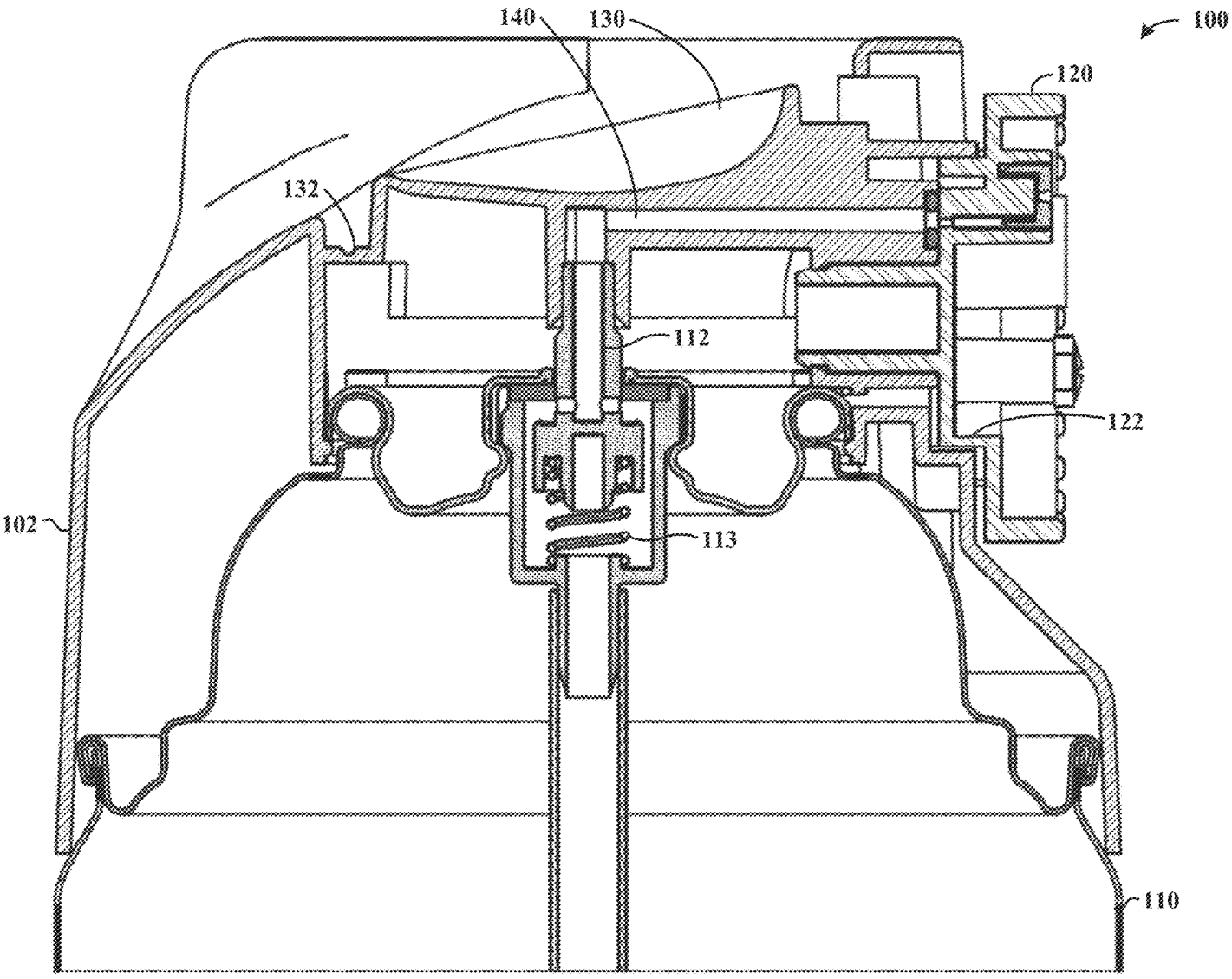
FIG. 5 shows a cross sectional view of the apparatus in FIG. 1, in an unlocked position and with a trigger in an actuated position for spraying aerosol liquid, in accordance with an example.
Figure 6:
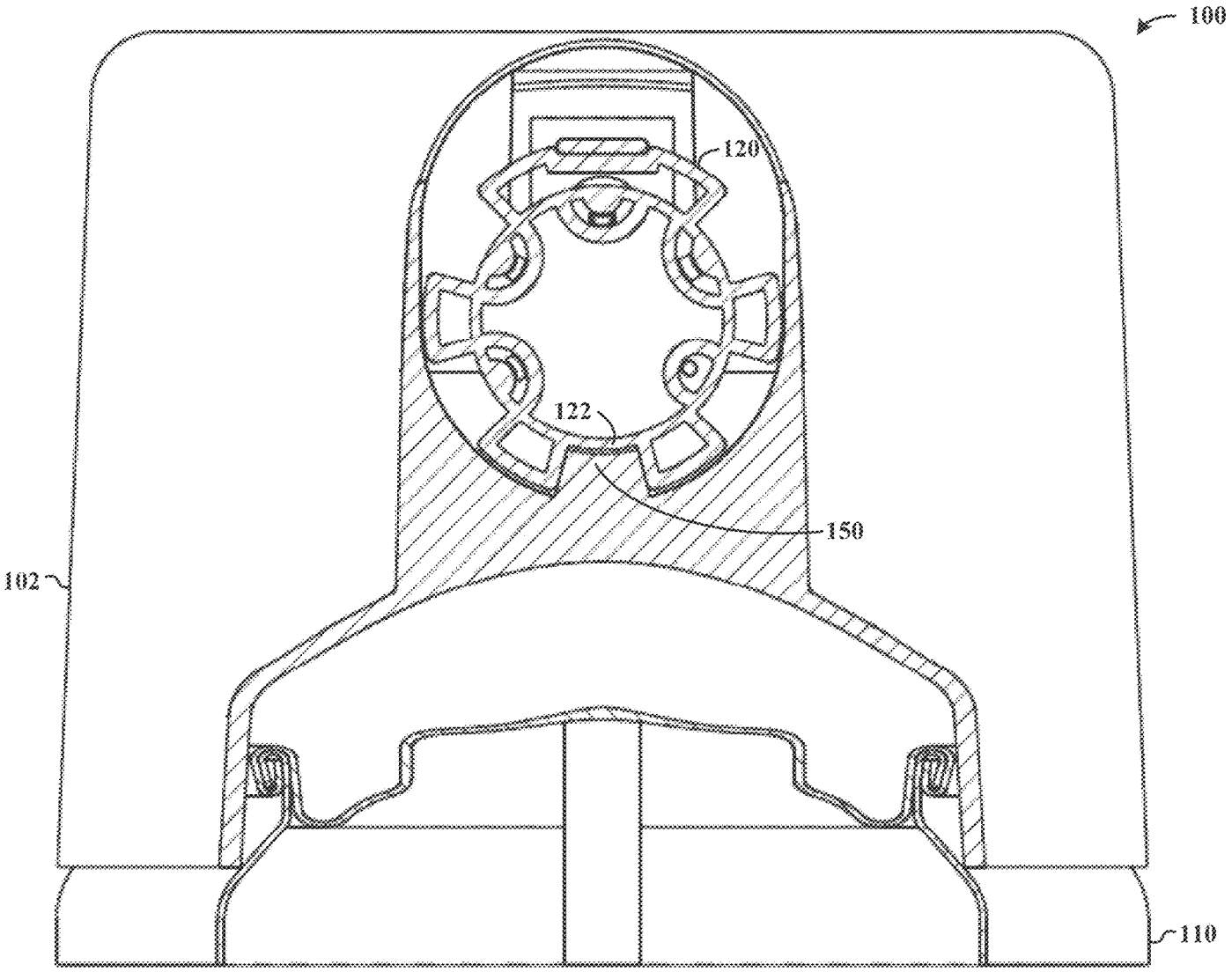
FIG. 6 shows a cross sectional view of the nozzle in the apparatus in the unlocked position with trigger actuated as shown in FIG. 5, in accordance with an example embodiment.

Turning now to the figures, FIGS. 1-6 show an apparatus 100 having a rotatable spray nozzle dial 120 with multiple apertures and a corresponding locking mechanism (using 121/150), as may be implemented in accordance with various embodiments. FIG. 1 shows a cross sectional view of the apparatus in a locked position, FIG. 3 shows a cross sectional view of the apparatus in an unlocked position, and FIG. 5 shows a cross sectional view of the apparatus in an unlocked position and actuated for spraying. FIGS. 2, 4 and 6 show cross-sectional views of dial 120 respectively in the locked, unlocked, and unlocked and actuated positions.

Referring to FIG. 1, the apparatus 100 includes a cap body 102 that is shown coupled to a canister 110, such as an aerosol can. The apparatus 100 is shown in a locked position in which a gear 121 on the dial is engaged with a tooth 150 of the cap body 102. Referring to FIG. 2, this locked position is further shown in cross-section, with a cog portion of the gear 121 engaged with the tooth 150, such that the tooth prevents the dial from being actuated in a downward directly as depicted in the figure. The dial 120 is connected to a button 130 (actuator), and has a shaft 129 coupled to a sleeve 141 in the cap body 102. The shaft 129 may rotate within the sleeve to facilitate rotation of the dial 120 and alignment of nozzles in the cap with channel 140. The channel 140 is further configured for alignment with a valve, by way of example shown with valve 112 of canister 110, for actuating the valve and delivering propelled liquid from the valve to nozzles in the dial 120.

Referring to FIGS. 3 and 4, the apparatus 100 is shown in an unlocked position in which the button 130 is free to move. Specifically, the dial 120 is in a position such that one of the nozzles therein is aligned to the channel 140, and further that the gear of the dial is aligned to mesh with the tooth 150, with a space 122 between cogs of the gear aligned over the tooth. In this position, the button 130 may be depressed and released to actuate valve 112, with spring 113 operating to maintain the valve 112 in a closed position when the button is not depressed.

Referring to FIGS. 5 and 6, the apparatus 100 is shown in the unlocked position with the button 130 actuated for spraying liquid, as may be released by the valve 112 from the canister 110 upon actuation. As shown in FIG. 5, the button 130 has been actuated downward toward the valve 112, compressing the spring 113 and opening the valve. Liquid from the canister 110 may thus be propelled via the channel to a nozzle in the dial 120. As shown in FIG. 6, the tooth 150 is meshed with the gear of the dial 120, into a region 122 between respective cogs of the gear in this actuated position.

In some embodiments, the apparatus 100 includes a pivot 132 about which the button 130 and dial 120 pivot. For instance, the pivot 132 may include a flexible portion of the cap body 102 that operates to bend in response to pressure applied to the button 130, a hinge, and/or other componentry that allows the button, dial 120 and related structure to actuate as shown in FIGS. 3 and 5.

Figure 7:
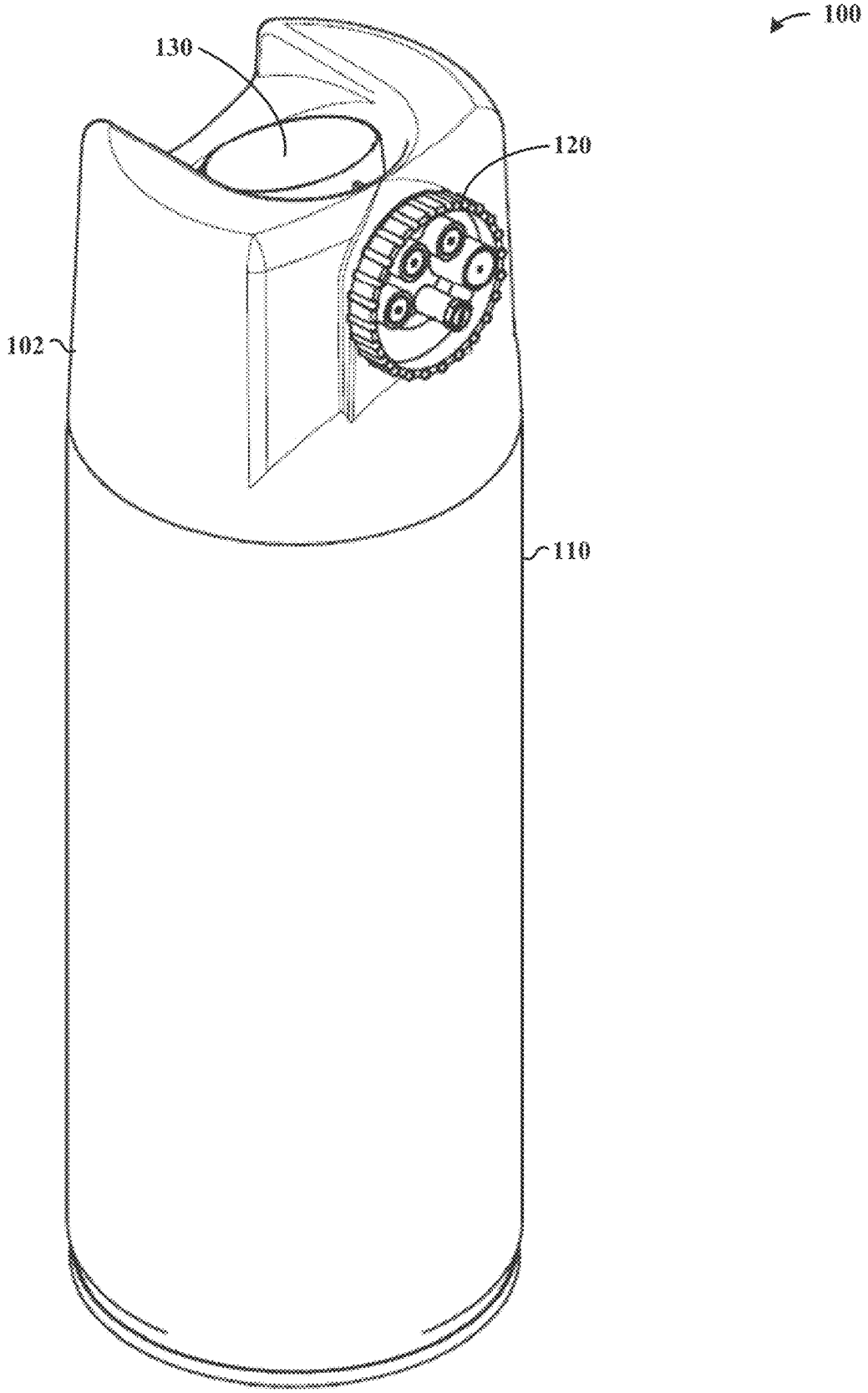
FIG. 7 shows an oblique view of an apparatus having a rotatable spray nozzle dial with multiple apertures and a corresponding locking mechanism, as may be implemented in accordance with one or more embodiments.
Figure 8:
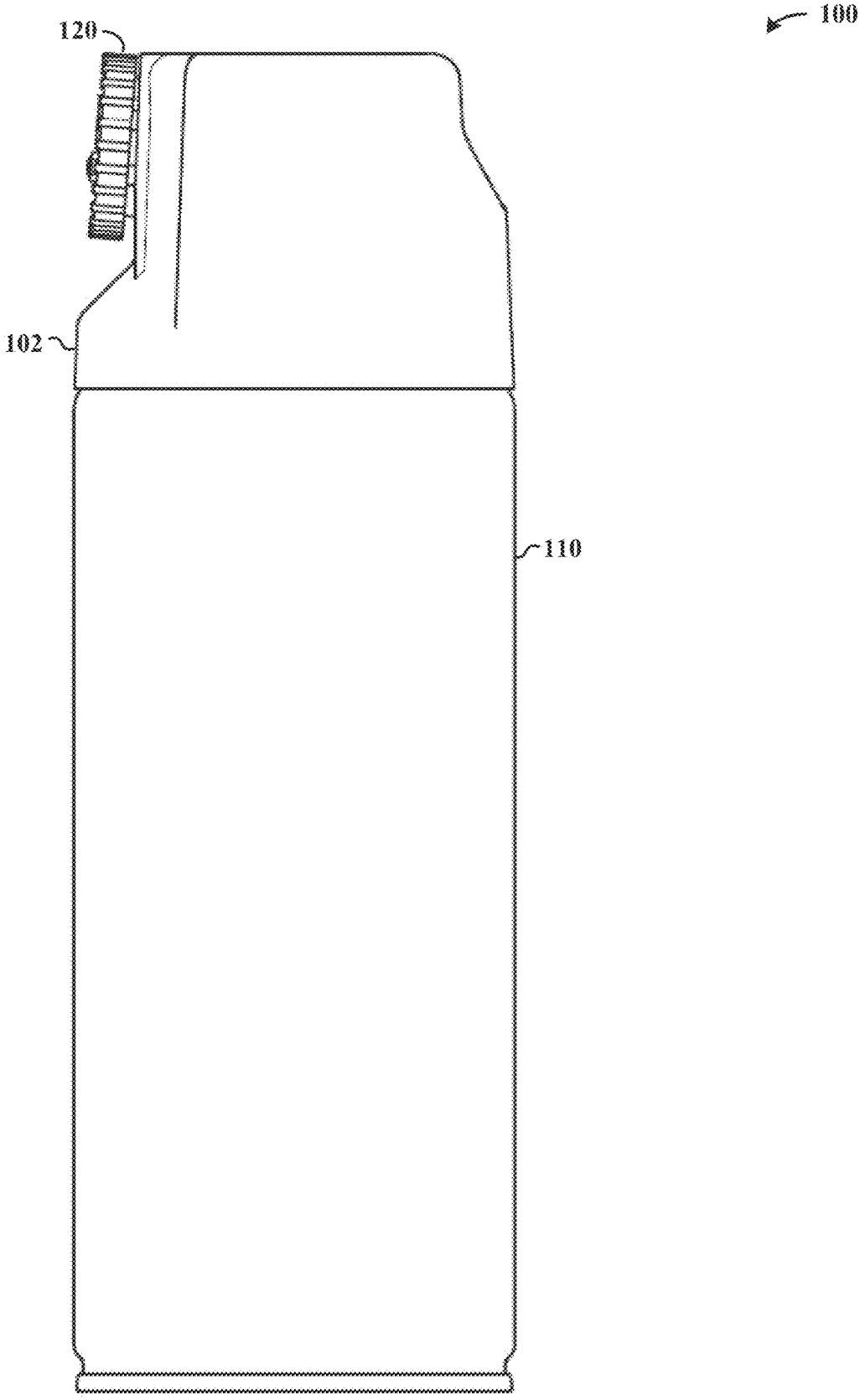
FIG. 8 shows a side view of the apparatus depicted in FIG. 7.
Figure 9:
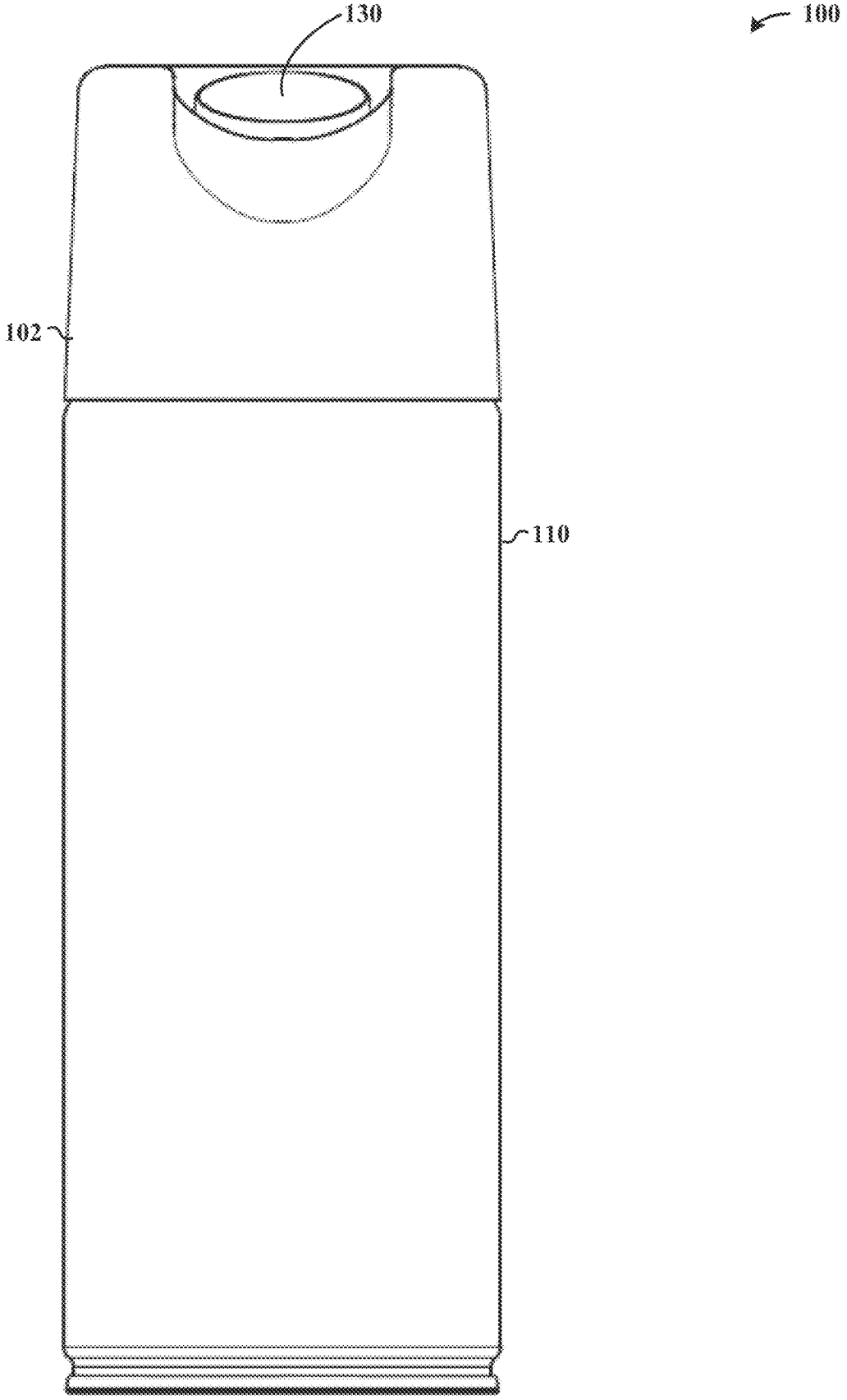
FIG. 9 shows a rear view of the apparatus depicted in FIG. 7.
Figure 10:
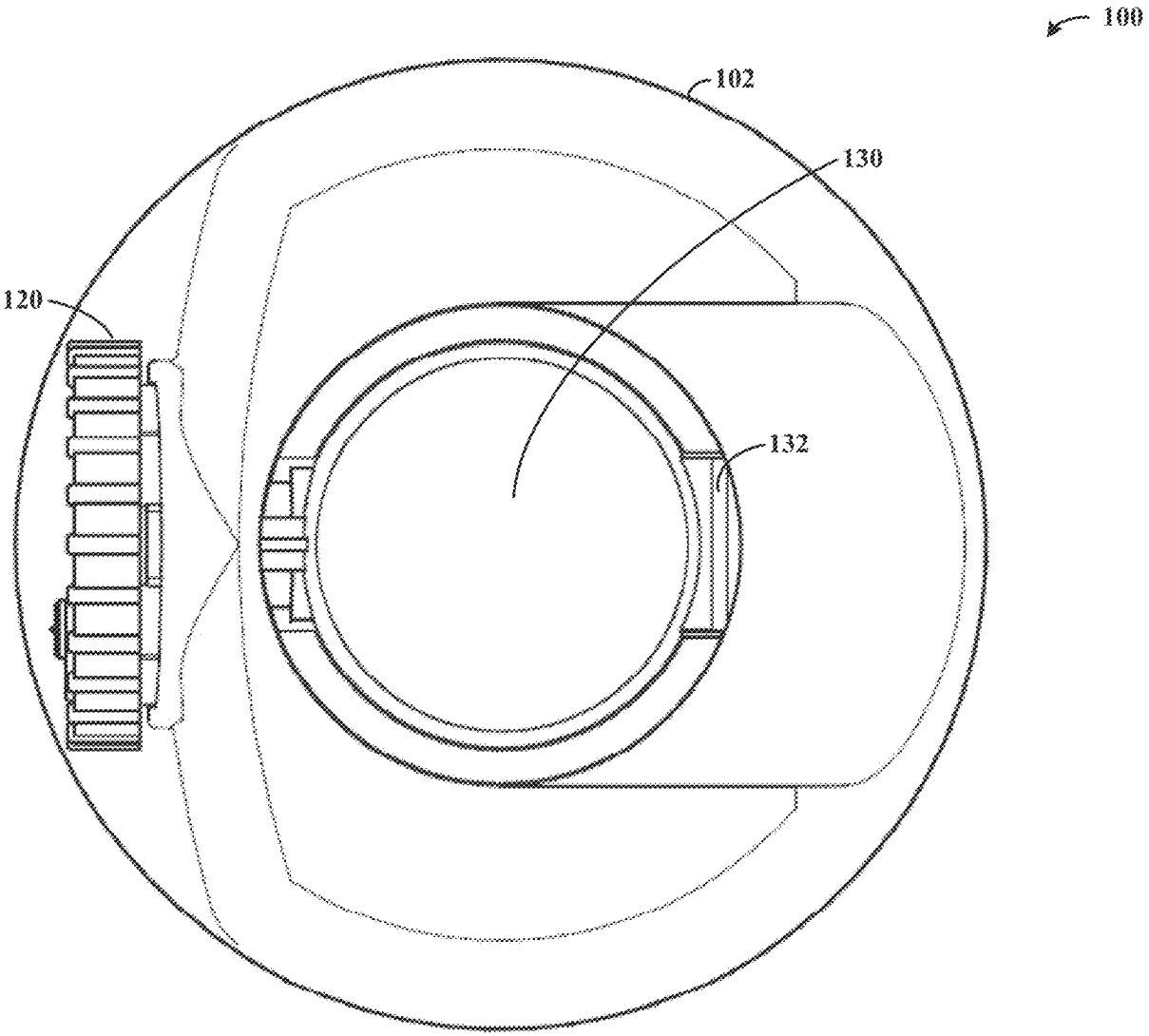
FIG. 10 shows a top view of the apparatus depicted in FIG. 7, as may be implemented in accordance with one or more embodiments.

FIG. 7 shows an oblique view of an apparatus 100 having a rotatable spray nozzle dial with multiple apertures, and a corresponding locking mechanism, as may be implemented in accordance with one or more embodiments. FIGS. 8, 9 and 10 respectively show side, rear and top views of the apparatus depicted in FIG. 7. Each of these figures may be implemented, for example, utilizing the apparatus depicted in FIGS. 1-6. Accordingly, similarly numbering is used for similar components. The apparatus 100 includes a cap body 102, a spray dial 120 and a button 130, with the cap body 102 coupled to a canister 110. The dial 120 is depicted having five nozzles. However, fewer or more nozzles, or nozzles of other sizes and/or shapes are implemented, in accordance with various embodiments.

The apparatus includes a locking mechanism integrated with the dial 120 and cap body 102, for selectively operating in a locked position in which the button 130 is prevented from being depressed, and in an and unlocked position in which button 130 is allowed to actuate. This locking mechanism may be implemented, for example, using a gear and tooth as depicted in FIGS. 1-6. The dial 120 is operable for placing the locking mechanism in an unlocked position by rotating to align one of the nozzles to a channel within the cap body 102 for receiving propelled liquid from the canister 110. In response to the button 120 being pressed when the dial 120 is in the unlocked position corresponding to the aforementioned nozzle alignment, liquid is propelled from the canister 110 through the aligned nozzle in dial 120. The dial 120 is further operable for placing the locking mechanism in a locked position by rotating such that the nozzles are not aligned to the channel, under which conditions depression of the button is blocked. In this context, the dial 120 may move/actuate with the button 130 as it is depressed and released, for instance using a hinge or pivot type mechanism as depicted herein or otherwise.

Figure 11:
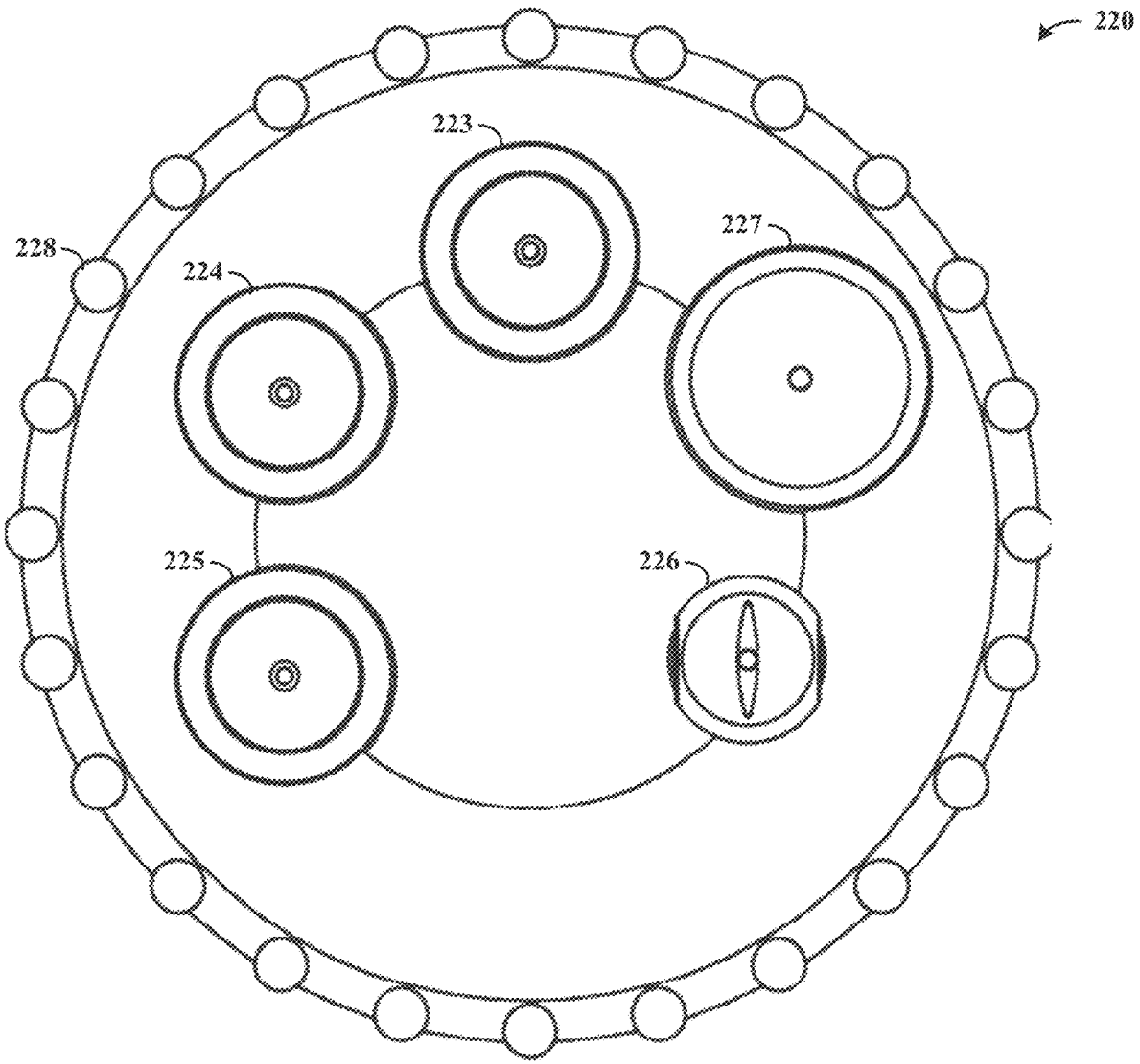
FIG. 11 shows a front view of a rotatable dial with multiple spray nozzles, as may be implemented in accordance with one or more embodiments.

FIGS. 11-14 depict various embodiments involving rotatable dials, which may be implemented together. Further, the respective embodiments may be implemented with one or more aspects of FIGS. 1-10, such as with dial 120. FIG. 11 shows a front view of a rotatable dial 220 having multiple spray nozzles 223-227. The rotatable dial 220 may have raised features 228, which provide grip for rotation. When implemented with the embodiment shown in FIG. 5, the apparatus 100 may thus operate to spray liquid through one of the nozzles 223-227 that is aligned to channel 140, upon actuation of button 130. For instance, with channel 140 positioned as shown in FIG. 5 and nozzle 223 shown in FIG. 11 aligned to the channel, fluid such as paint may be sprayed through the nozzle 223 when the button 130 is depressed.

Figure 12:
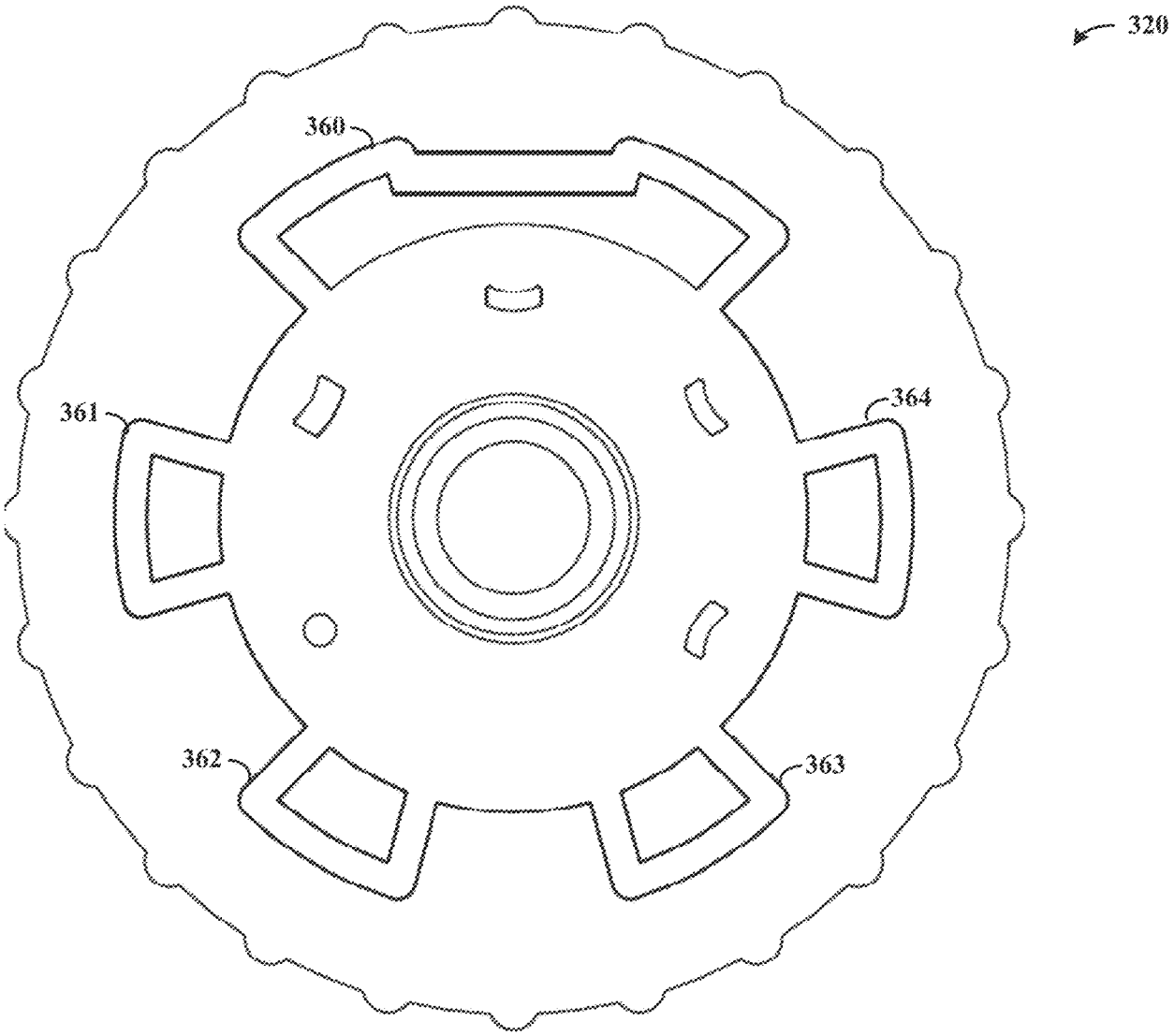
FIG. 12 shows a rear view of a rotatable dial with a locking mechanism, as may be implemented in accordance with one or more embodiments.

FIG. 12 shows a rear view of a rotatable dial 320 with a locking mechanism, as may be implemented in accordance with one or more embodiments. The locking mechanism includes a gear having cogs 360-364, and recessed regions between the cogs. The cogs 360-364 are configured to interact with a tooth or other structure to prevent movement of the dial 320. For instance, when implemented with the embodiment shown in FIGS. 1 and 2, one of the cogs (e.g., 363) may be utilized to interact with tooth 150 in a manner as shown in FIG. 2 with gear portion 121 contacting the tooth. Similarly when implemented with the embodiment shown in FIGS. 5 and 6, the recessed region between cogs 363 and 363 may be aligned to tooth 150, allowing actuation of the rotatable dial 320 and dispensing of liquid. When implemented with the rotatable dial 220 of FIG. 11, the positions of the respective dials 320 and 220 may be as depicted in these figures with nozzle 223 aligned with channel 140 for spraying upon meshing of the region between cogs 362 and 363 with tooth 150.

Figure 13:
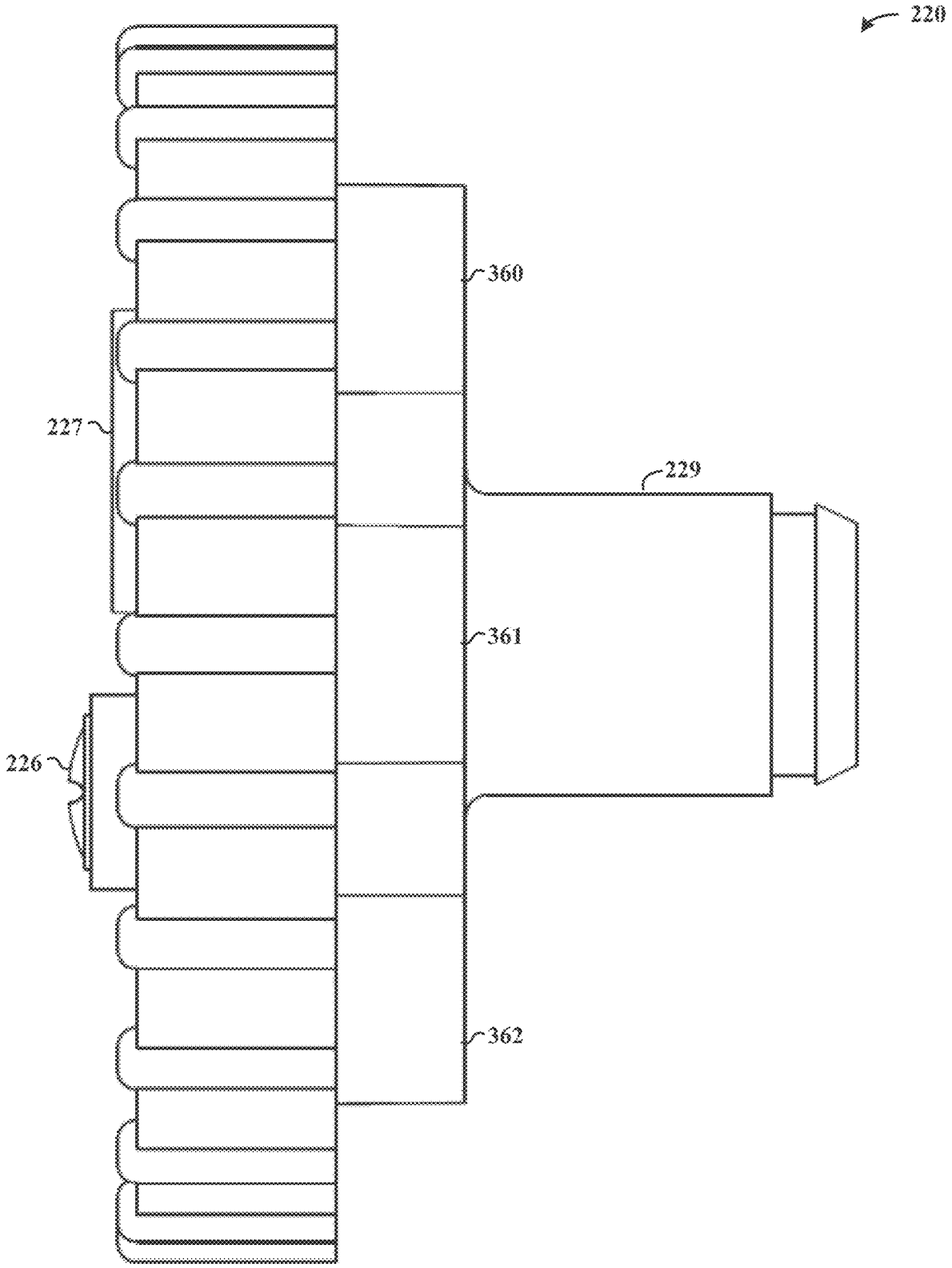
FIG. 13 shows a side view of a rotatable dial with multiple spray nozzles, as may be implemented in accordance with one or more embodiments.
Figure 14:
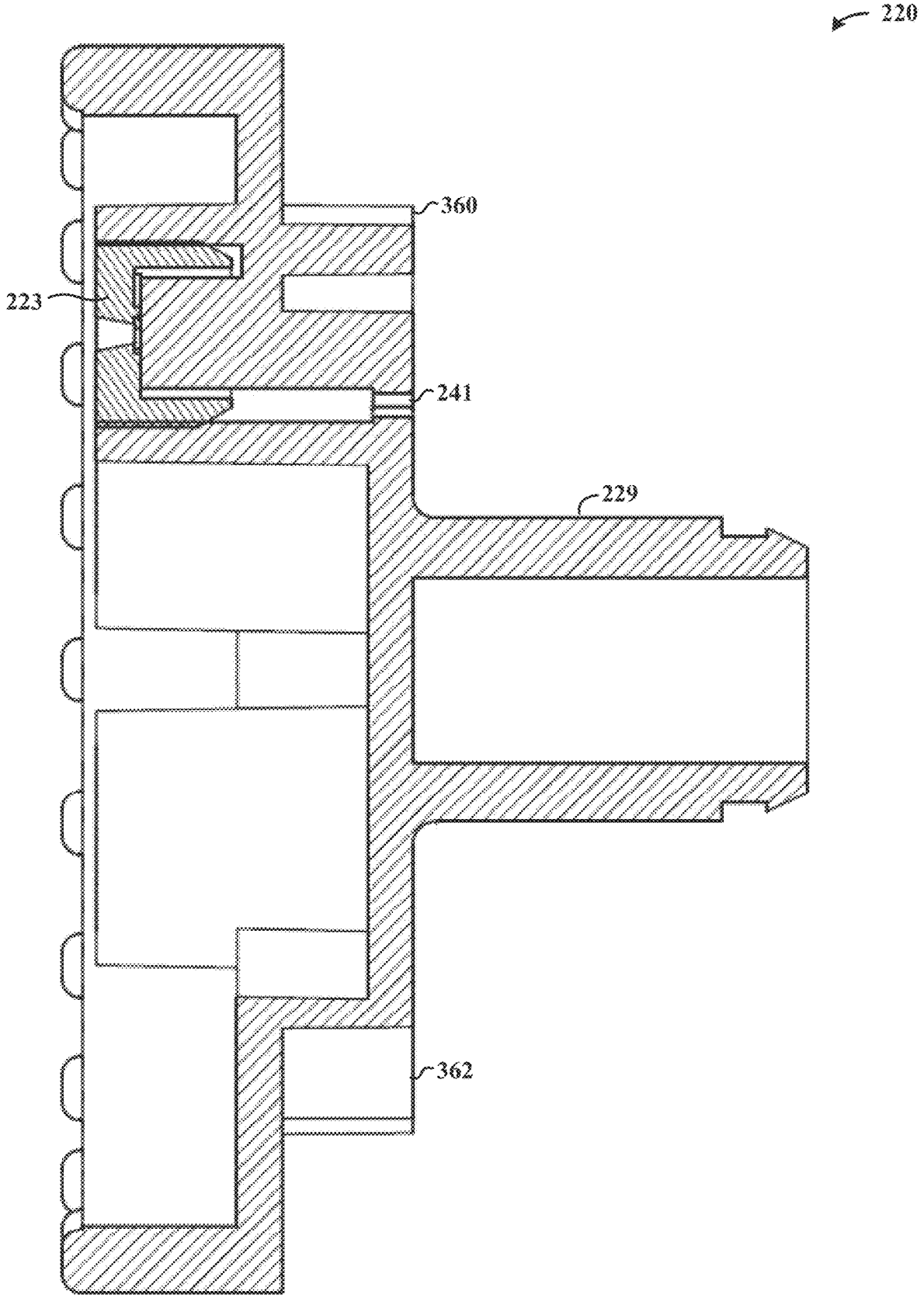
FIG. 14 shows a cross-sectional view of the rotatable dial shown in FIG. 13, as may be implemented with one or more embodiments.

FIGS. 13 and 14 respectively show side and cross-sectional views of an embodiment the rotatable dial 220 of FIG. 11, as may be implemented in accordance with one or more embodiments. In this embodiment, the rotatable dial 220 has a shaft 229 configured for engaging with a sleeve for rotation of the rotatable dial 220 and alignment of the spray nozzles 223-227. This embodiment further utilizes a gear as depicted in FIG. 12, with cogs 360, 361 and 362 visible in the position shown. This embodiment of the rotatable dial 220 may be implemented, for example, as the dial 110 as shown in FIG. 1, with the shaft 229 corresponding to shaft 129 and operable for engagement with the sleeve 141.

Referring specifically to FIG. 14, a channel 241 is configured for selective alignment with another channel (e.g., channel 140) for receiving propelled liquid and coupling that propelled liquid to spray nozzle 223. Each respective one of the spray nozzles 224-227 have similar channels that are operable for alignment for receiving propelled liquid. Cogs, including visible cogs 360 and 362, are accordingly arranged to facilitate actuation of the rotatable dial 220 when in the position shown, or in positions in which one of the other spray nozzles 224-227 is rotated into the position in which spray nozzle 223 is depicted.

Figure 15:
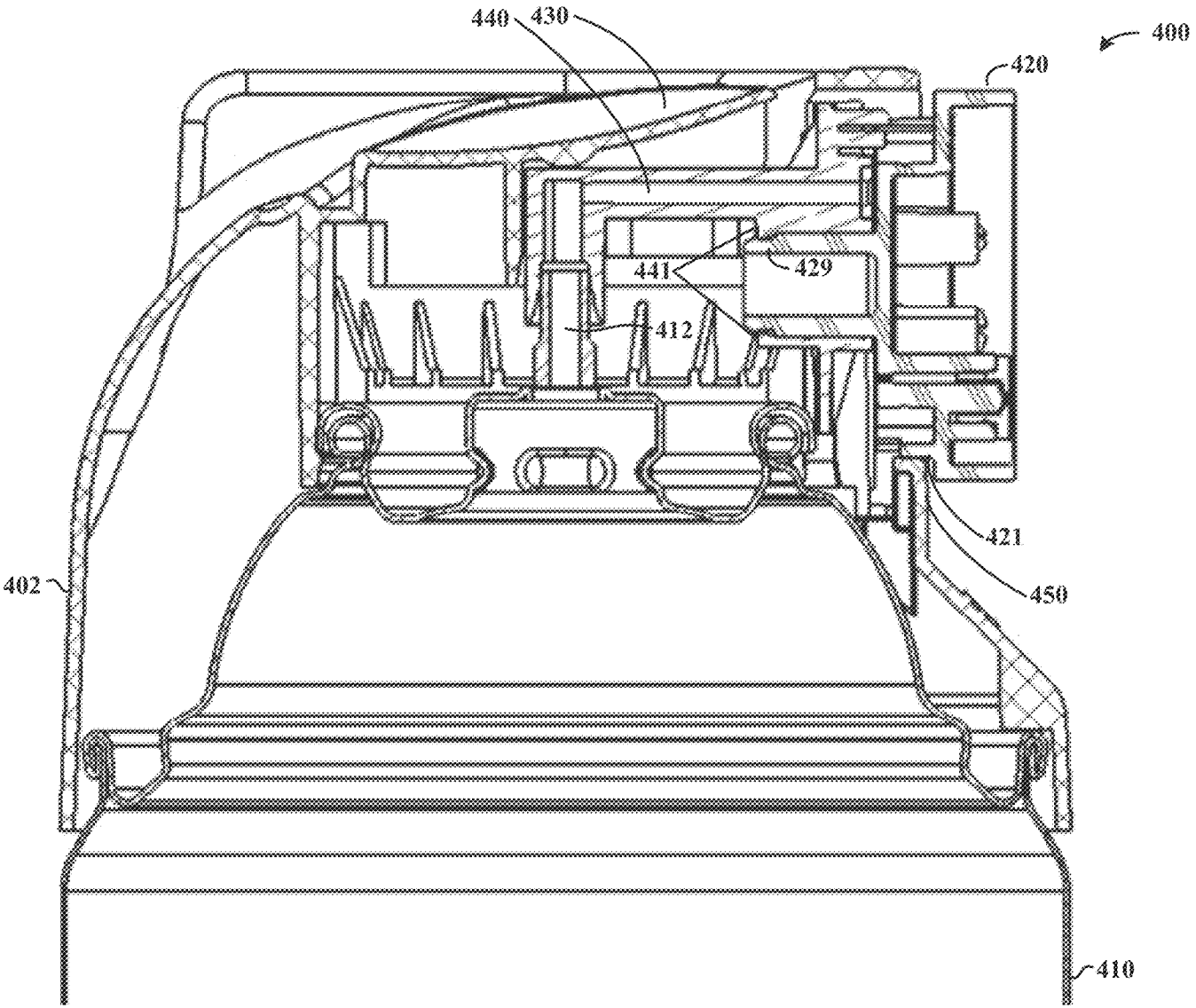
FIG. 15 shows a cross sectional view of an apparatus having a rotatable spray nozzle dial with multiple apertures and a corresponding locking mechanism, with the apparatus in a locked position and coupled to an aerosol can, as may be implemented in accordance with various embodiments.
Figure 16:
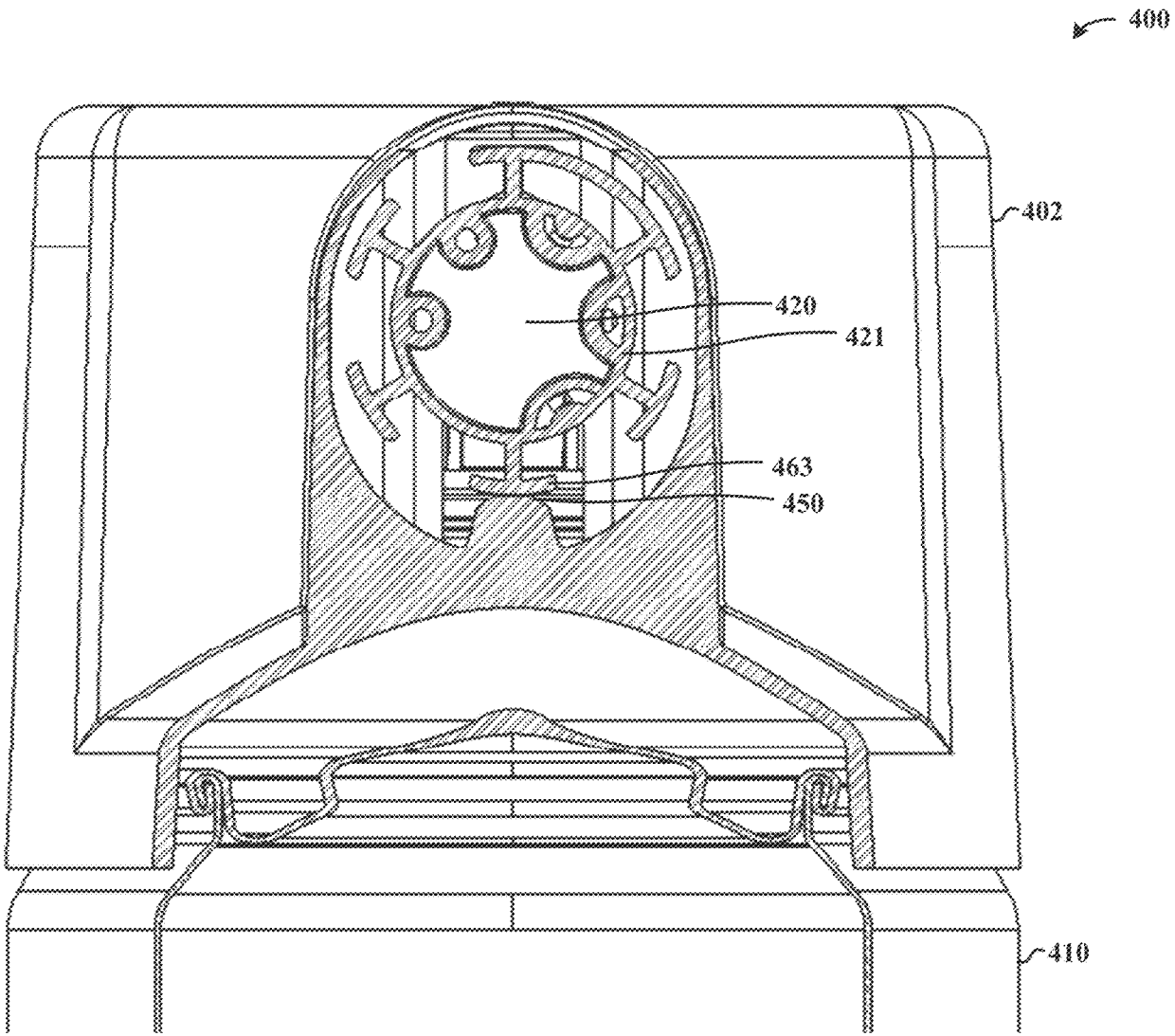
FIG. 16 shows a cross sectional view of the nozzle in the apparatus in the locking position as shown in FIG. 15, in accordance with an example embodiment.
Figure 17:
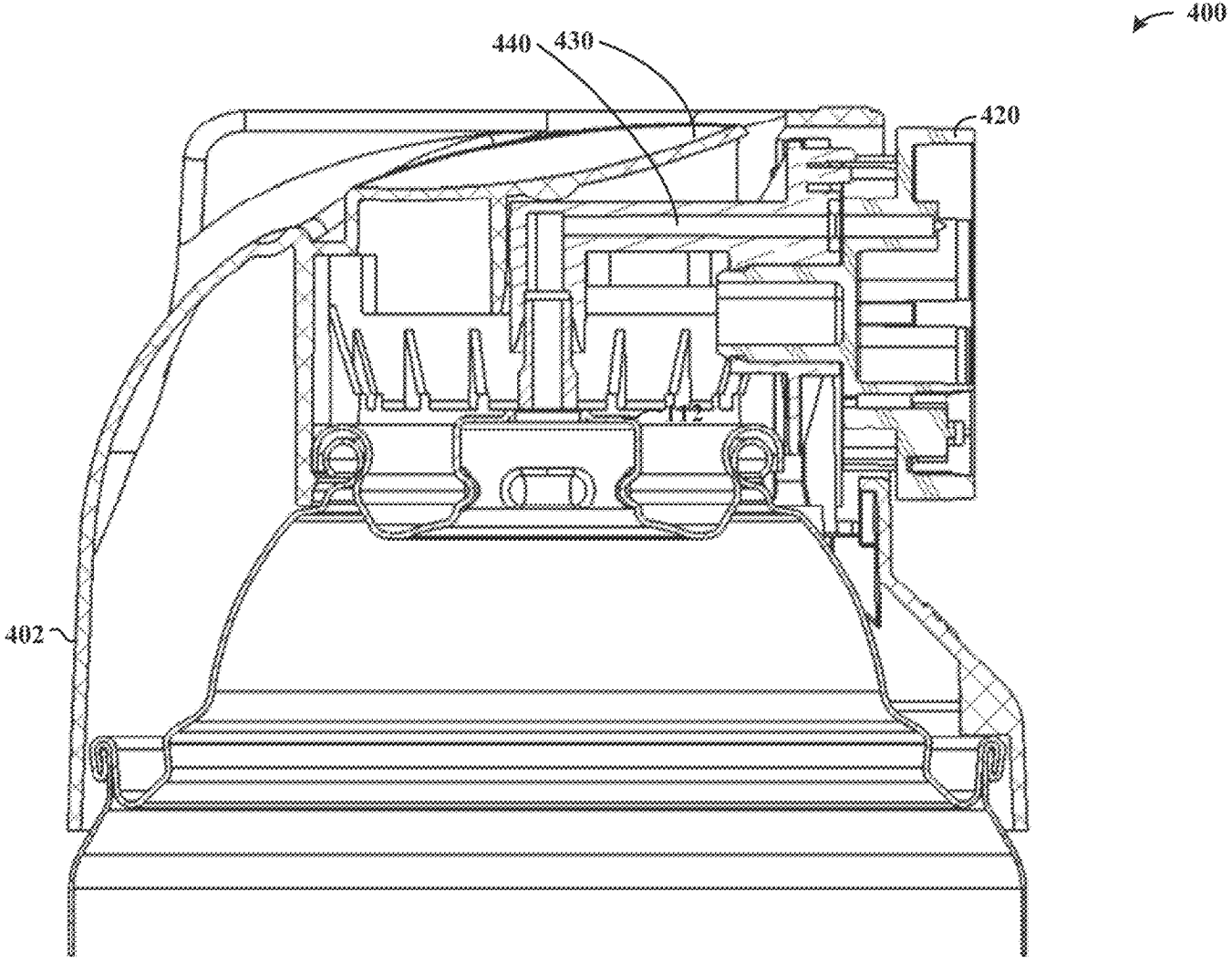
FIG. 17 shows a cross sectional view of the apparatus in FIG. 15, in an unlocked position, in accordance with an example embodiment.
Figure 18:
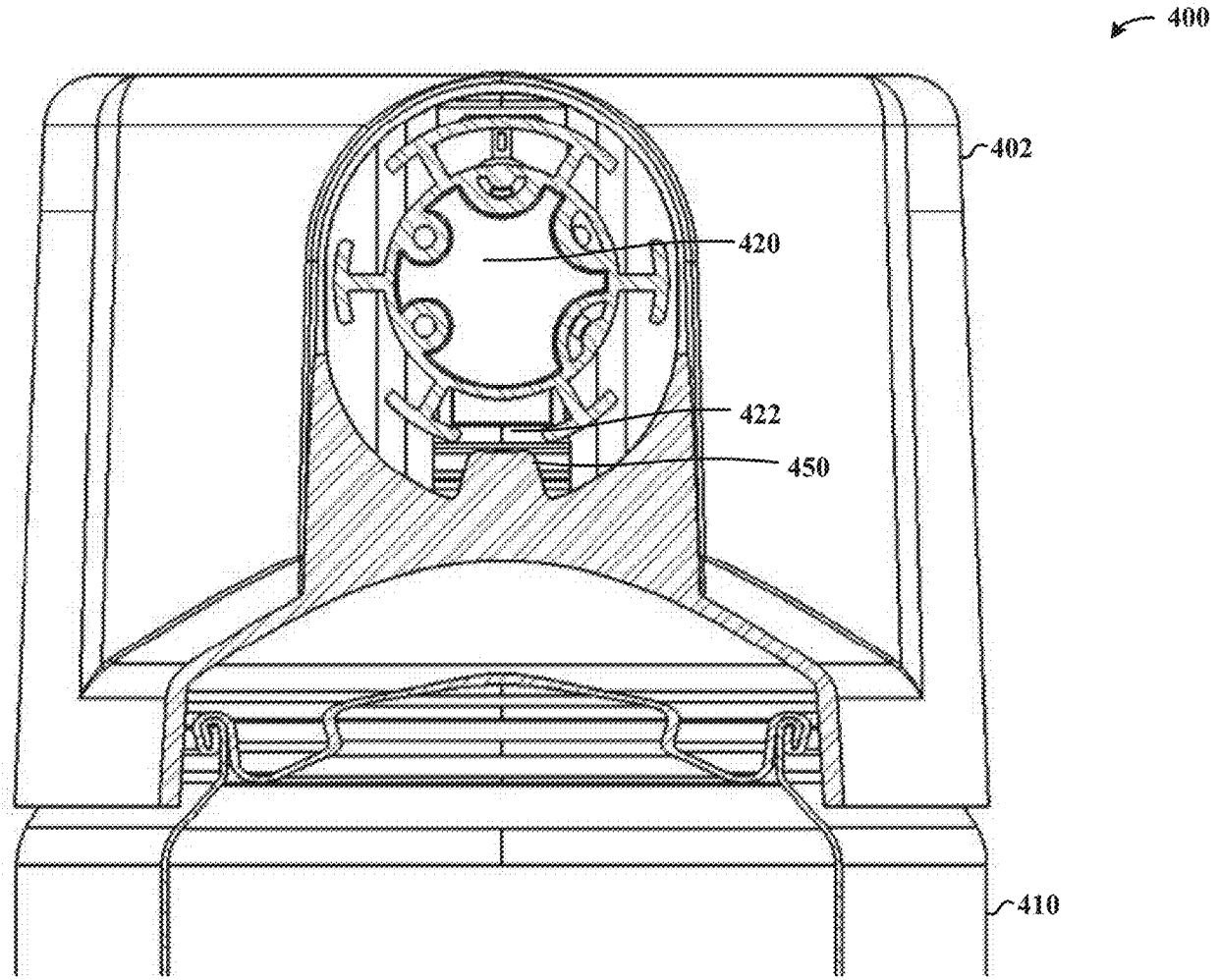
FIG. 18 shows a cross sectional view of the nozzle in the apparatus in the unlocked position as shown in FIG. 17, in accordance with an example embodiment.
Figure 19:
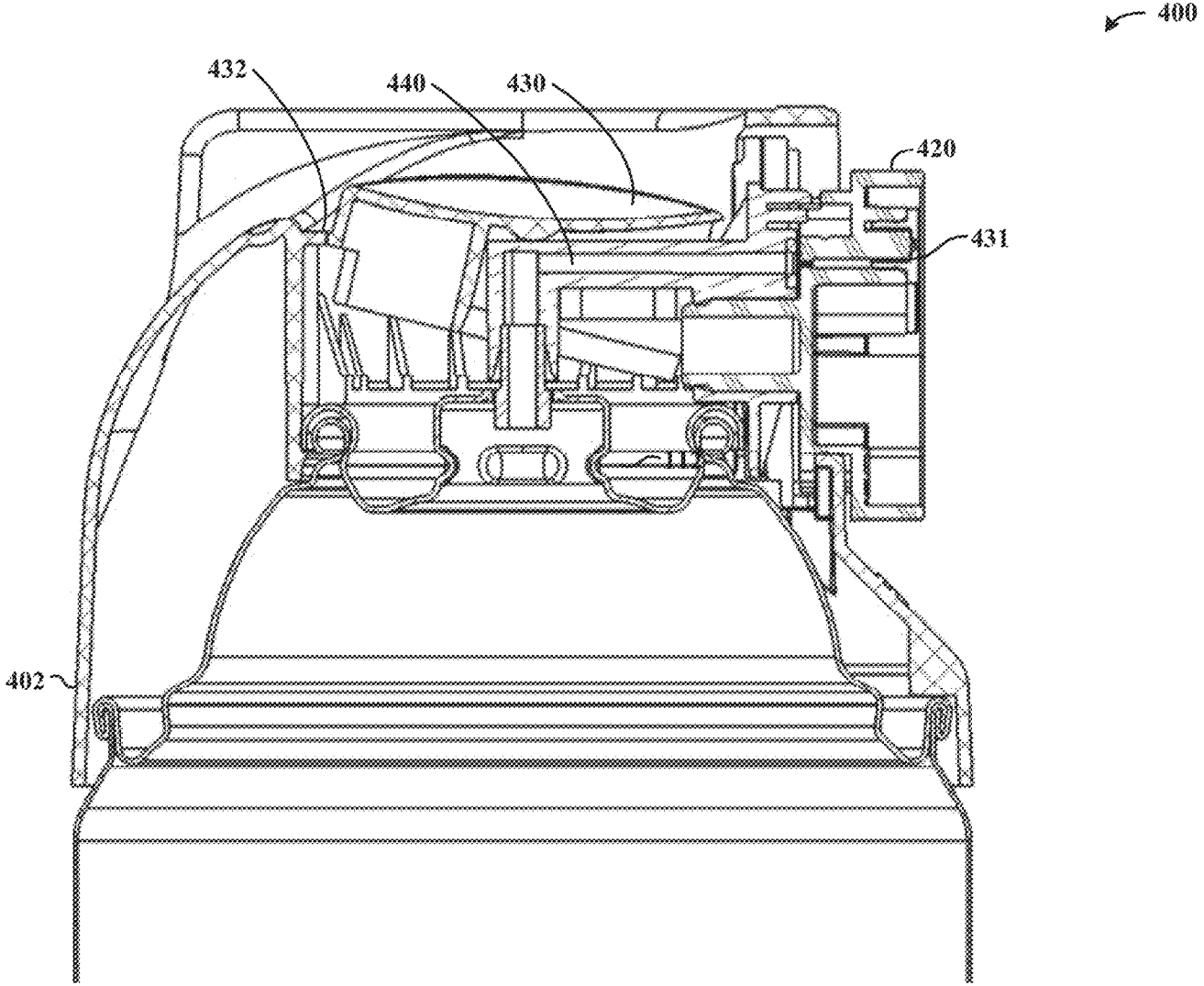
FIG. 19 shows a cross sectional view of the apparatus in FIG. 15, in an unlocked position and with a trigger in an actuated position for spraying aerosol liquid, in accordance with an example.
Figure 20:
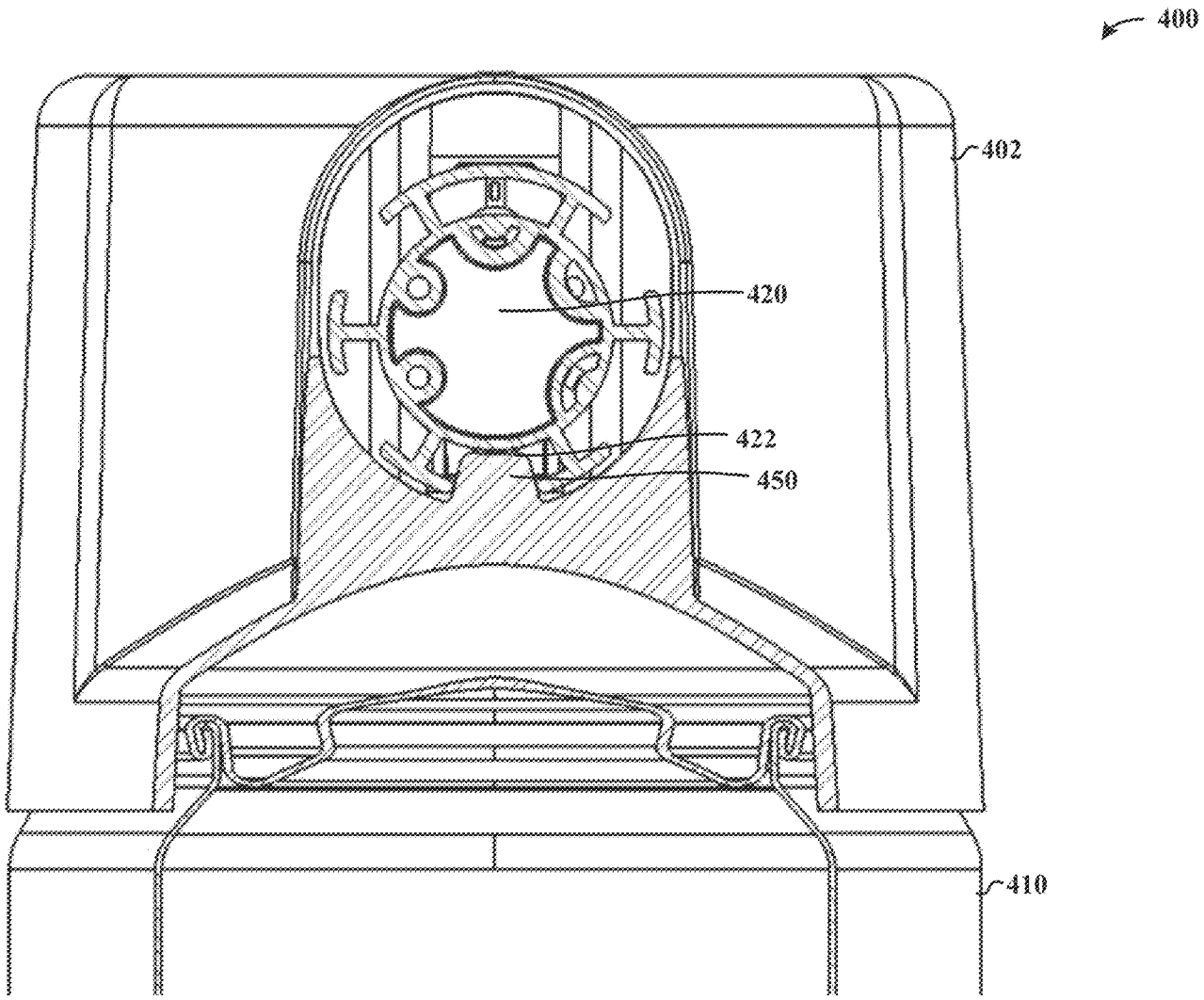
FIG. 20 shows a cross sectional view of the nozzle in the apparatus in the unlocked position with trigger actuated as shown in FIG. 19, in accordance with an example embodiment.

FIGS. 15-20 show an apparatus 400 having a rotatable spray nozzle dial 420 with multiple apertures and a corresponding locking mechanism (using 422/450), as may be implemented in accordance with various embodiments. FIG. 15 shows a cross sectional view of the apparatus in a locked position, with FIG. 16 showing a cross-sectional view of the dial 420 in the locked position. FIG. 17 shows a cross sectional view of the apparatus in an unlocked position and amenable to actuation, with FIG. 18 showing a cross-sectional view of the diel in this unlocked position. FIG. 19 shows a cross sectional view of the apparatus in an unlocked position and actuated for spraying (with button/actuator 430 depressed), and FIG. 20 shows a cross-sectional view of dial 420 in the unlocked and actuated position.

Specifically referring to FIGS. 15 and 16, the apparatus 400 includes a cap body 402 that is shown coupled to a canister 410, such as an aerosol can. The apparatus 400 is shown in a locked position in which a gear 421 on the dial is engaged with a tooth 450 of the cap body 402. Referring to FIG. 16, in this locked position a cog portion 463 of the gear 421 is engaged with the tooth 450, such that the tooth prevents the dial from being actuated in a downward directly as depicted in the figure (e.g., when downward pressure is applied to button 430, the tooth and cog prevent the button from actuating). The dial 420 has a shaft 429 coupled to a sleeve 441 in the cap body 402. The shaft 429 may rotate within the sleeve to facilitate rotation of the dial 420 and alignment of nozzles in the cap with channel 440. The channel 440 is further configured for alignment with a valve, by way of example shown with valve 412 of canister 410, for actuating the valve and delivering propelled liquid from the valve to nozzles in the dial 420.

Figure 23:
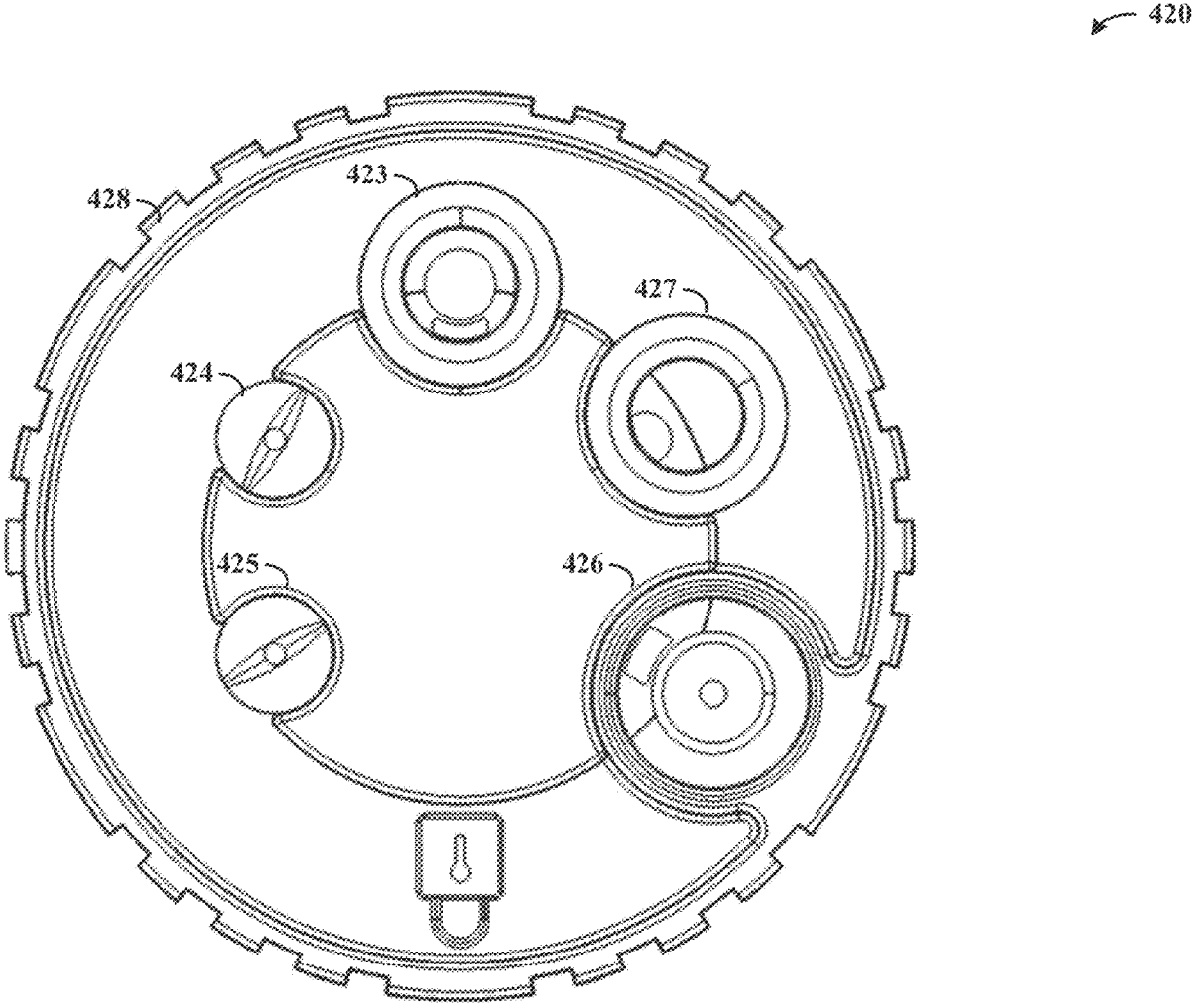
FIG. 23 shows a front view of a rotatable dial with multiple spray nozzles, as may be implemented in accordance with one or more embodiments.

Referring to FIGS. 17 and 18, the apparatus 400 is shown in an unlocked position in which the button 430 is free to move downward in response to pressure applied thereto. Specifically, the dial 420 is in a position such that one of the nozzles therein (e.g., as may be implemented as shown in FIG. 23) is aligned to the channel 440. In this position, the gear of the dial is aligned to mesh with the tooth 450, with a space 422 between cogs of the gear aligned over the tooth as depicted in FIG. 18.

In the unlocked position as shown in FIGS. 17 and 18, the button 430 may be depressed and released to actuate valve 412, as depicted in FIGS. 19 and 20 with the button 430 actuated for spraying liquid released through 412 from the canister 410. As shown in FIG. 19, liquid from the canister 410 may be propelled via the channel 440 to a nozzle 431 in the dial 420. As shown in FIG. 20, the tooth 450 is meshed with the gear of the dial 420, with the toot extending into the space 422 between respective cogs of the gear in this actuated position.

The apparatus 400 may include a pivot 432 about which the button 430 pivots. For instance, the pivot 432 may include a flexible portion of the cap body 402 that operates to bend in response to pressure applied to the button 430, a hinge, and/or other componentry that allows the button to pivot and the gear 422 to actuate as shown in FIGS. 17 and 18.

Figure 21:
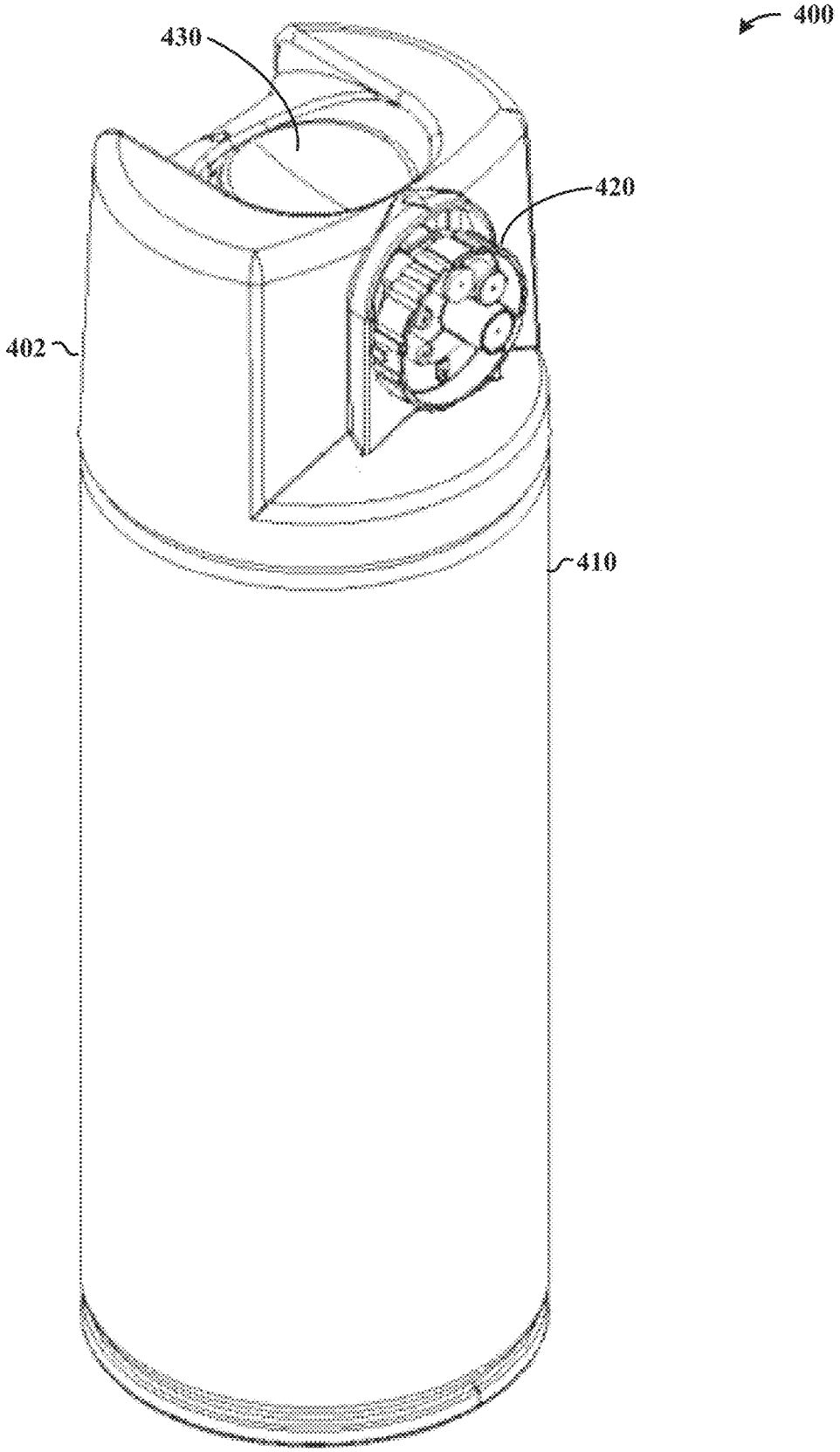
FIG. 21 shows an oblique view of an apparatus having a rotatable spray nozzle dial with multiple apertures and a corresponding locking mechanism, as may be implemented in accordance with one or more embodiments.
Figure 22:
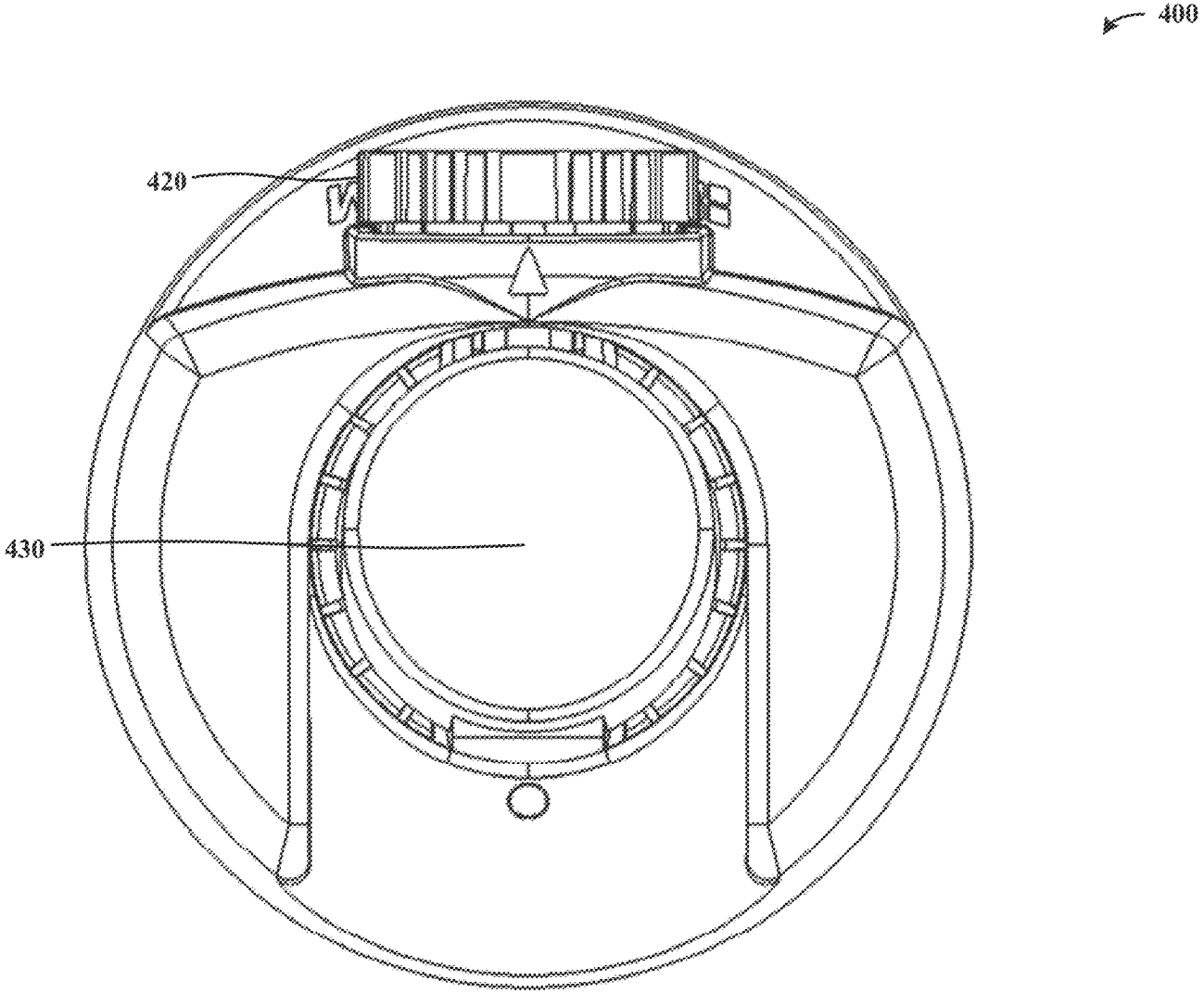
FIG. 22 shows top view of the apparatus depicted in FIG. 21, as may be implemented in accordance with one or more embodiments.

FIGS. 21 and 22 show oblique and top views of an apparatus 400, as may be implemented in accordance with one or more embodiments. These figures may be implemented, for example, utilizing the apparatus depicted in FIGS. 15-20 with the locking mechanisms therein. Accordingly, similarly numbering is used for similar components. The dial 420 is thus operable for placing the locking mechanism in a locked position by rotating such that the nozzles are not aligned to the channel, under which conditions depression of the button 430 is blocked. When the dial 420 is rotates such that a nozzle is in alignment with a channel for spraying, button 430 may be actuated. The apparatus 400 includes a cap body 402, a spray dial 420 and a button 430, with the cap body 402 coupled to a canister 410, with the understanding that the cap body 402 may be implemented with various types, shapes and sizes of canisters. The dial 420 is depicted having five nozzles. However, fewer or more nozzles, or nozzles of other sizes and/or shapes are implemented, in accordance with various embodiments.

FIGS. 23-27 depict various embodiments involving rotatable dials, which may be implemented together. Further, the respective embodiments may be implemented with one or more aspects of FIGS. 15-22, such as with dial 420, with each dial in FIGS. 23-27 similarly numbered. FIG. 23 shows a front view of a rotatable dial 420 having multiple spray nozzles 423-427. The rotatable dial 420 may have raised features 428 that may provide grip for rotation. When implemented with the embodiment shown in FIGS. 19 and 20, the apparatus 400 may thus operate to spray liquid through one of the nozzles 423-427 that is aligned to channel 440, upon actuation of button 430. For instance, with channel 440 positioned as shown in FIG. 19 and nozzle 423 shown in FIG. 23 aligned to the channel, fluid such as paint may be sprayed through the nozzle when the button 430 is depressed.

Figure 24:
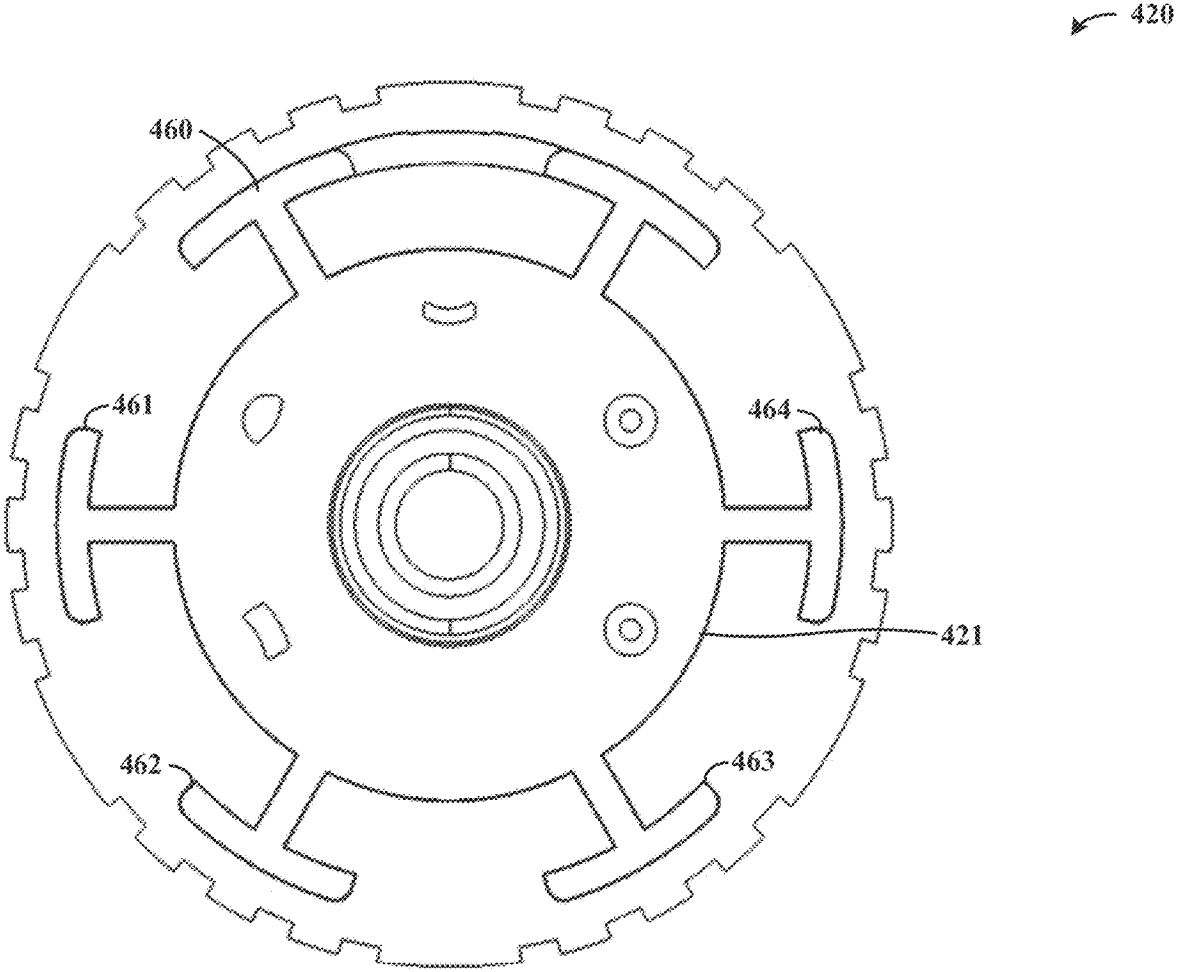
FIG. 24 shows a rear view of a rotatable dial with a locking mechanism, as may be implemented in accordance with one or more embodiments.

FIG. 24 shows a rear view of a rotatable dial 420 with a locking mechanism, as may be implemented in accordance with one or more embodiments. The locking mechanism includes a gear having cogs 460-464, and recessed regions between the cogs. The cogs 460-464 are configured to interact with a tooth or other structure to prevent downward movement of the dial 420 and, therein prevent liquid dispensing. For instance, when implemented with the embodiment shown in FIGS. 15 and 16, one of the cogs (e.g., 463) may be utilized to interact with tooth 450 in a manner as shown in FIG. 16 with the cog 463 of the gear 410 contacting the tooth. Similarly when implemented with the embodiment shown in FIGS. 19 and 20, the recessed region between cogs 462 and 463 may be aligned to tooth 450, allowing actuation of the rotatable dial 420 and dispensing of liquid. When implemented with the rotatable dial 420 of FIG. 23, the position of the dial 420 aligns nozzle 423 with channel 440 for spraying upon meshing of the region between the cogs 462 and 463 with tooth 450.

Figure 25:
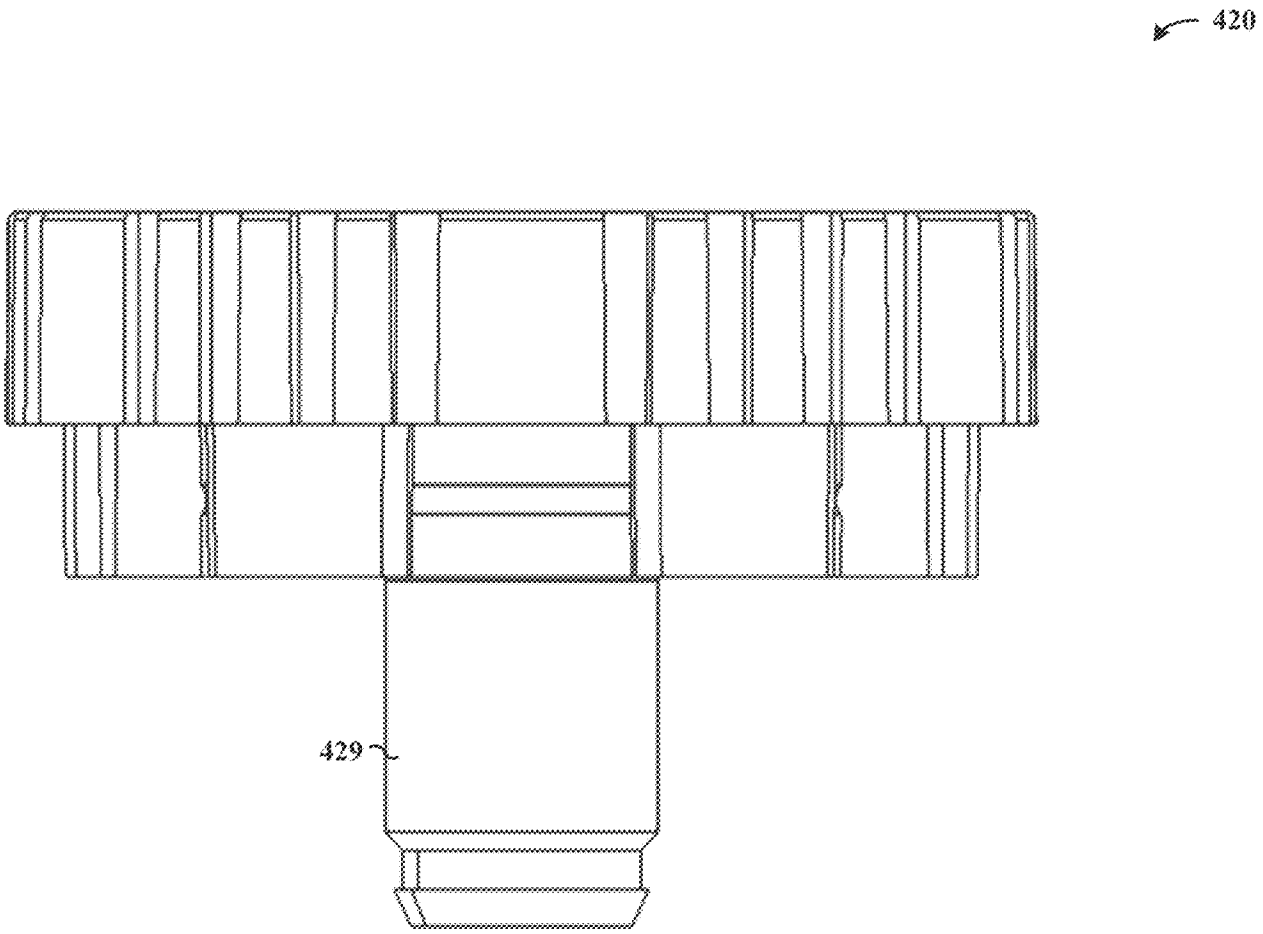
FIG. 25 shows a side view of a rotatable dial with multiple spray nozzles, as may be implemented in accordance with one or more embodiments.
Figure 26:
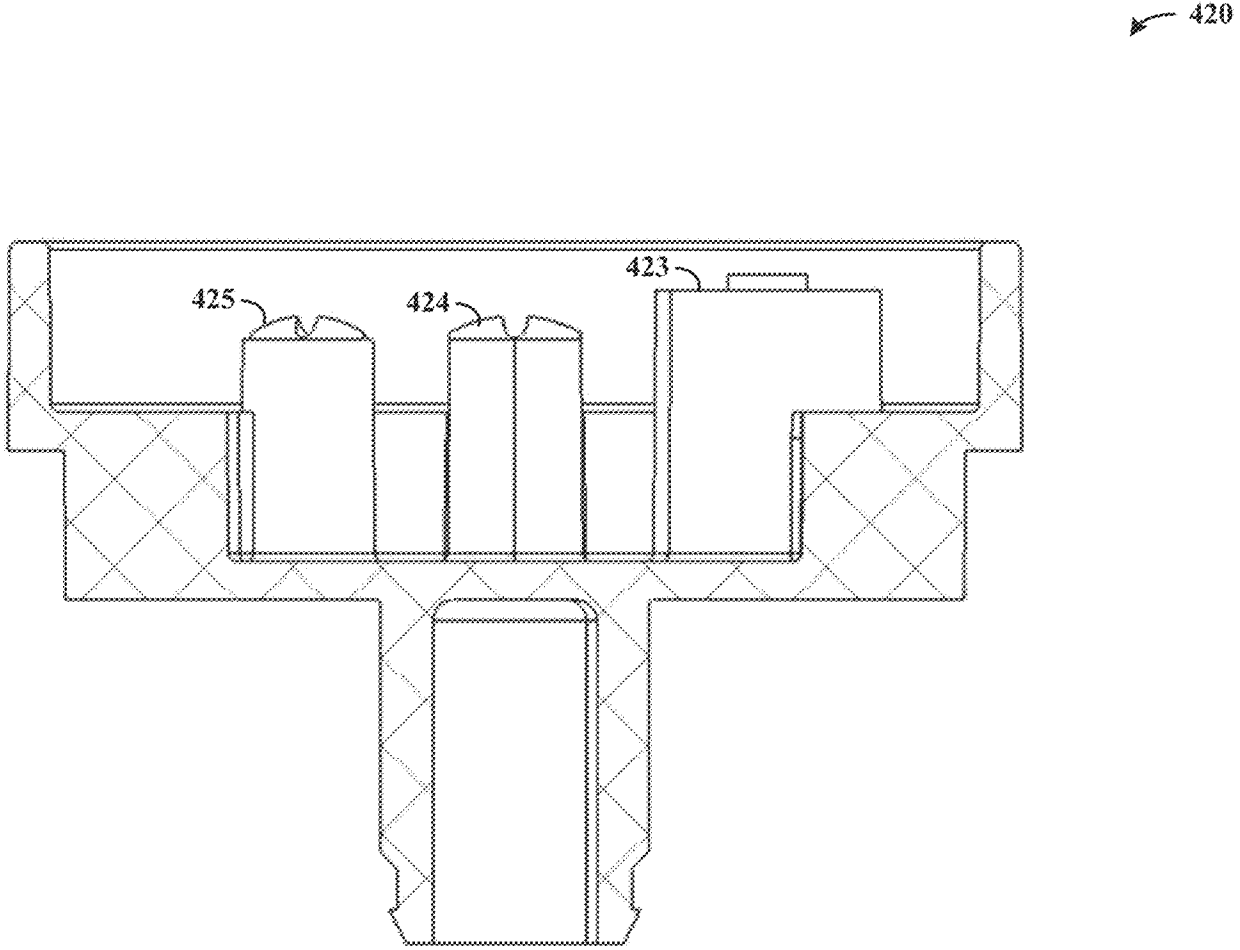
FIG. 26 shows a cross-sectional view of the rotatable dial shown in FIG. 25, as may be implemented with one or more embodiments.
Figure 27:
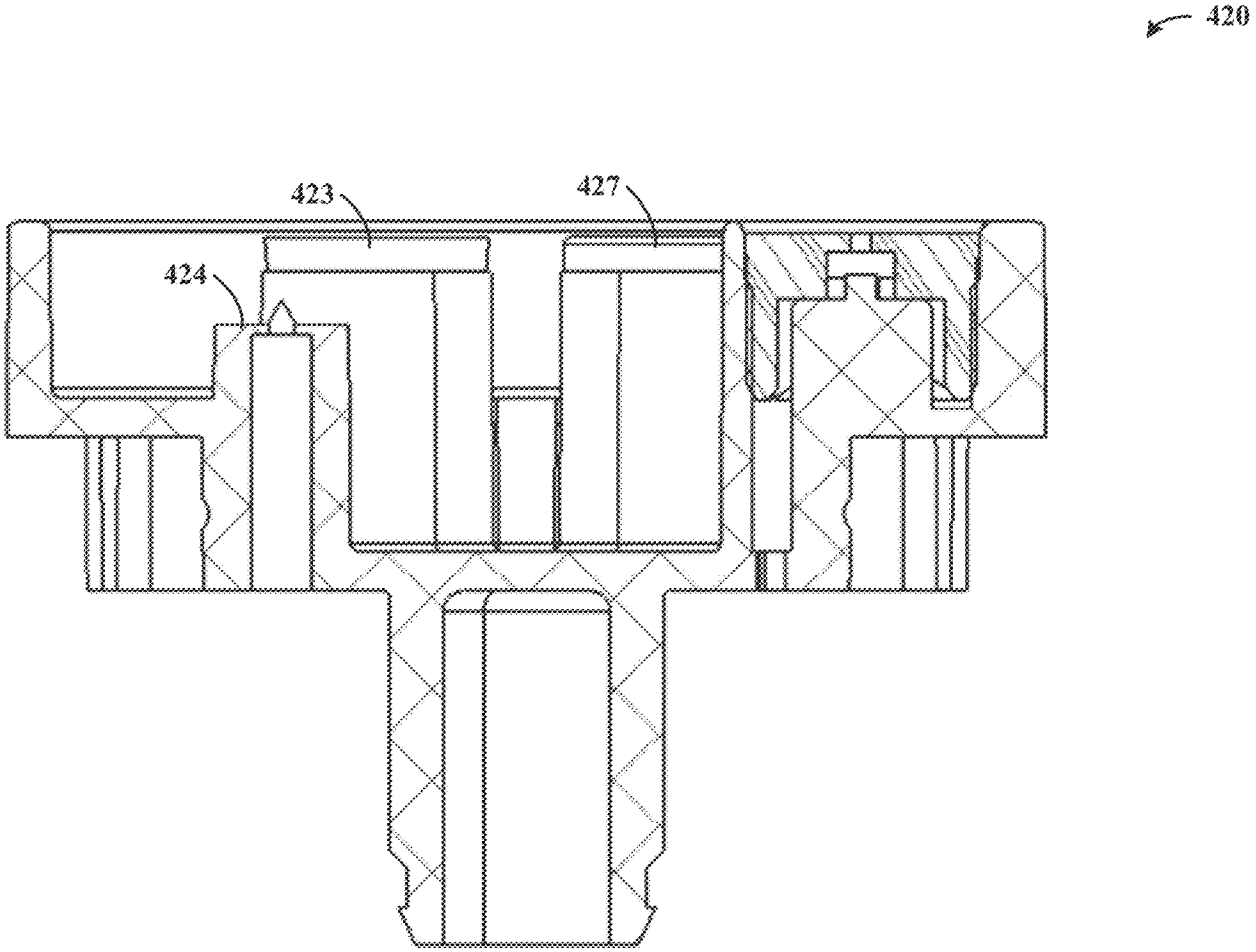
FIG. 27 shows another cross-sectional view of the rotatable dial shown in FIG. 25 rotated to a position different than that shown in FIG. 26, as may be implemented with one or more embodiments.

FIGS. 25-27 respectively show side and cross-sectional views of the rotatable dial 420 of FIG. 23, as may be implemented in accordance with one or more embodiments. The rotatable dial 420 has a shaft 429 configured for engaging with a sleeve (e.g., 441 of FIG. 15) for rotation of the rotatable dial 420 and alignment of the spray nozzles 423-427. FIGS. 26 and 27 show respective cross-sections with the nozzles revealed as noted. Each respective one of the spray nozzles 423-427 have channels operable for alignment for receiving propelled liquid upon depression of the button 430 in an unlocked position.

Figure 28:
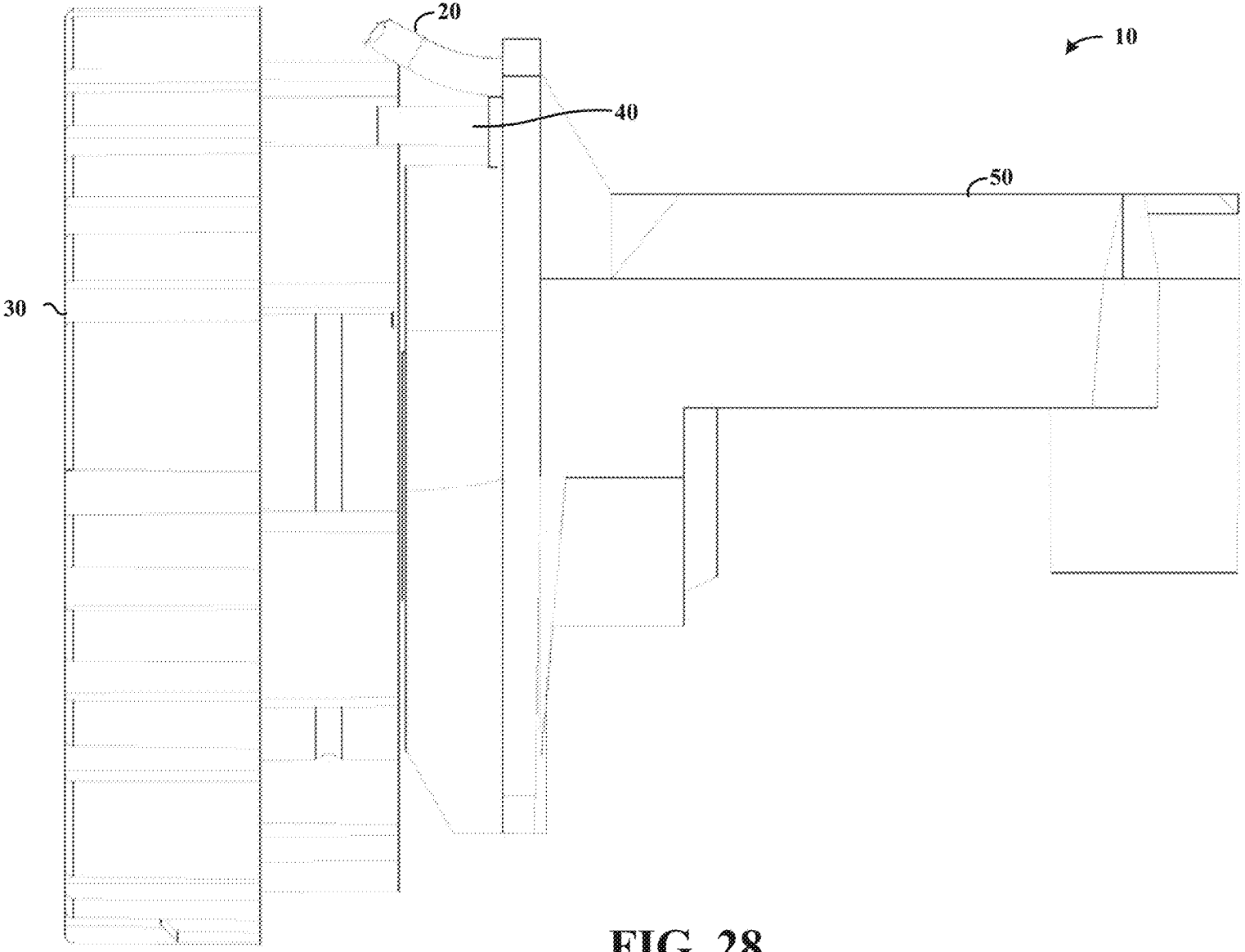
FIG. 28 depicts a side view of an apparatus, as may be implemented in accordance with one or more embodiments.

FIGS. 28-47 show respective aspects of one or more embodiments involving force or resistive type feedback, and/or audio feedback, with a dial and spray channel apparatus 10 that may be implemented with a cap and aerosol can as characterized herein. Various embodiments depicted in FIGS. 28-47 Beginning with FIG. 28, a side view of the apparatus 10 is shown, as may be implemented in accordance with one or more embodiments. At the top of the view, a tab 20 provides force feedback and is shown in a bent upward state with dial 30 in a position that is midway between two spray positions, relative to a spray channel 50. The bending aspect of the tab generates force feedback as the dial is rotated. An audible feedback tab 40 may also be implemented to provide a click or other sound as the tab snaps back into place after passing a gear. Similar aspects may be implemented in accordance with tabs as shown in other figures, for instance as depicted in FIGS. 4-6, 15, 17 and 19.

Figure 29:
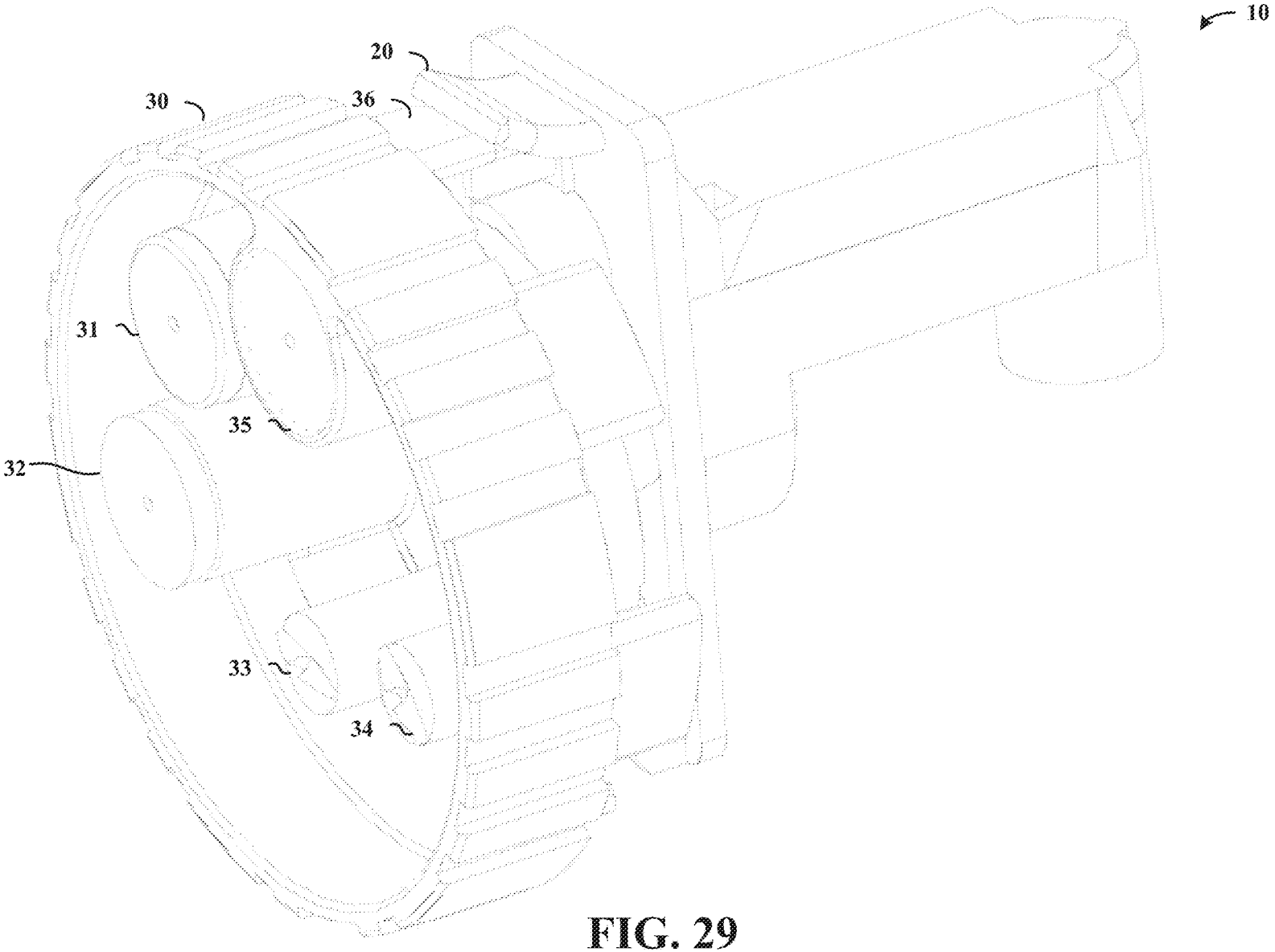
FIGS. 29 and 30 show isometric views of the apparatus of FIG. 28, as may be implemented in accordance with one or more embodiments.
Figure 30:
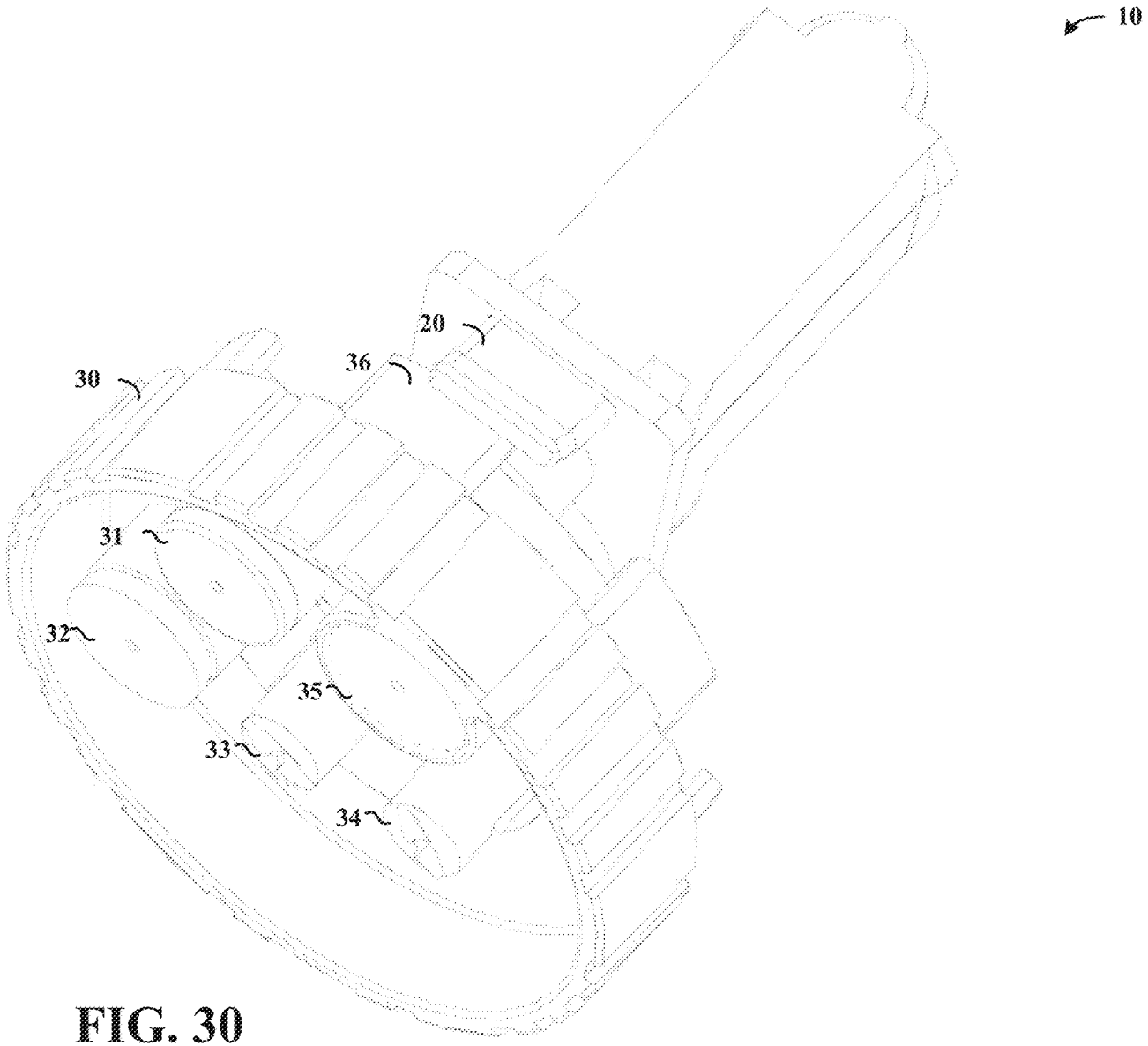

FIGS. 29 and 30 show isometric views of the apparatus 10, as may be implemented in accordance with one or more embodiments. The dial 30 is shown with nozzles 31, 32, 33, 34 and 35, by way of example. Fewer or more nozzles, or different types of nozzles, are utilized in connection with various embodiments. The dial 30 is rotated halfway between two spray positions (between nozzles 31 and 35), such that the tab 20 on the top of the spray channel is bent up via interaction with gear 36.

Figure 31:
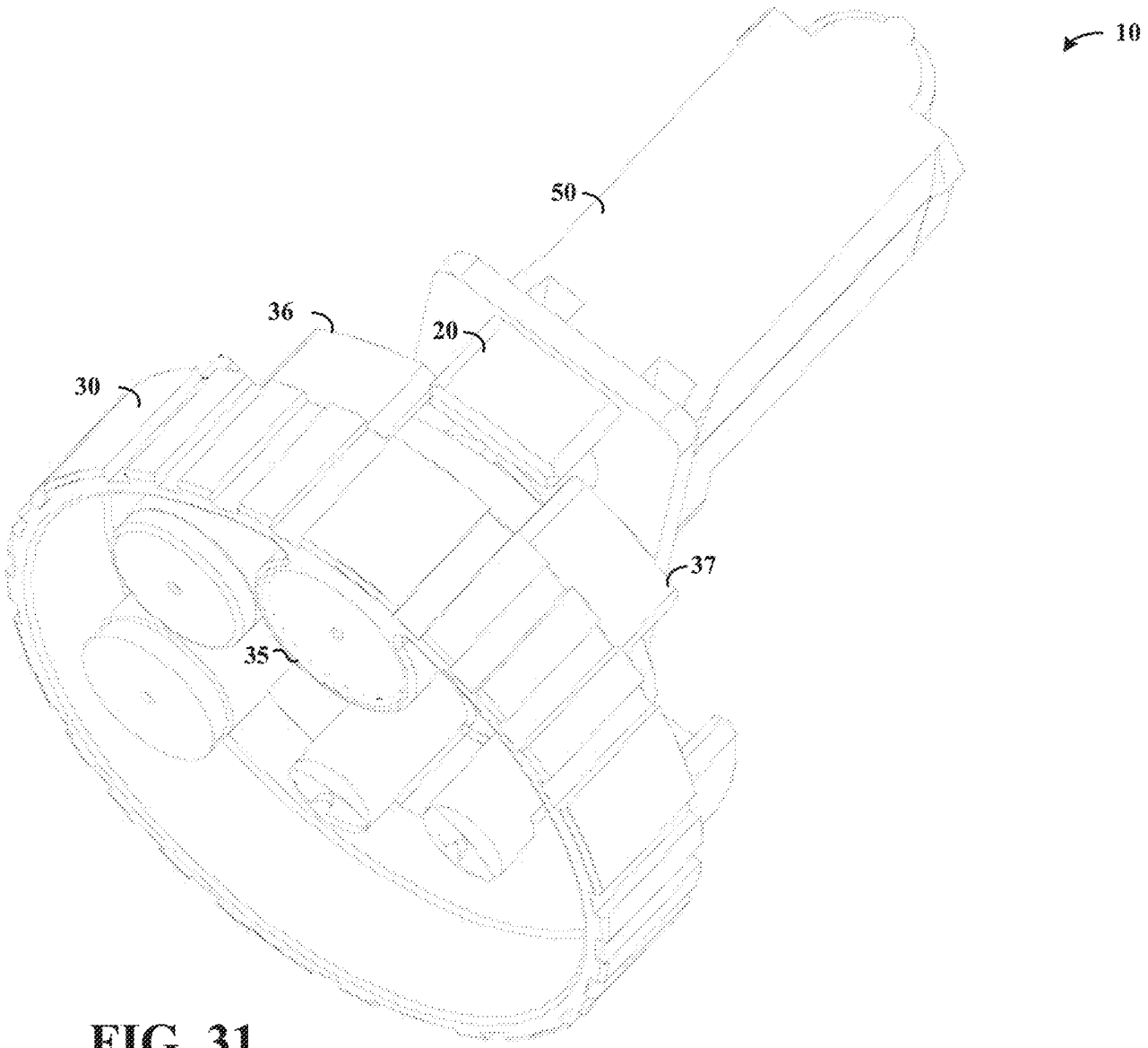
FIG. 31 shows the apparatus of FIG. 28 with a dial rotated counter clockwise relative to that depicted in FIGS. 29 and 30, as may be implemented in accordance with one or more embodiments.

FIG. 31 shows the apparatus 10 with the dial 30 rotated counter clockwise relative to FIGS. 29 and 30, as may be implemented in accordance with one or more embodiments. The tab 20 is located between gears 36 and 37 of the dial, with nozzle 35 aligned to the spray channel 50. At this position the tab 20 on the spray channel is in its relaxed position and locks the dial in position holding it there while fluid such as paint is sprayed through nozzle 35.

Figure 32:
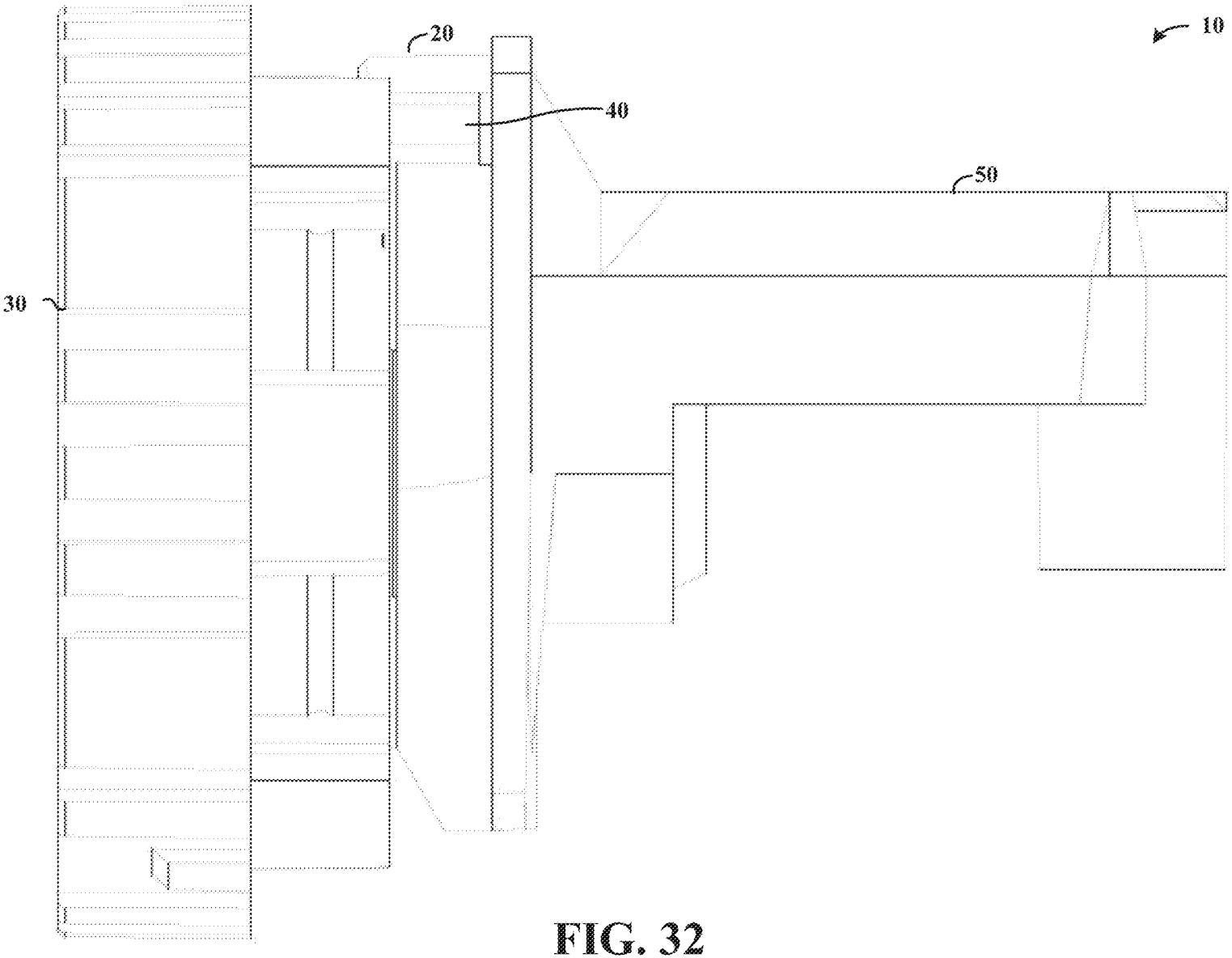
FIG. 32 shows a side elevation of an implementation of the apparatus of FIG. 28, as may be implemented in accordance with one or more embodiments.

FIG. 32 shows a side elevation of the apparatus 10, as may be implemented in accordance with one or more embodiments. The dial 30 is lined up to spray similarly as in FIG. 31, such that tab 20 at the top of the spray channel is not flexed and holds the dial in position, stopping it from rotating.

Figure 33:
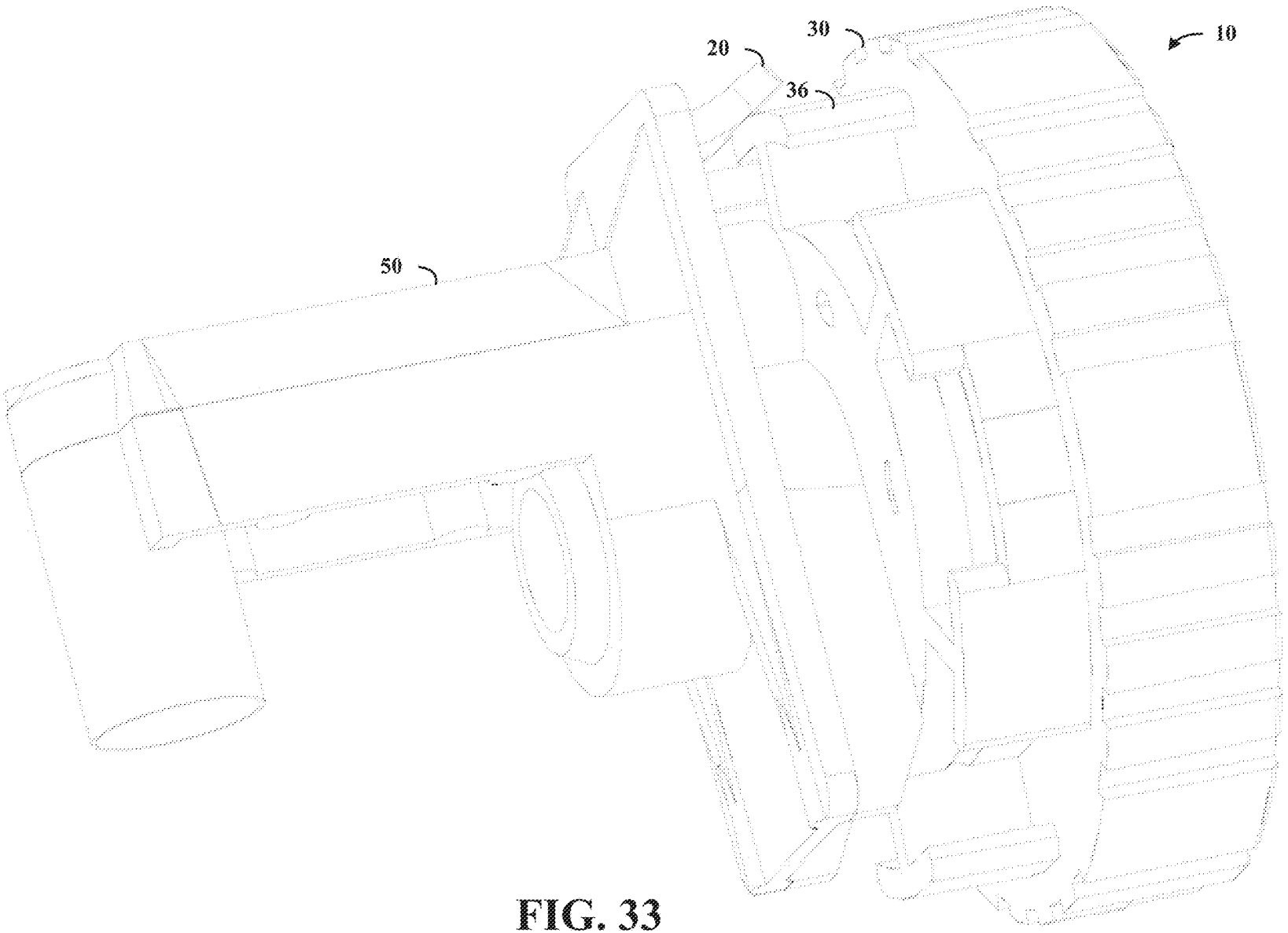
FIGS. 33 and 34 show other isometric views of implementations of the apparatus of FIG. 28, as may be implemented in accordance with one or more embodiments.
Figure 34:
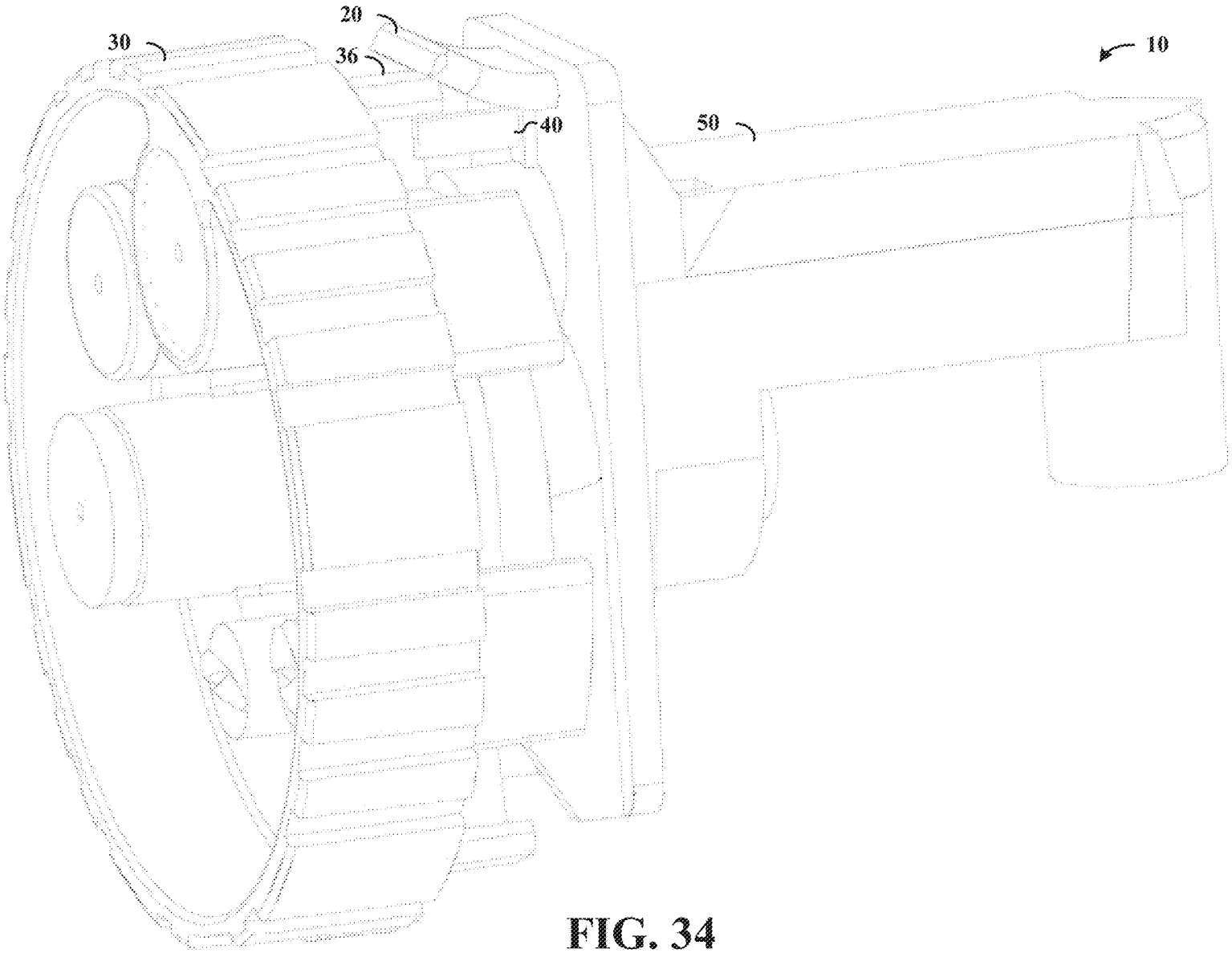

FIGS. 33 and 34 shows other isometric views of the apparatus 10, as may be implemented in accordance with one or more embodiments. The dial 30 is rotated in such a way as to flex the tab 20 at the top of the spray channel out of the way via gear. This shows it is in middle position between two spray positions, with the dial 30 rotated through about half its rotation and not in a position to spray. Tab 40 is located below tab 20 and operates to generate an audible sound when the tab 40 releases from its bent position and back to an unbent state, with the dial in position to spray through one of the nozzles aligned between the gears. Similar aspects may be implemented using tabs depicted in FIGS. 15 and 17-20.

Figure 35:
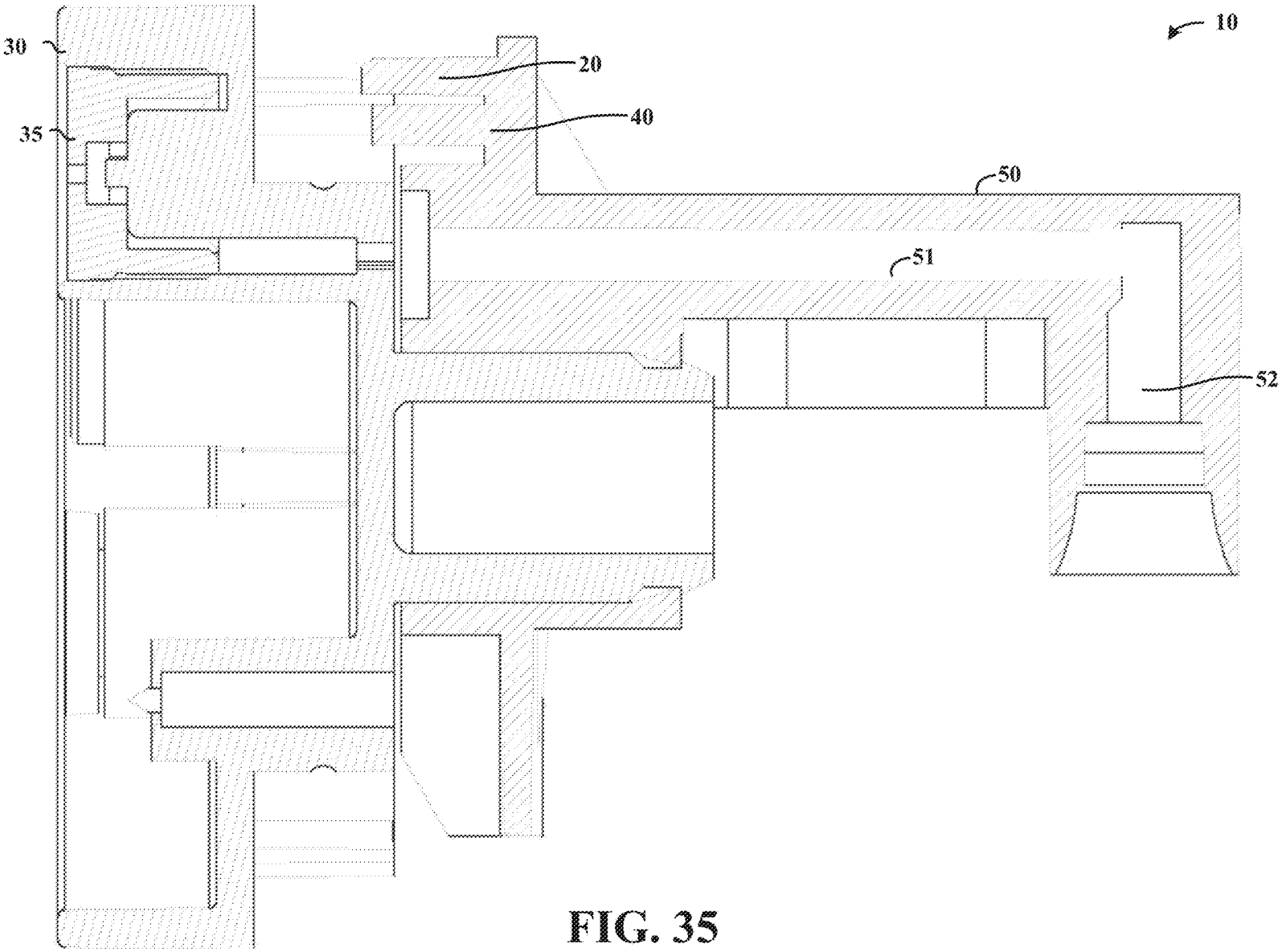
FIG. 35 shows a section view of an implementation of the apparatus of FIG. 28, as may be implemented in accordance with one or more embodiments.

FIG. 35 shows a section view of the apparatus 10, as may be implemented in accordance with one or more embodiments. The apparatus 10 is sectioned through the spray channel 50, dial 30 and nozzle 36. The spray channel 50 is shown with a horizontal portion 51 and a vertical portion 52, for example to align to an aerosol can nozzle. The dial 30 is between two positions as the tab 20 on the top of the spray channel is not under flexion.

Figure 36:
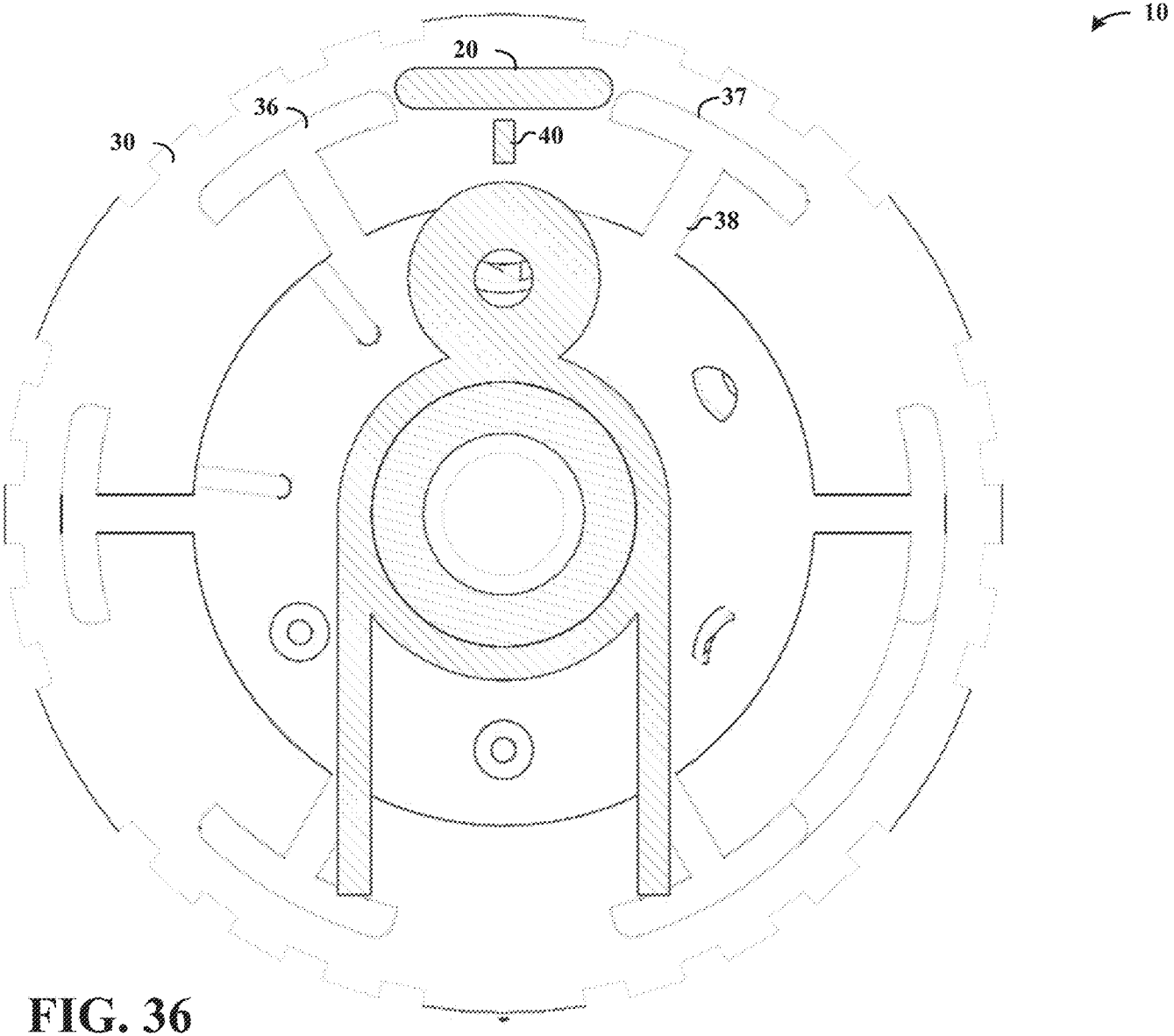
FIG. 36 shows another section view of an implementation of the apparatus of FIG. 28, through the spray channel looking towards the dial, as may be implemented in accordance with one or more embodiments.

FIG. 36 shows another section view of the apparatus 10 through the spray channel 50 looking towards the dial 30, as may be implemented in accordance with one or more embodiments. The force feedback tab 20 is shown at the top sitting clearly between dial gears 36 and 37. The edges of the force feedback tab 20 are radiused as are the tops of the dial gears, which engages and allows the force feedback tab to ride up on top of the gear 30. Below the force feedback tab 20 is the click tab 40. This click tab 40 may engage ribs between the gears (such as rib 38).

Figure 37:
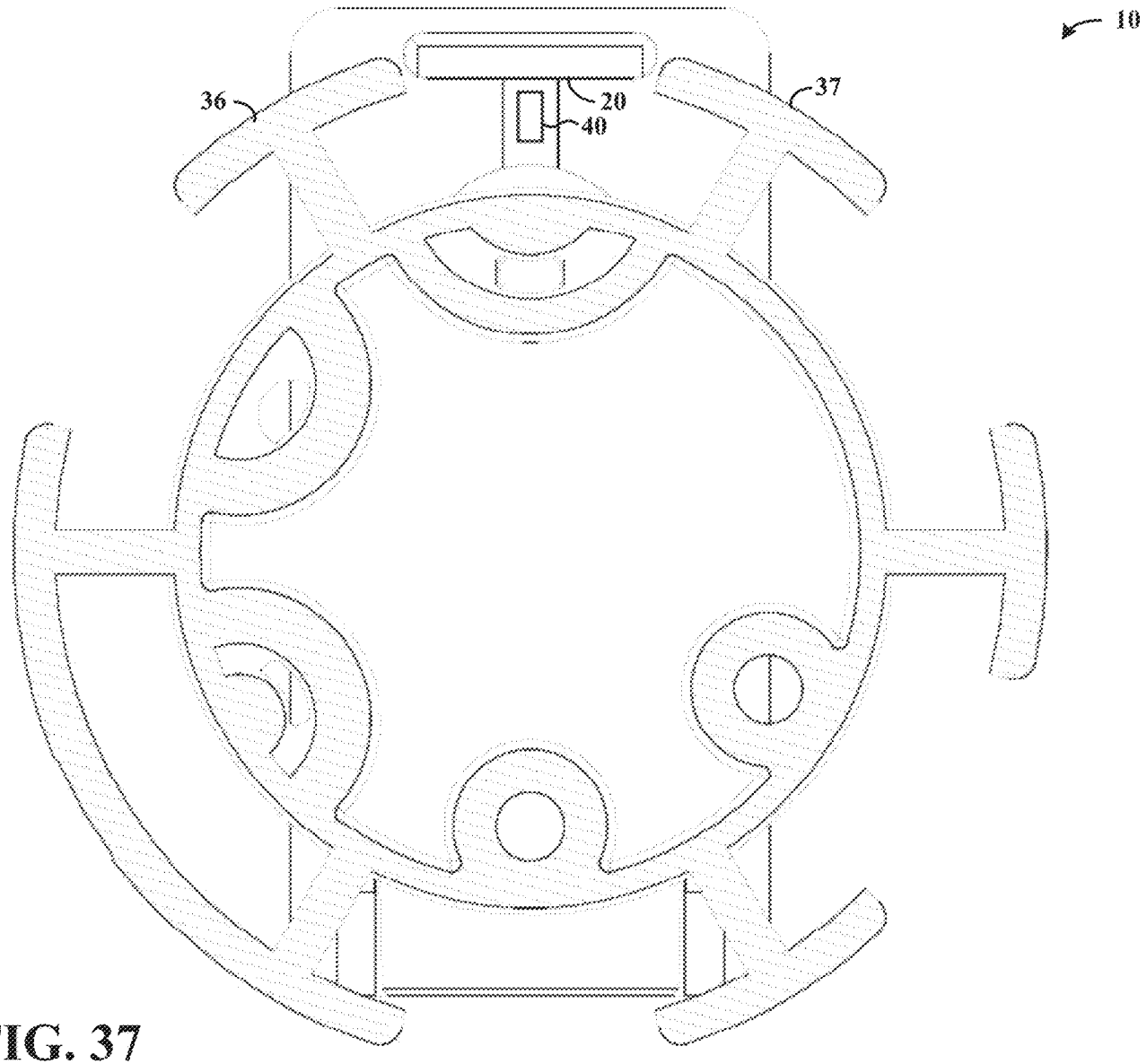
FIG. 37 shows another section view of an implementation of the apparatus of FIG. 28, through the gear members that are on the back face of the dial, as may be implemented in accordance with one or more embodiments.

FIG. 37 shows another section view of the apparatus 10, through the gear members that are on the back face of the dial 30, as may be implemented in accordance with one or more embodiments. The force feedback tab 20 at the top image can be seen sitting between two gear members 36 and 37, and the click tab 40 is below.

Figure 38:
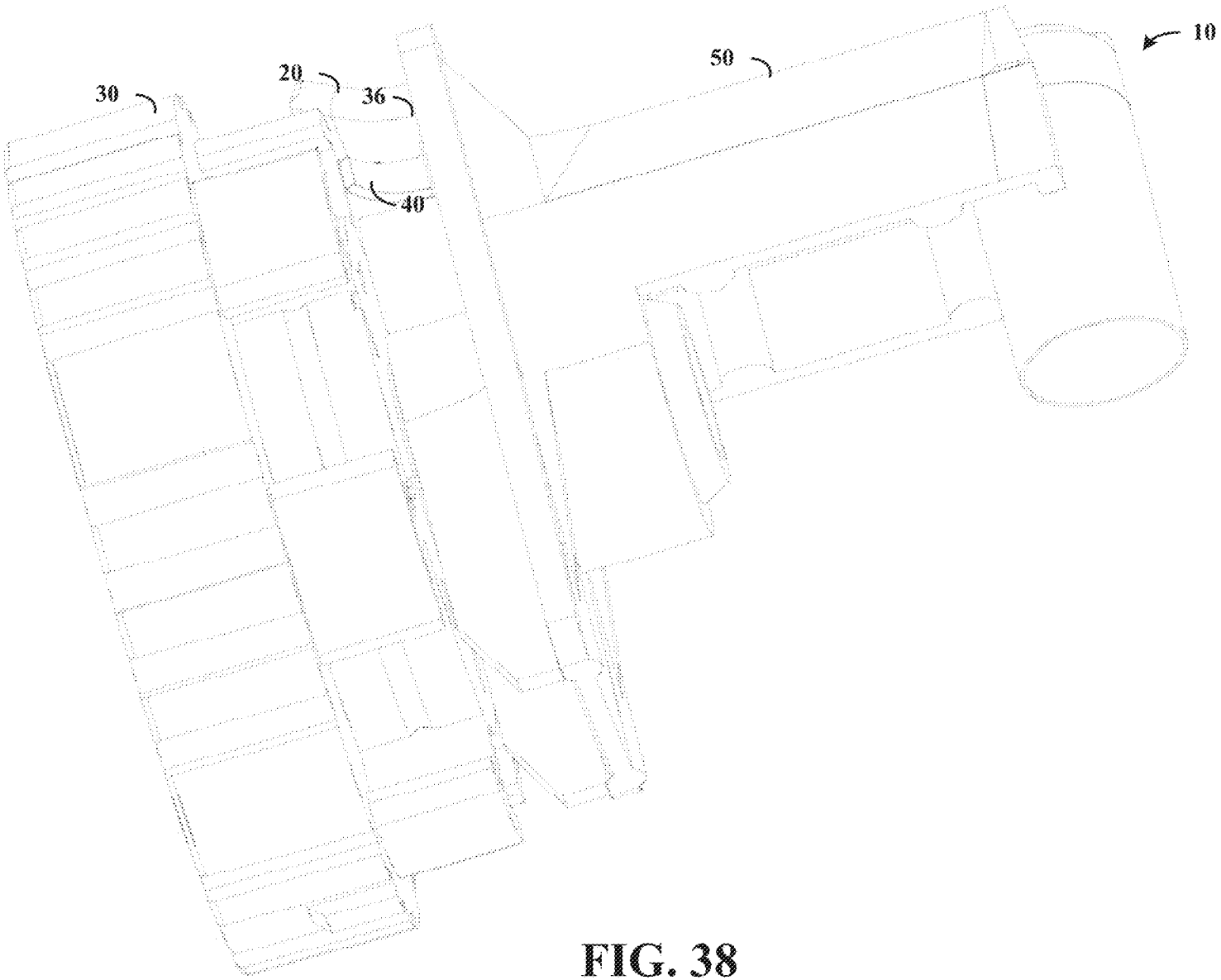
FIG. 38 shows an isometric view looking up showing the dial and the spray channel, as may be implemented in accordance with one or more embodiments.

FIG. 38 shows an isometric view looking up showing the dial 30 and the spray channel 50, as may be implemented in accordance with one or more embodiments. The dial 30 is rotated midway between two spray positions and the force feedback tab 20 is flexed up to clear the dial gear. Below the dial gear the click mechanism 40 is flexed, and will stay flexed until it is released as the dial continues its rotation to the next spray position.

Figure 39:
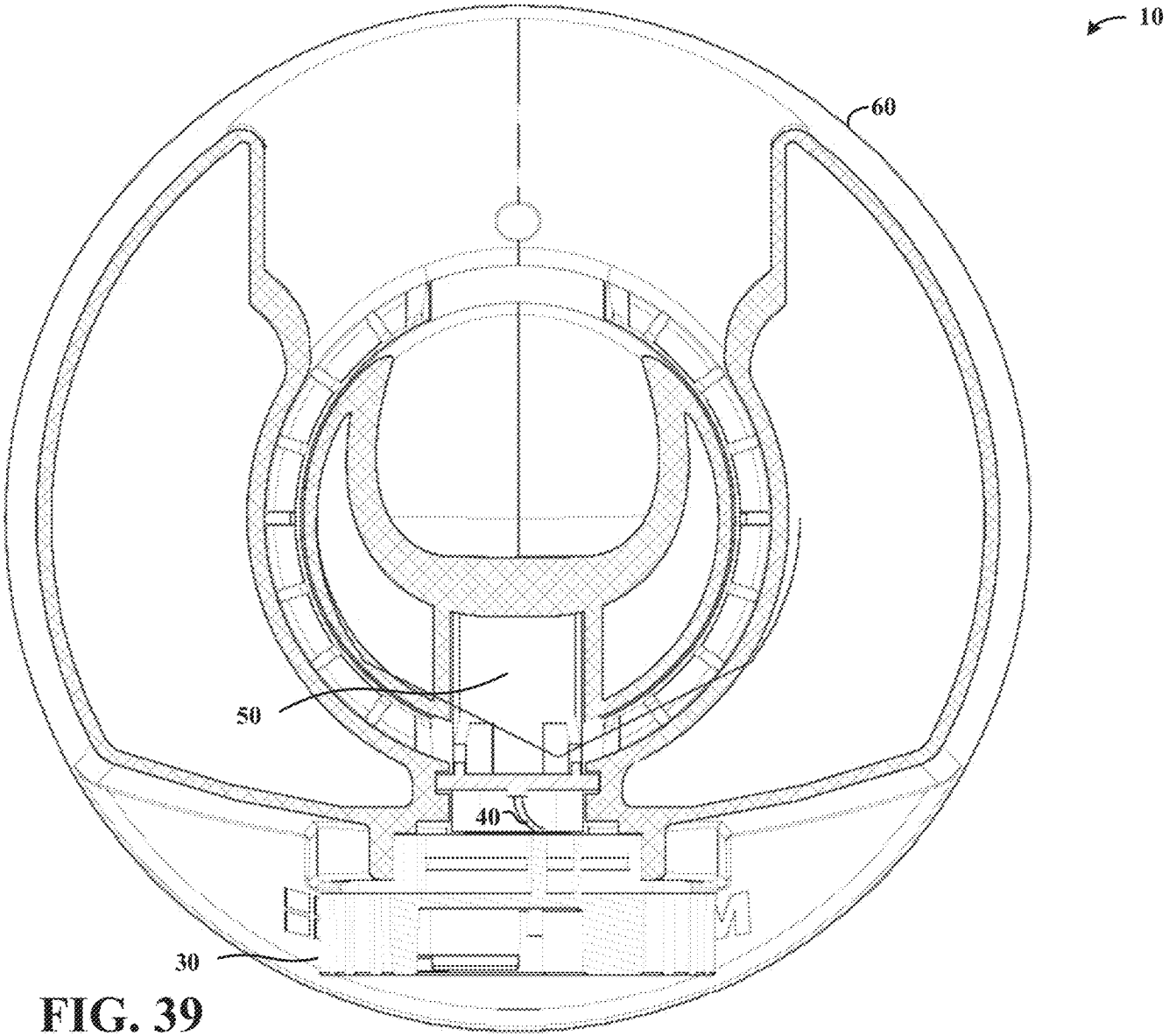
FIG. 39 shows a section view of a cap assembly including the apparatus of FIG. 28, through the click portion of the spray channel, as may be implemented in accordance with one or more embodiments.

FIG. 39 shows a section view of a cap assembly 60 including the apparatus 10, through the click portion of the spray channel 50, as may be implemented in accordance with one or more embodiments. The cap assembly 60 may be implemented in a manner similar to that shown in FIGS. 15-21. As the dial 30 is in rotation between two positions, the click tab 40 is bent, ready to be released as the dial continues its motion. The sound occurs just after the dial has passed the centerline between two spray positions.

Figure 40:
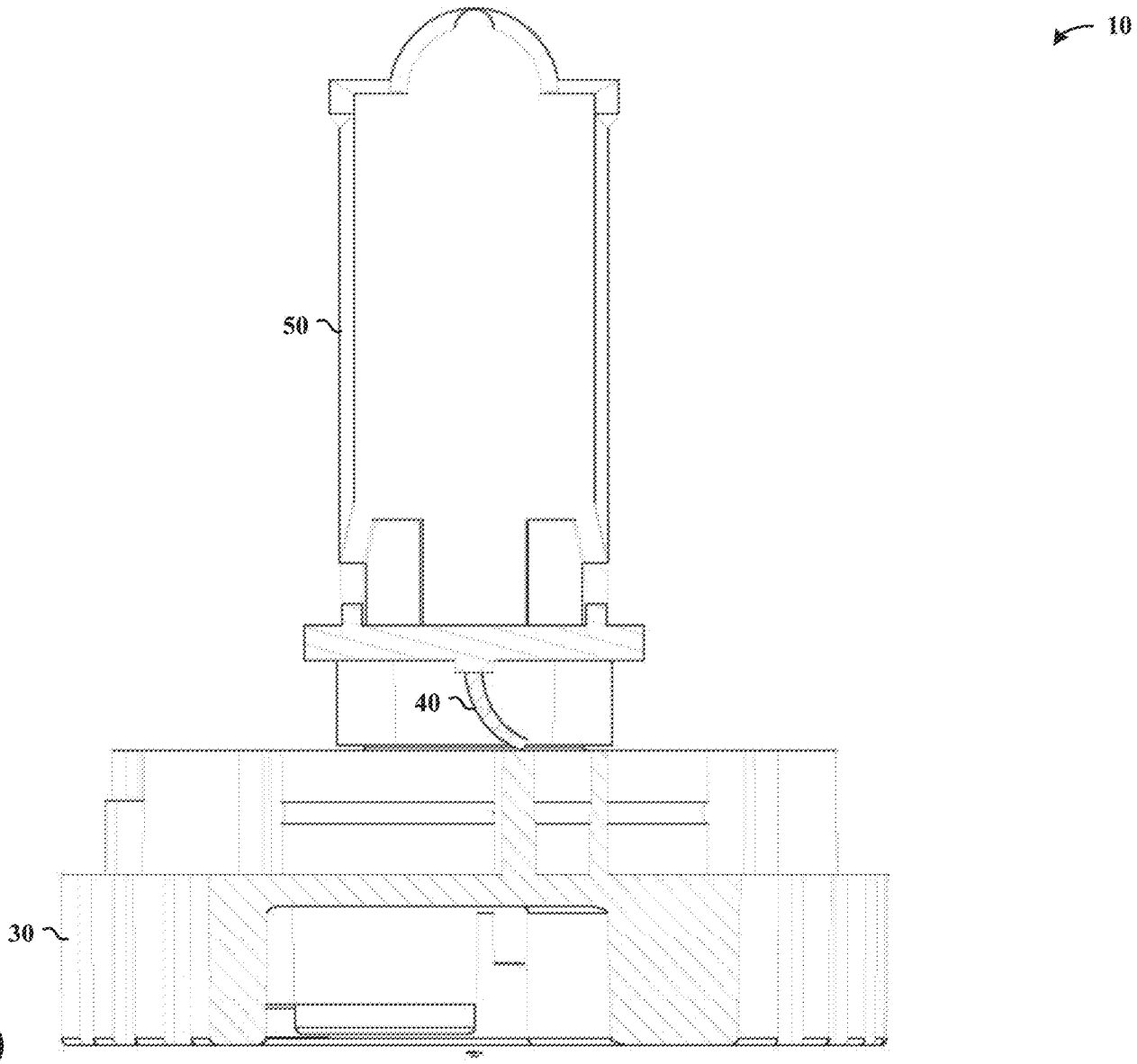
FIG. 40 shows a top section view of the apparatus of FIG. 28, similar to FIG. 39 but without the cap assembly, as may be implemented in accordance with one or more embodiments.

FIG. 40 shows a top section view of the apparatus 10, similar to FIG. 39 but without the cap assembly 60, as may be implemented in accordance with one or more embodiments. The section runs through the click mechanism showing the dial 30 and the spray channel 50. The dial 30 is shown in a non-spray position, and the click tab 40 is flexed as it is pushed out of the way by the dial as it passes. When the dial 30 releases the click tab 40, a click sound is made, indicating that the dial is moving between two spray positions.

Figure 41:
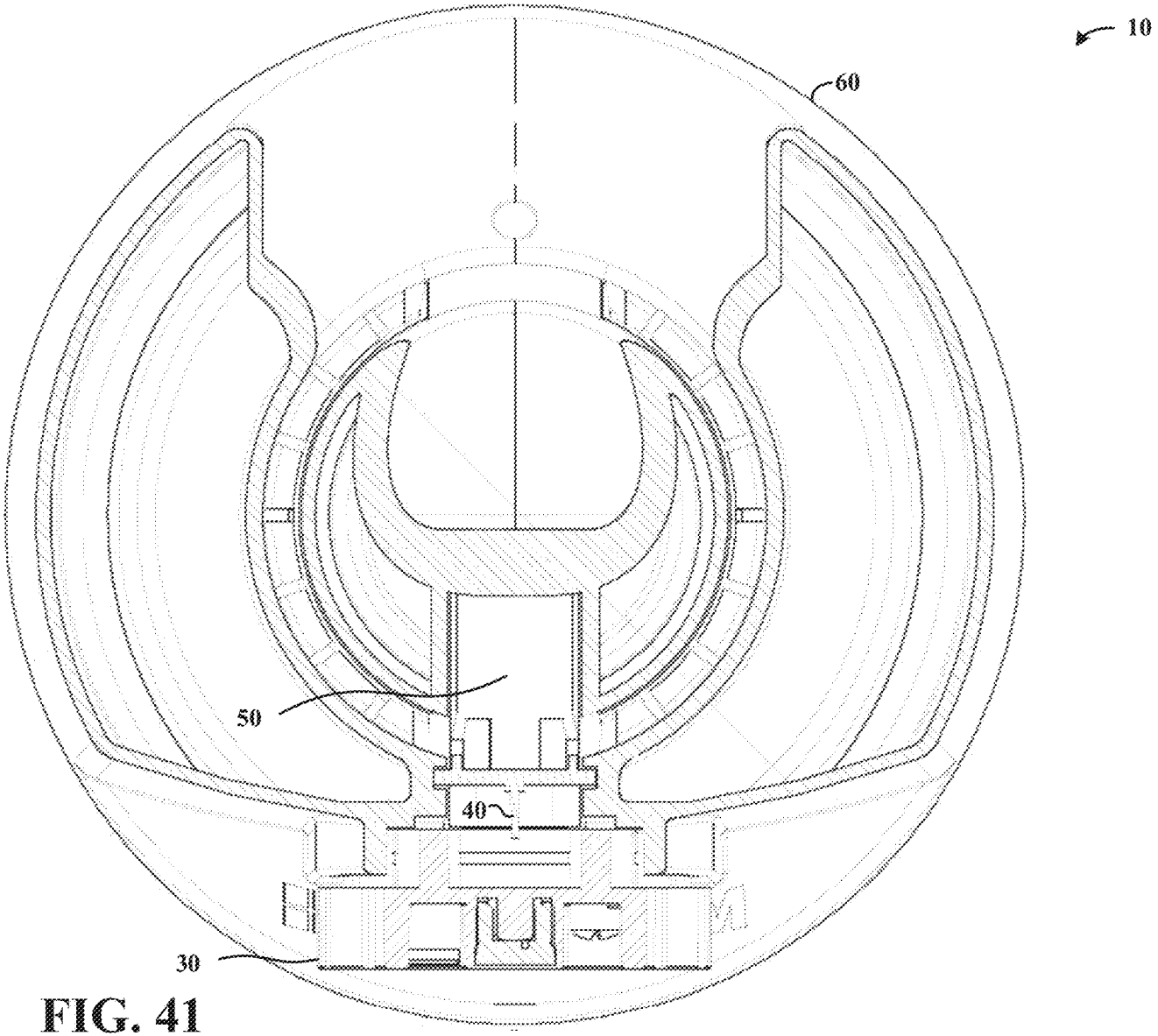
FIG. 41 shows a top view of the apparatus of FIG. 28 with a cap assembly, as may be implemented in accordance with one or more embodiments.

FIG. 41 shows a top view of the apparatus 10 with the cap assembly 60, as may be implemented in accordance with one or more embodiments. The click mechanism 40 is shown in its relaxed position as the dial is rotated in a position ready to spray. The click mechanism extends into the pathway of the dial, as it would rotate around its central axis.

Figure 42:
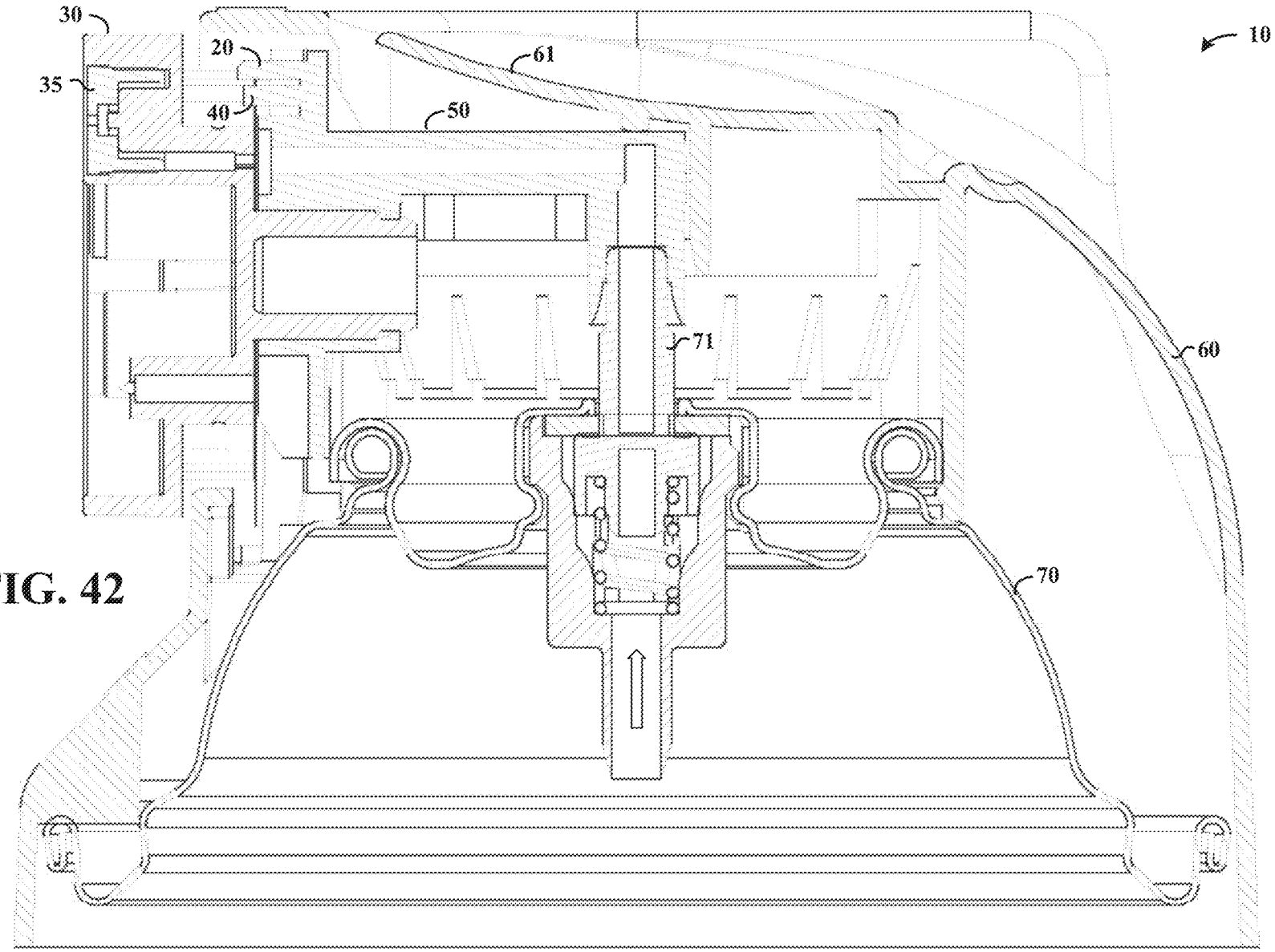
FIG. 42 shows a sectioned side elevation of an implementation of the apparatus of FIG. 28 along with an aerosol cap assembly and a portion of an aerosol can, as may be implemented in accordance with one or more embodiments.

FIG. 42 shows a sectioned side elevation of the apparatus 10 along with the aerosol cap assembly 60 and a portion of an aerosol can 70, as may be implemented in accordance with one or more embodiments. The view is split through the centerline, with the force feedback tab 20 over a portion of the spray channel 50 entering nozzle 35 of the dial 30, as well as the click tab 40 below the force feedback tab 20. When button 61 is depressed, the dial 30 and spray channel 50 actuate vertically downward toward the aerosol can 70, engaging with valve stem 71 to dispense pressurized fluid (e.g., paint) from the aerosol can in a direction as shown by the arrow, through the spray channel 50 and out the nozzle 35. In some implementations, the dial 30 is snapped into the spray channel 50, sandwiching the cap between the two.

Figure 43:
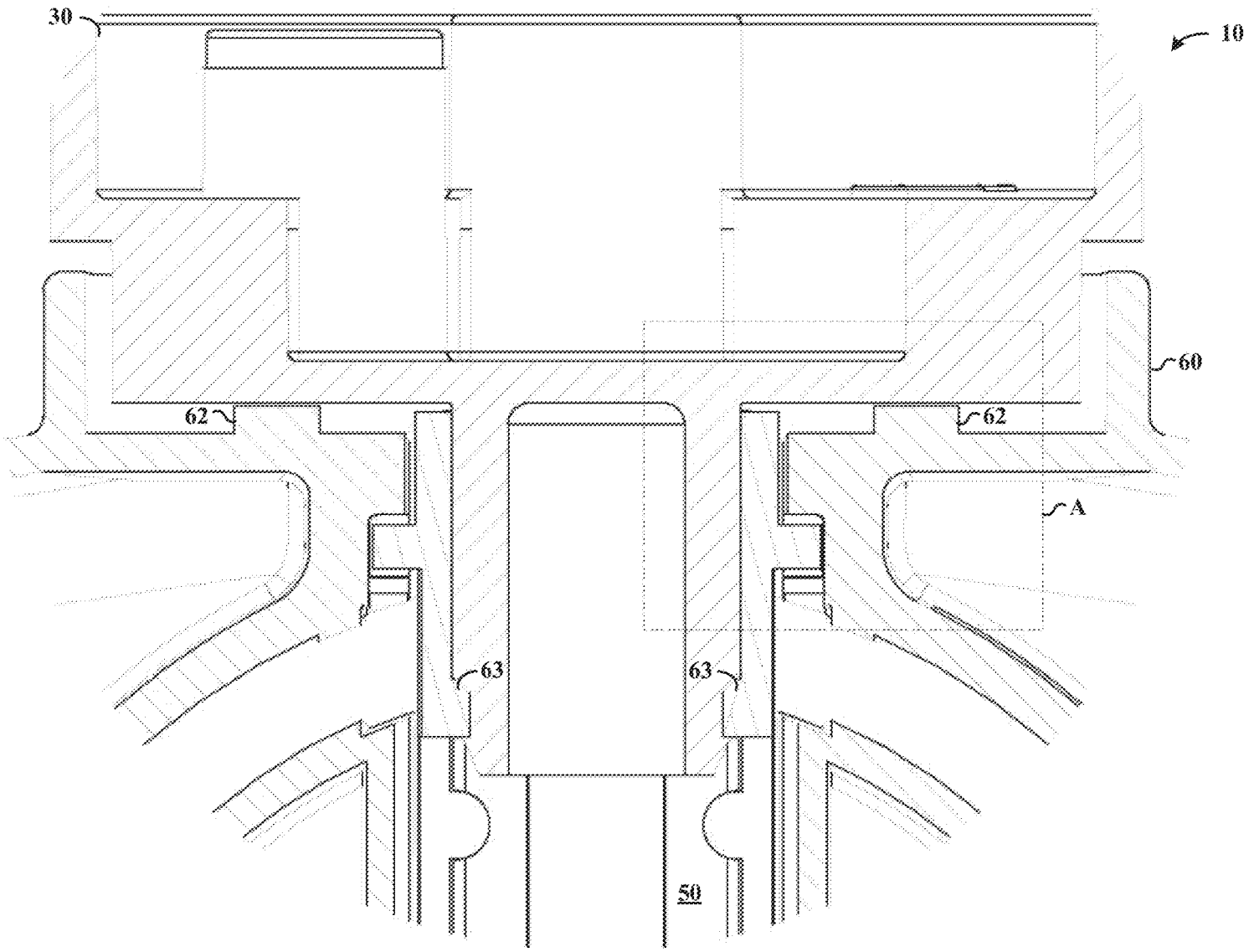
FIG. 43 shows a detailed section view of the dial, cap assembly and spray channel of an implementation of the apparatus of FIG. 28, as may be implemented in accordance with one or more embodiments.

FIG. 43 shows a detailed section view of the dial 30, cap assembly 60 and spray channel 50, as may be implemented in accordance with one or more embodiments. The section runs through the centerline of the dial, showing guide rails 62 that the dial 30 slides on the cap, and a retaining mechanism 63 that holds the dial onto the spray channel 50. The guide rails work to reduce the contact of the dial onto the cap and the spread channel onto the cap. The guide rails 62 may further be tapered off, so that the dial follows the spray channel 50 in tilting back when the button 61 (in FIG. 42) is depressed in a lock mode. This ensures that the dial 30 does not pull apart from the spray channel 50, which may otherwise allow fluid to leak at the connection.

Figure 44:
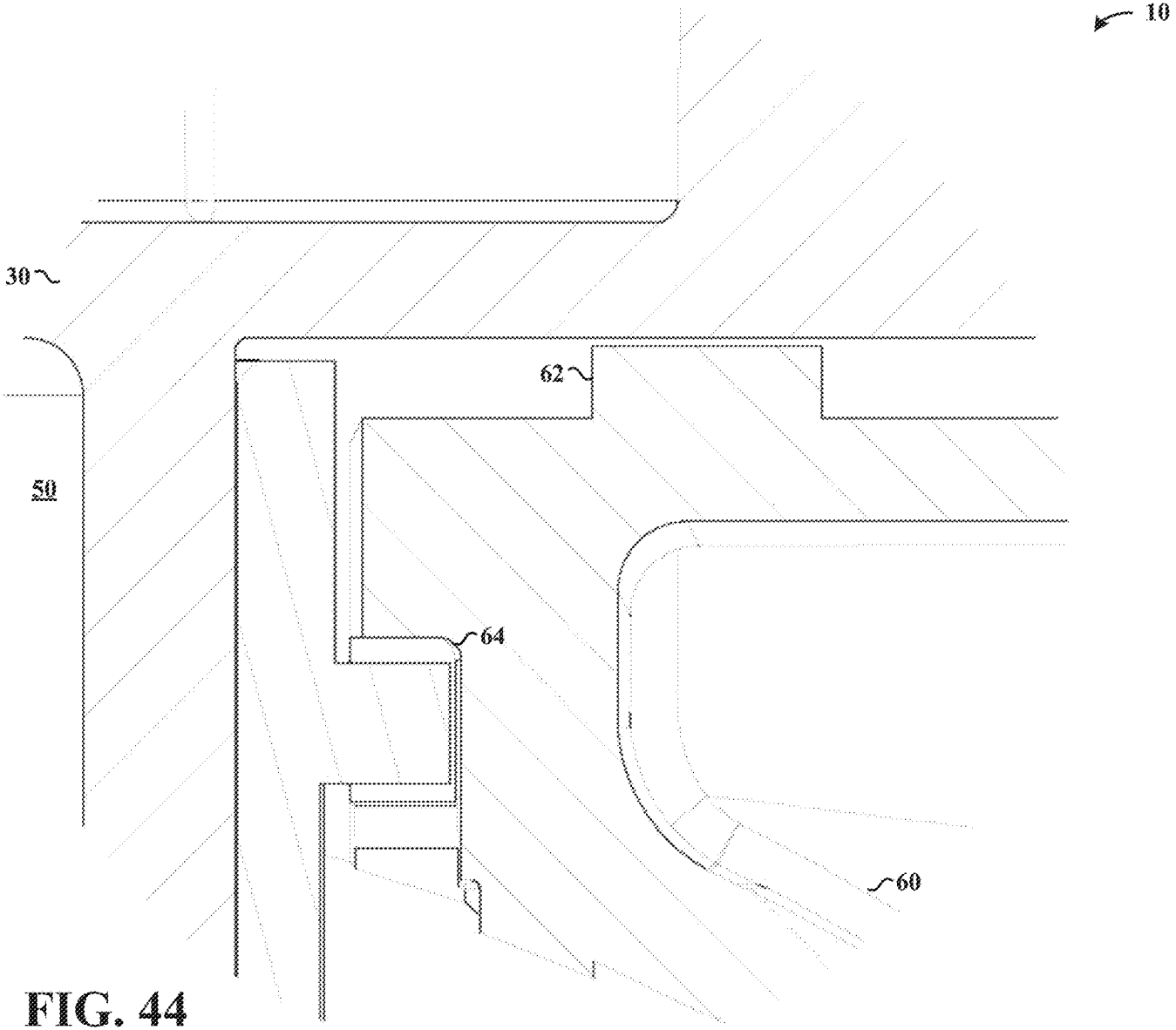
FIG. 44 shows a detailed view of the inset "A" from FIG. 43, as may be implemented in accordance with one or more embodiments.

FIG. 44 shows a detailed view of the inset "A" from FIG. 43, with dial 30 on the left-hand side, the spray channel 50 in the middle, and the cap assembly 60 on the lower right-hand side, as may be implemented in accordance with one or more embodiments. The apparatus may be assembled by placing the spray channel 50 inside of the cap 60. The dial 30 is then snapped into the spray channel from the outside of the cap. This positions the cap between the spray channel and the dial. As retaining rails 64 on the cap extend up and down, as the button is pressed the spray channel moves down, taking the dial with it.

Figure 45:
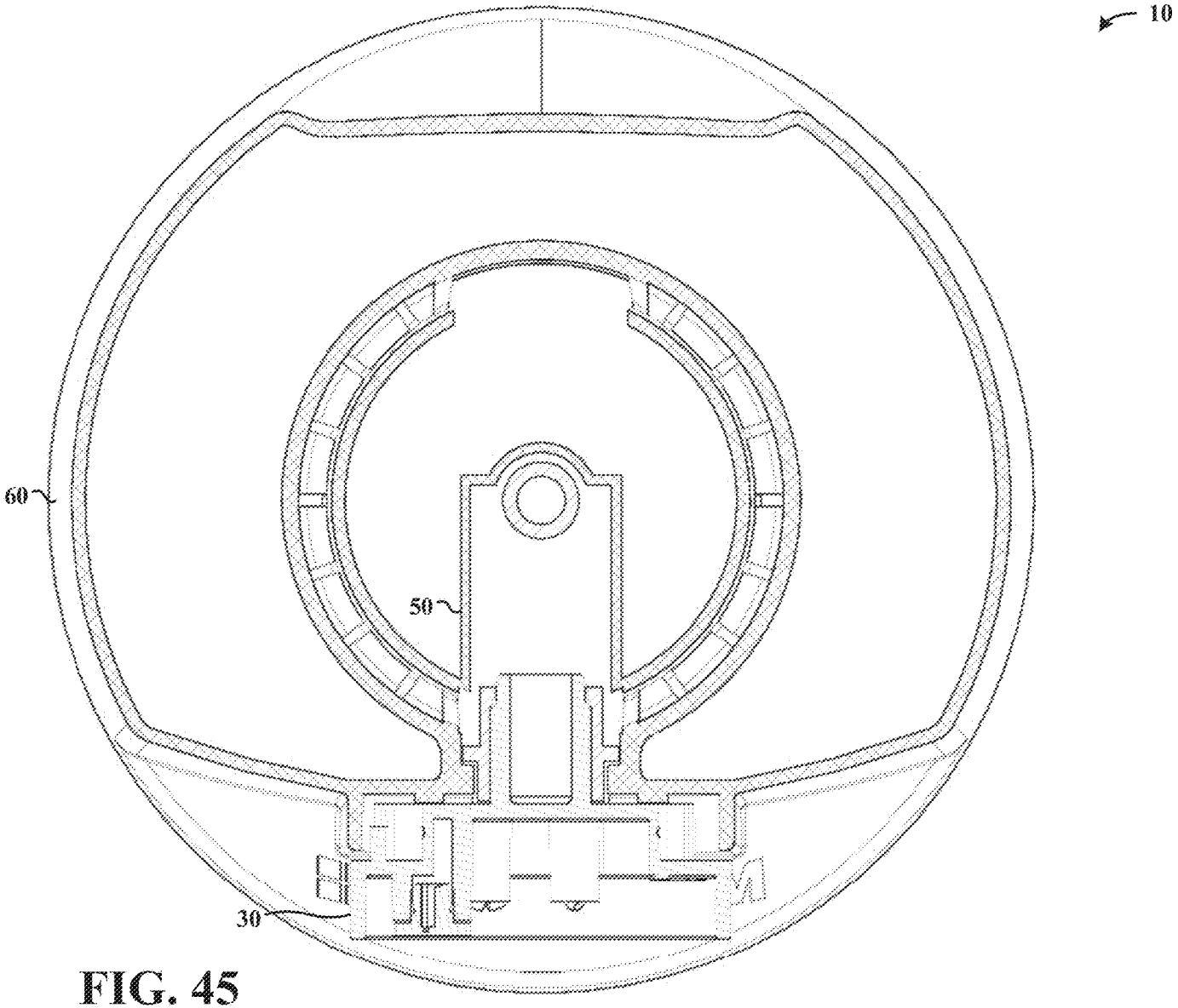
FIG. 45 shows a section view through the center line of the dial of an implementation of the apparatus shown in FIG. 20, as may be implemented in accordance with one or more embodiments.

FIG. 45 shows a section view through the centerline of the dial 30, as may be implemented in accordance with one or more embodiments. The cap 60, the spray channel 50 and the dial 30 are shown with the nozzles through that section.

Figure 46:
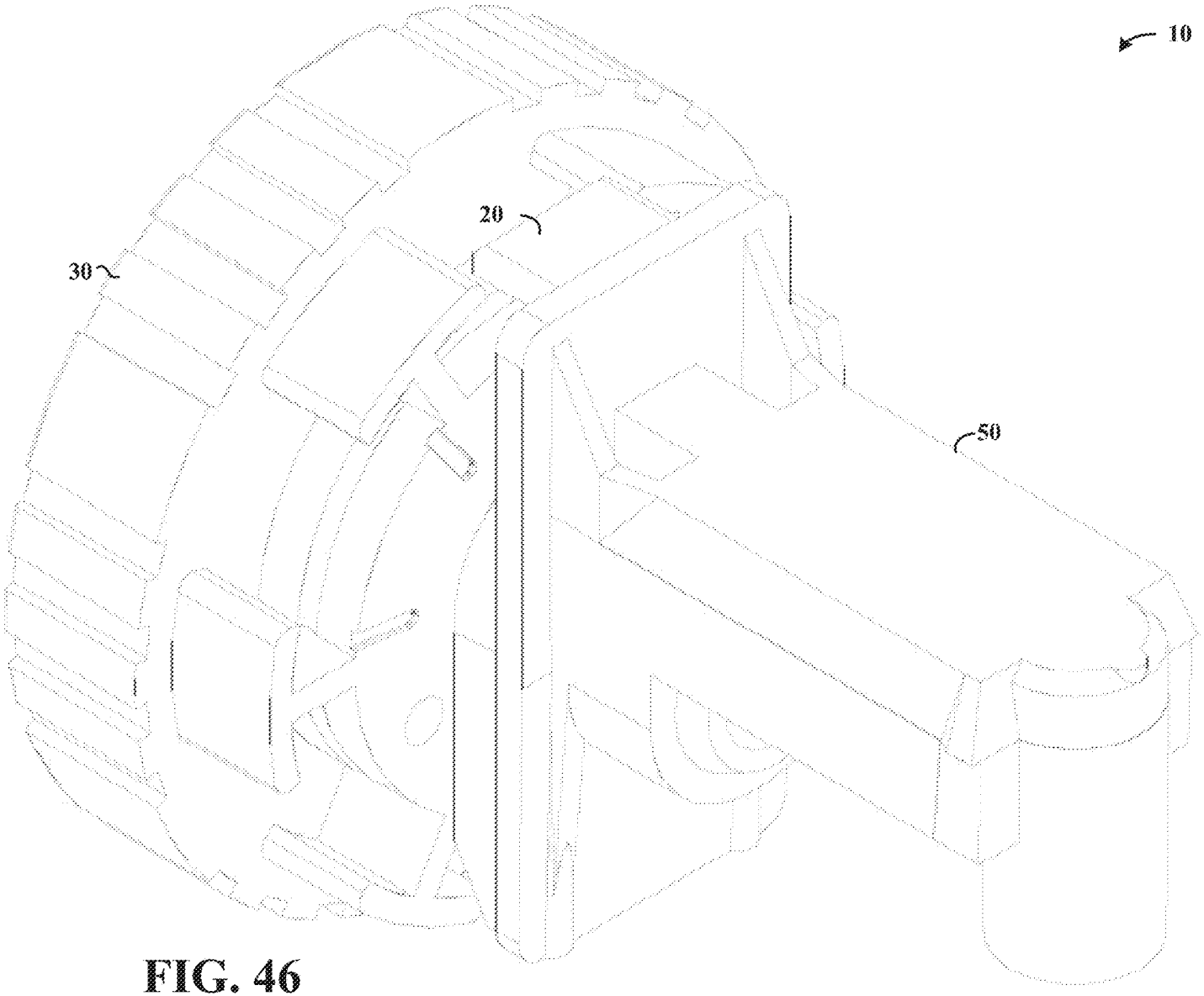
FIG. 46 shows an isometric view of the dial and spray channel of an implementation of the apparatus of FIG. 28, as may be implemented in accordance with one or more embodiments.

FIG. 46 shows an isometric view of the dial 30 and spray channel 50, as may be implemented in accordance with one or more embodiments. The dial 30 is set to a spray position and the force feedback tab 20 is not flexed but holds the dial from moving out of position.

Figure 47:
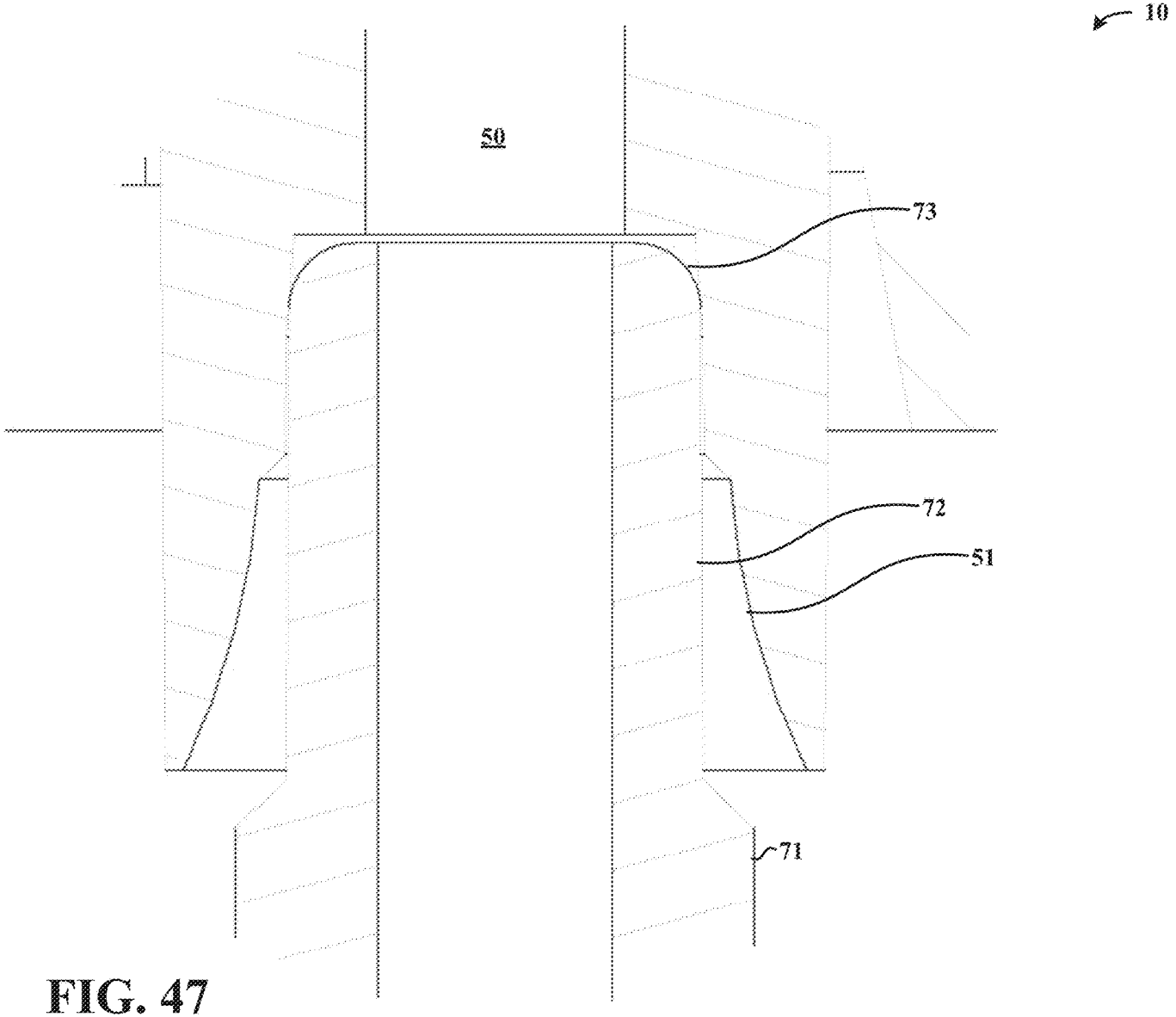
FIG. 47 shows engagement of a valve stem into a spray channel, for example relative to the apparatus as shown in FIG. 42, and as may be implemented in accordance with one or more embodiments.

FIG. 47 shows engagement of the valve stem 71 into the spray channel 50, for example relative to the apparatus as shown in FIG. 42, and as may be implemented in accordance with one or more embodiments. The valve stem 71 has a side 72 that is parallel with the vertical portion of the spray channel 50 with a radius top edge 73. For assembly purposes the spray channel 50 has a lead in chamfer 51 shaped like a trumpet cone that leads into a shoulder and then a very slow taper to a flat surface. The engagement between the valve stem 71 and the spray channel 50 takes place on this slope taper, which provides a seal on the sidewalls.

In various embodiments, the apparatus 10 may be implemented utilizing multiple apertures and a corresponding locking mechanism, for example as depicted in FIGS. 1-6. For instance, the gear aspects depicted in FIG. 37 may be utilized in connection with a mechanical stop such as tooth 150 as depicted in FIGS. 2 and 4.

Figure 48:
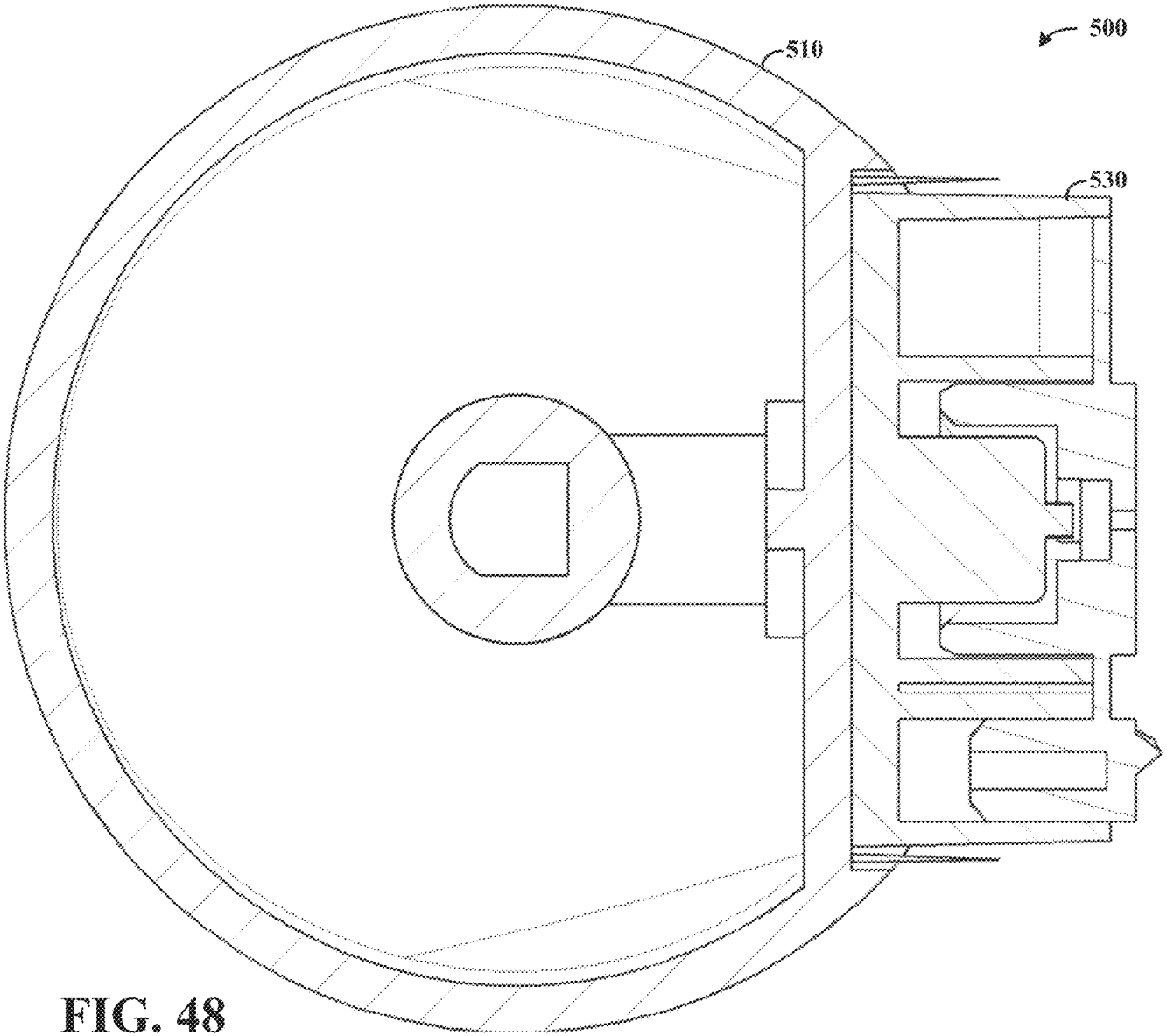
FIG. 48 shows a top cross-section view of a spray button apparatus, as may be implemented in accordance with one or more embodiments.
Figure 49:
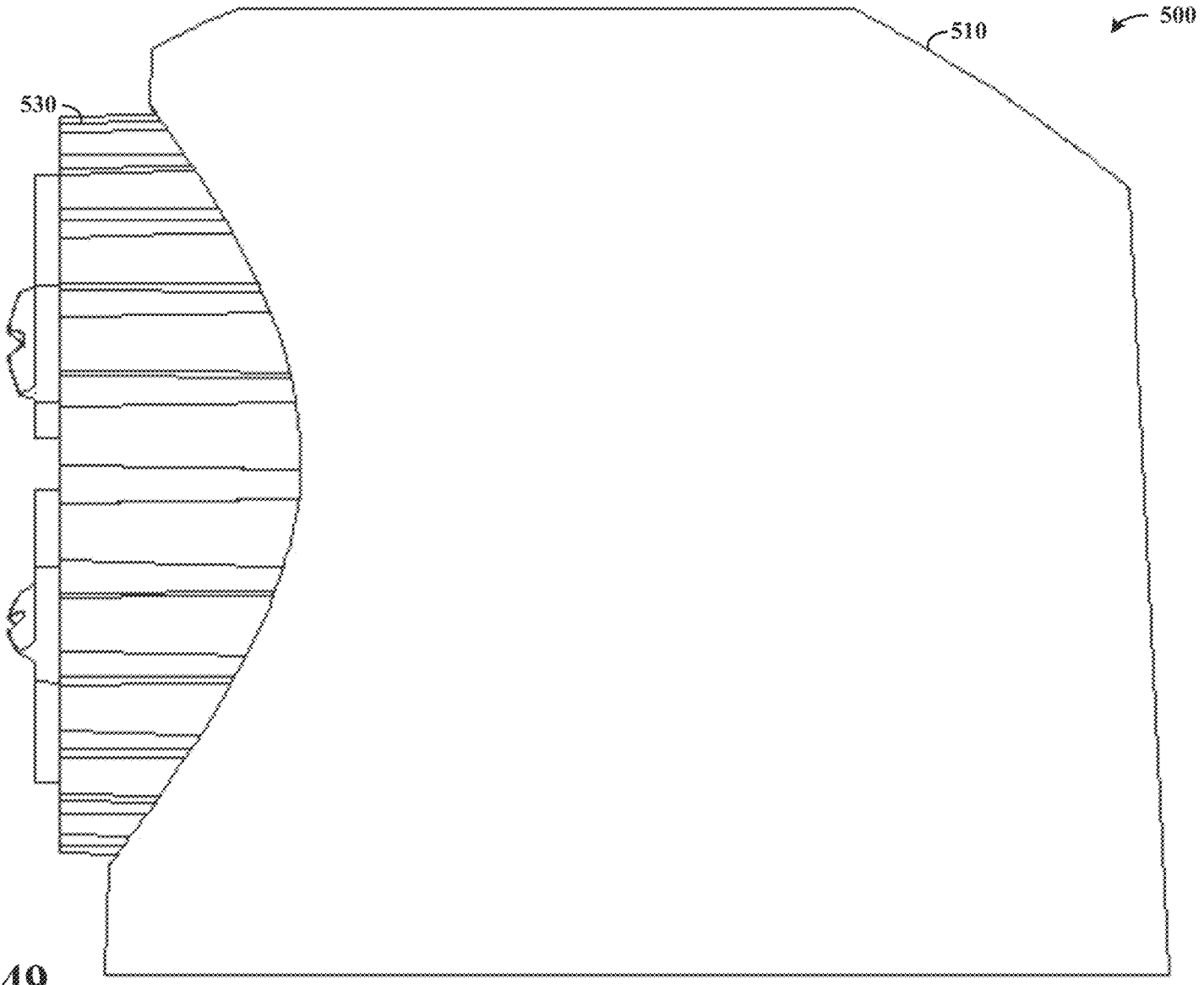
FIG. 49 shows a side view elevation of the apparatus of FIG. 48, as may be implemented in accordance with one or more embodiments.

FIG. 48 shows a top cross-section view, and FIG. 49 shows a side view elevation, of spray button apparatus 500 as may be implemented in accordance with one or more embodiments. The apparatus 500 includes spray button 510 having a dial 530 affixed to the front thereof, as may be operable for attachment to an aerosol can for dispensing fluid through a valve stem therein. The dial 530 includes multiple spray nozzles, for example, as may include six positions with three conical sprays, two fan sprays, and one stop position. Other embodiments utilize fewer or more nozzles/positions. The section is taken horizontally through the spray button apparatus (looking down).

Figure 50:
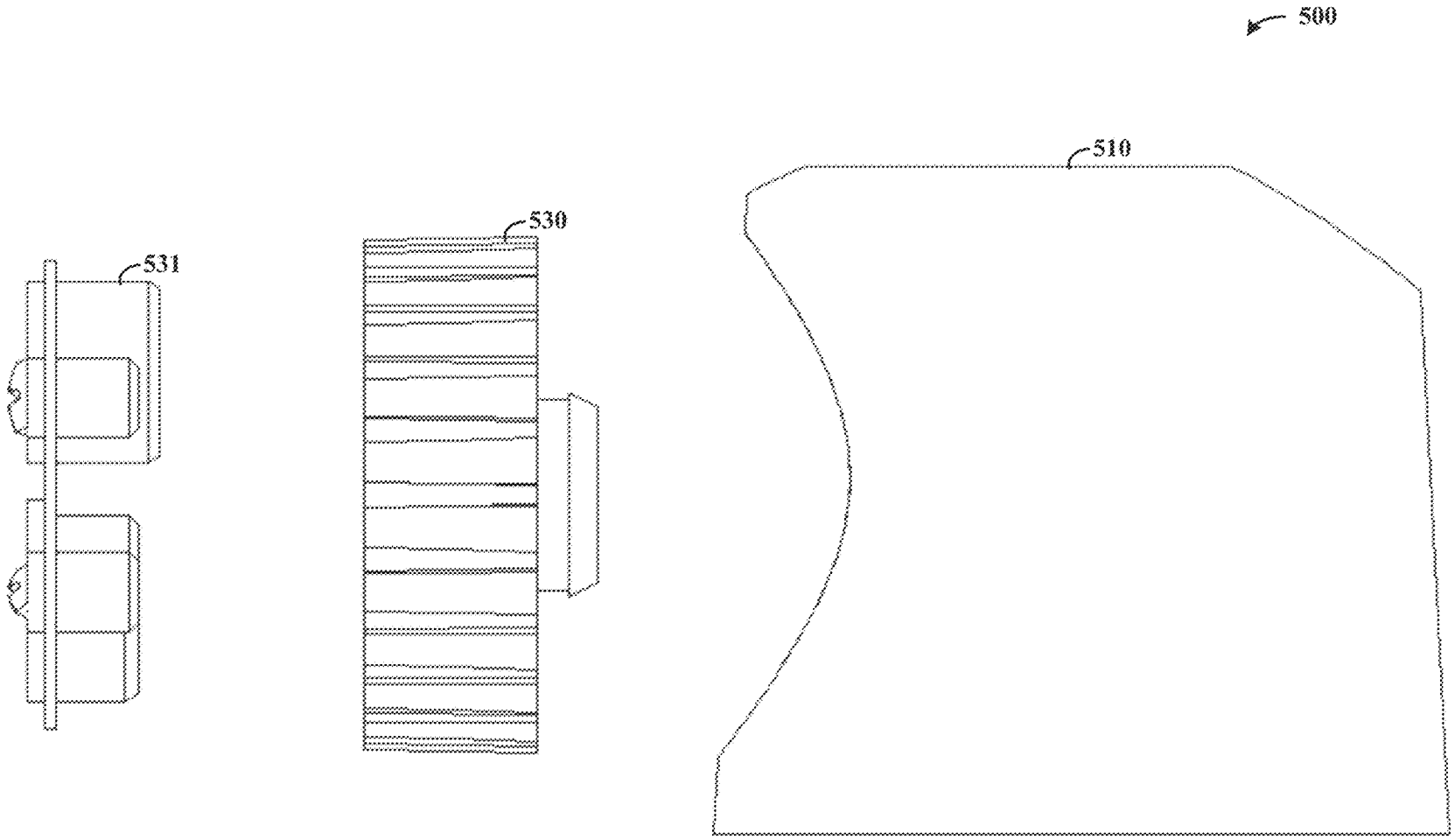
FIG. 50 shows an exploded view of the apparatus of FIG. 48, as may be implemented in accordance with one or more embodiments.

FIG. 50 shows an exploded view of the apparatus 500, as may be implemented in accordance with one or more embodiments. The spray button 510 is configured to accept the dial 530, which in turn is configured to accept nozzles 531 into the dial. In other embodiments, the nozzles 531 are formed integrally with the dial 530. The dial 30 has a serrated edge that facilitates rotation by fingers. A retention ring may be utilized to hold the dial 530 and nozzle 531 assembly into the spray button 510.

Figure 51:
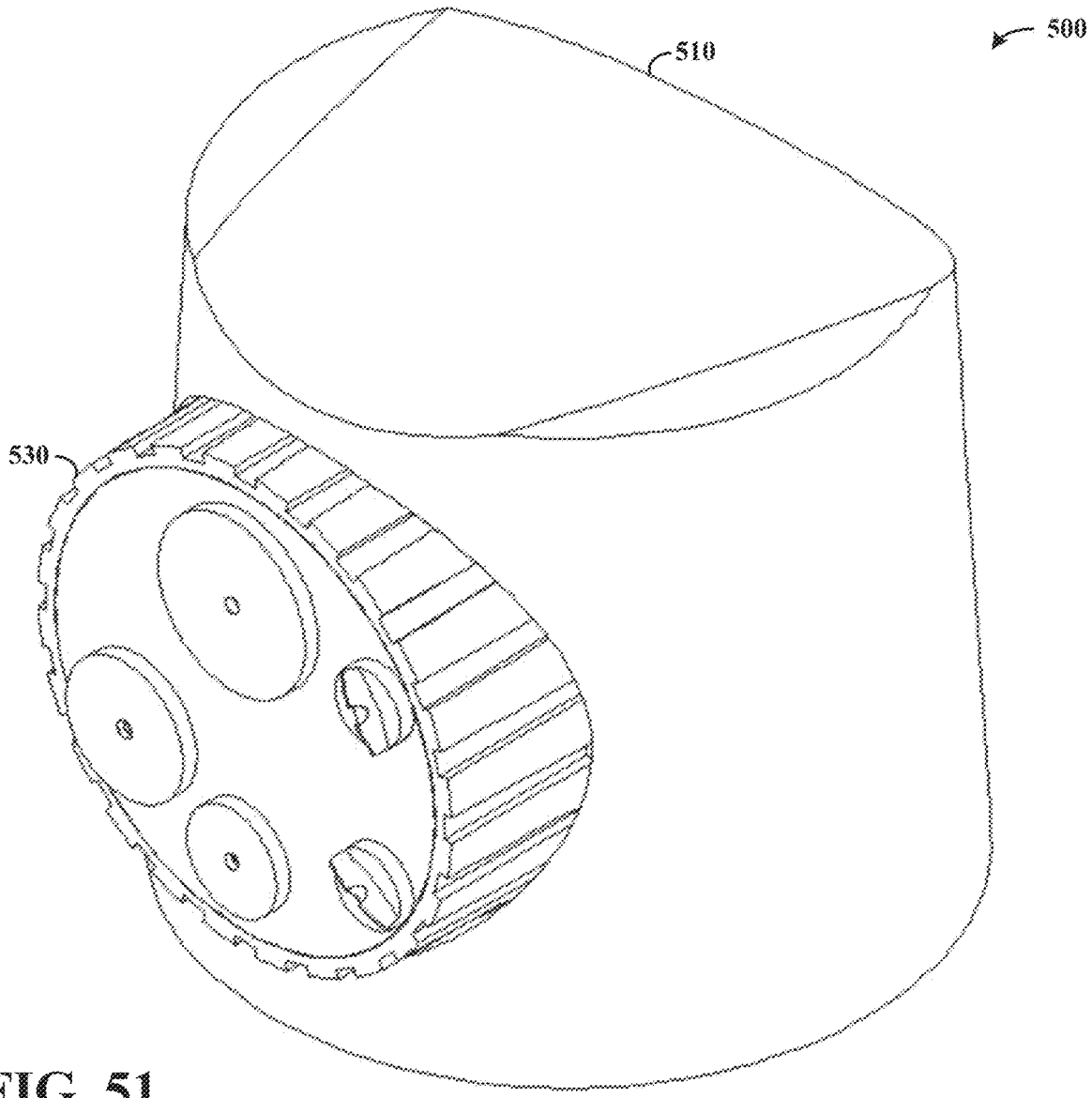
FIG. 51 shows an isometric view of the spray button apparatus of FIG. 48, as may be implemented in accordance with one or more embodiments.
Figure 52:
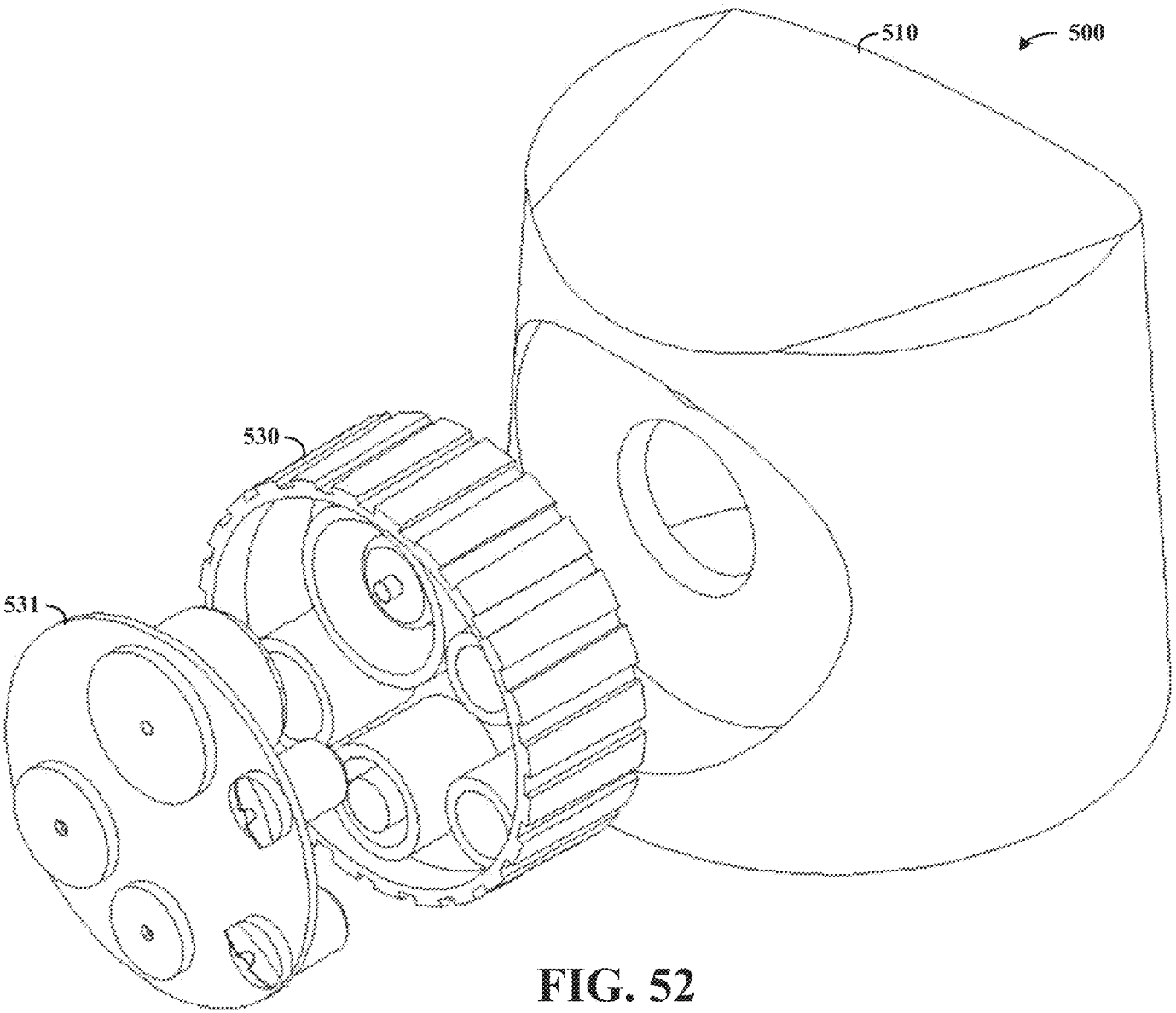
FIG. 52 shows an exploded view of an implementation of the apparatus shown in FIG. 51, as may be implemented in accordance with one or more embodiments.
Figure 53:
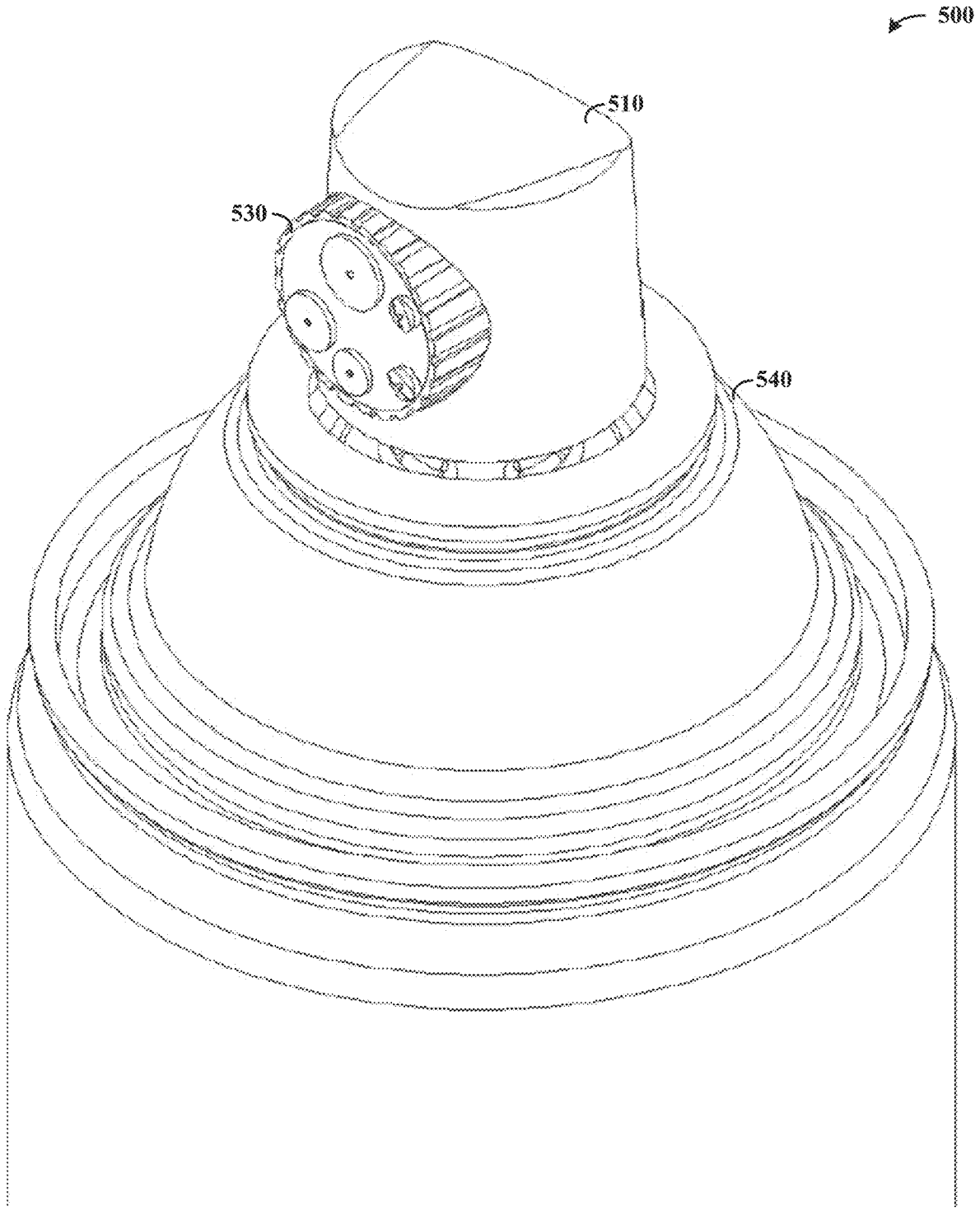
FIG. 53 shows an isometric view of the apparatus of FIG. 48 atop an aerosol can, as may be implemented in accordance with one or more embodiments.

FIG. 51 shows an isometric view of the spray button apparatus 500, as may be implemented in accordance with one or more embodiments. FIG. 52 shows an exploded view of an implementation of the spray button apparatus shown in FIG. 51, as may be implemented in accordance with one or more embodiments. FIG. 53 shows an isometric view of the spray button apparatus 500 atop an aerosol can 540, as may be implemented in accordance with one or more embodiments.

Figure 54:
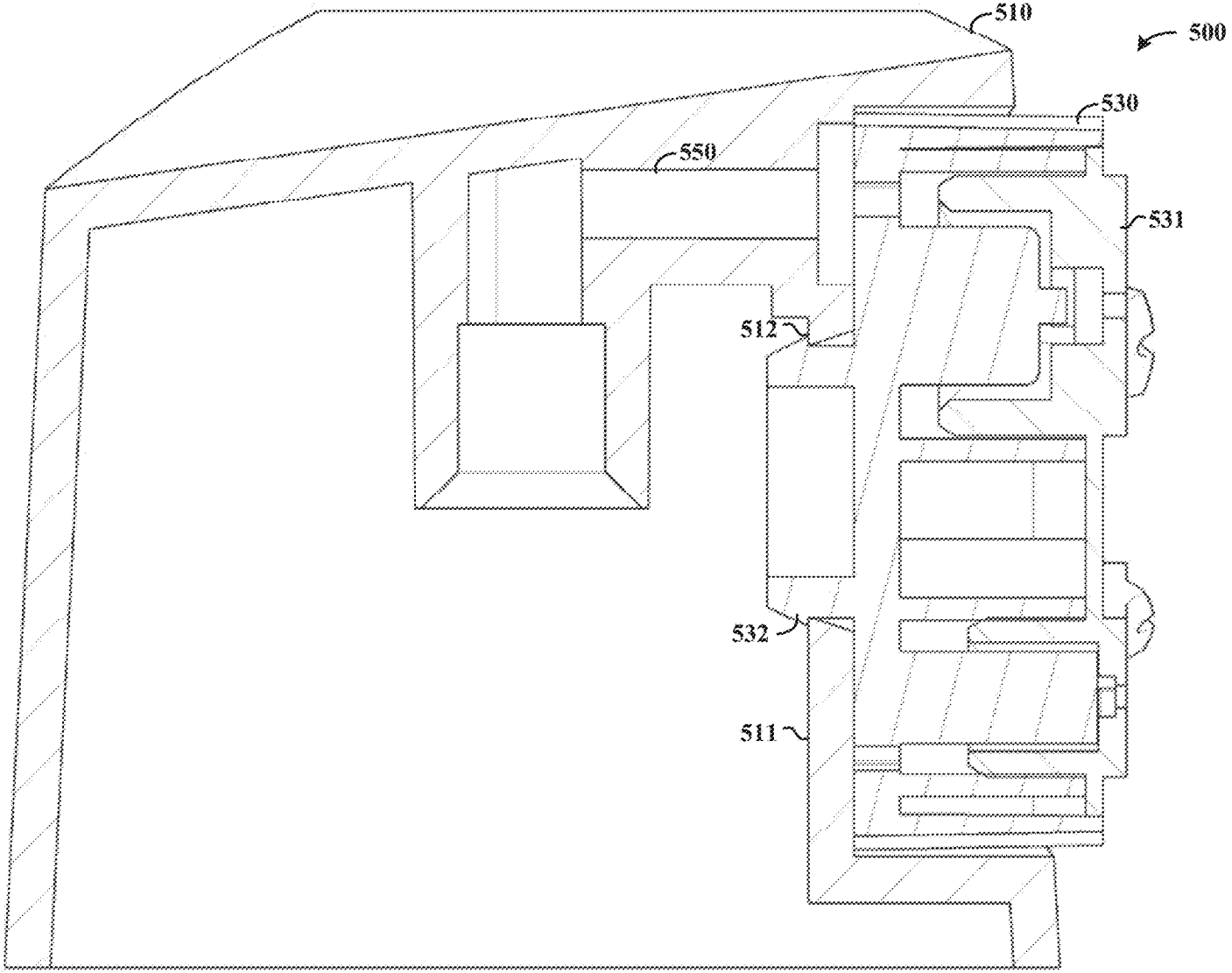
FIG. 54 shows a cross section view through the centerline of the apparatus of FIG. 48, as implemented in accordance with a particular embodiment.

FIG. 54 shows a cross section view through the center line of the spray button 500, as implemented in accordance with a particular embodiment. Nozzle 531 is shown aligned to spray channel 550 in a spraying position. The dial 530 includes a tapered portion 532 that snaps into sidewall portions 511 and 512 of the spray button 510.

In various embodiments, the spray button 500 may be implemented utilizing multiple apertures and a corresponding locking mechanism, for example as depicted in FIGS. 1-6. The spray button 500 may also be implemented utilizing a force feedback mechanism 20 and/or a click mechanism 40 as characterized with FIGS. 28-47.

Figure 55:
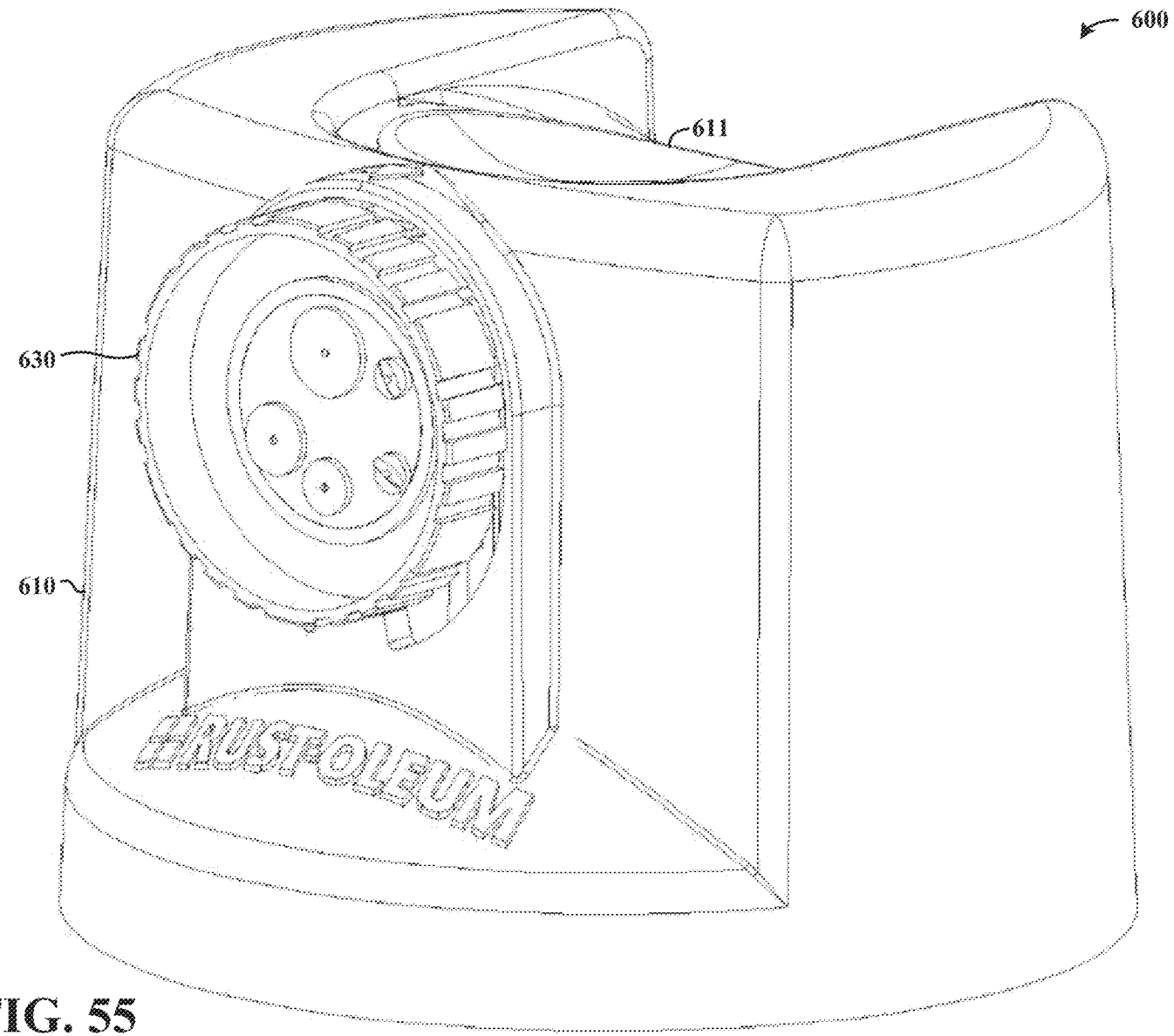
FIG. 55 depicts a one piece molded nozzle dial and cap, as may be implemented in connection with one or more embodiments.
Figure 56:
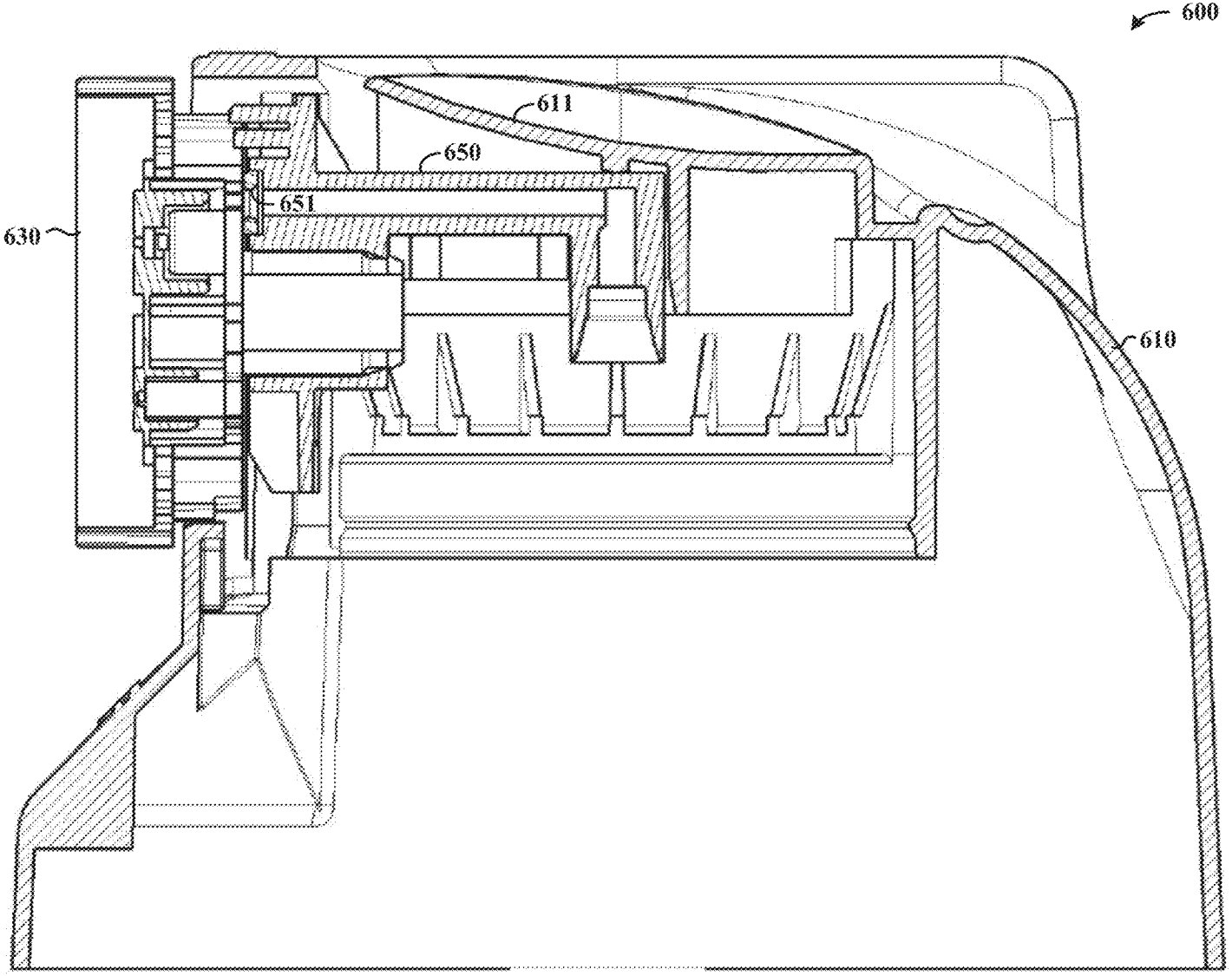
FIG. 56 shows a section view through the center line of the apparatus of FIG. 55, as may be implemented in accordance with one or more embodiments.
Figure 57:
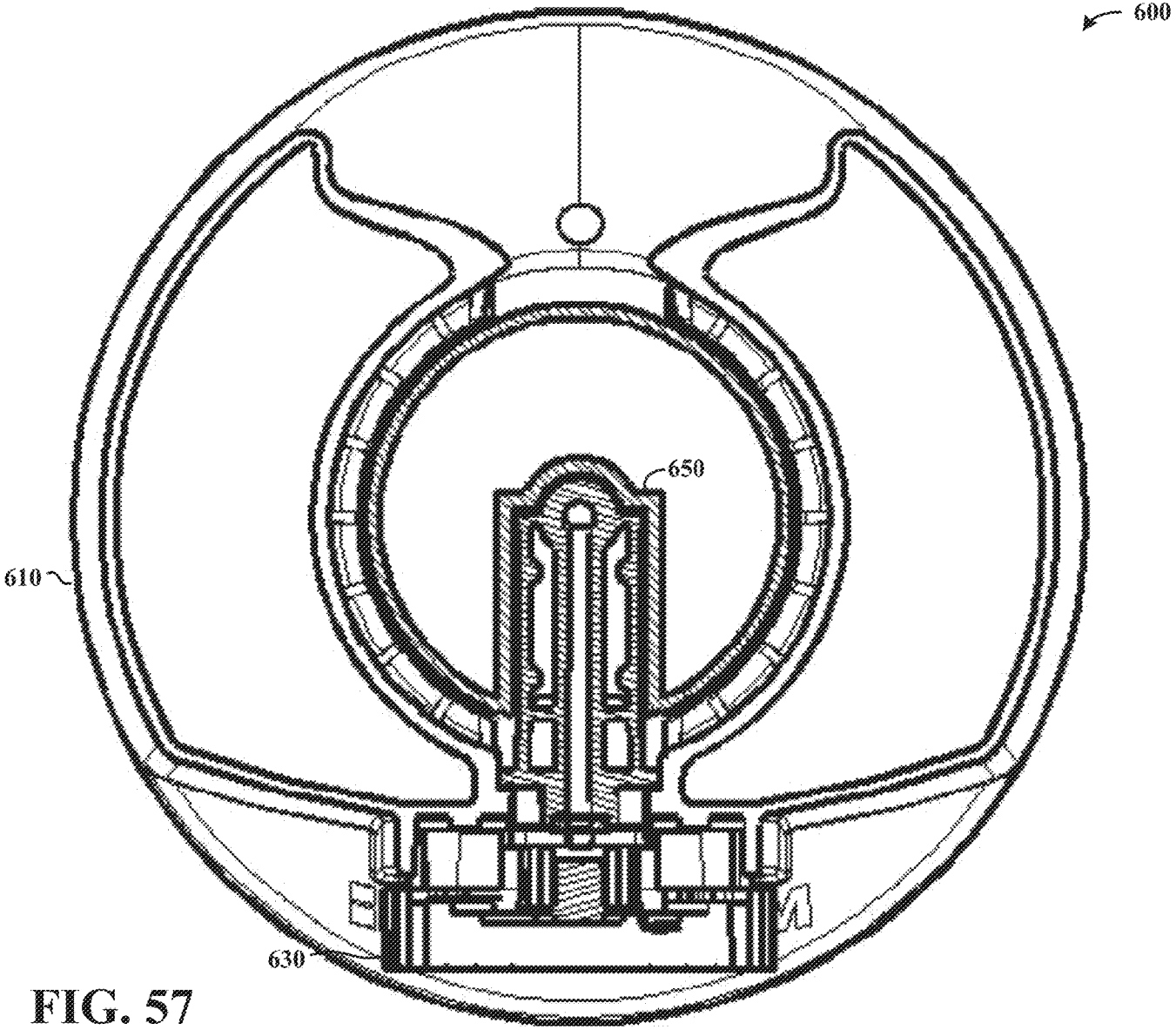
FIG. 57 shows a section view horizontal to the cap of the apparatus of FIG. 55, looking down (for example upon an aerosol can below the cap and to which the cap is attached).

FIGS. 55-57 depict an apparatus 600 including a one piece molded nozzle dial 630 on a cap 610, as may be implemented in connection with one or more embodiments. The cap 610 includes a button 611, for dispensing fluid via nozzles, which are molded as part of the dial 630. FIG. 56 shows a section view through the centerline of the cap 610. An O-ring 651 may be used to connect spray channel 650 to the dial 630. The cap 610 may be used to hold the assembly together, with the spray channel inside of the cap. FIG. 57 shows a section view horizontal to the cap 610, looking down (for example upon an aerosol can below the cap and to which the cap is attached). This approach may facilitate a smaller factor, and still have intrinsic feedback mechanisms and performance as characterized in connection with various embodiments herein.

In various embodiments, the molded nozzle dial 630 may be implemented utilizing multiple apertures and a corresponding locking mechanism, for example as depicted in FIGS. 1-6. The molded nozzle dial 630 may also be implemented utilizing a force feedback mechanism 20 and/or a click mechanism 40 as characterized with FIGS. 28-47.

Based upon the above discussion and illustrations, those skilled in the art will readily recognize that various modifications and changes may be made to the various embodiments without strictly following the exemplary embodiments and applications illustrated and described herein. For example, the dials and related gears, actuator and tabs may be utilized for a multitude of different types of dispensers and dispensing approaches, for a variety of materials. Further, tabs similar to one or both depicted with FIGS. 28-47 may be implemented with the spray button apparatus depicted in FIGS. 48-54. Similarly, the force feedback tab 20 and audible feedback tab 40 as shown in FIGS. 28-47 may be implemented with the corresponding tabs (similarly positioned) depicted in FIGS. 4-6, 15, 17 and 19. Further, the embodiments noted herein may be combined, and further embodiments may be separated (e.g., some embodiments are directed to a dial and stop, or to an apparatus with a resistive/force feedback tab, to an apparatus with a click type audible feedback feature, or a combination thereof. Other shapes, such as an oblong shape, and other forms of rotation such as a truncated arc, may be utilized as well, with approaches as noted herein. Such modifications do not depart from the scope of various aspects of the invention, including aspects set forth in the claims.

What is claimed is:

1. An apparatus comprising:

a dial having a planar surface;

a fluid supply channel;

a plurality of nozzles recessed within the surface of the dial, each of the nozzles having a fluid channel extending in a direction that is aligned in parallel with the fluid channels of the other nozzles, the dial being configured to rotate for selectively aligning each of the respective nozzles with the fluid supply channel;

a gear, coupled to the dial and configured to rotate with the dial, the gear having a plurality of cogs coupled to a rib, each cog and rib being separated by spaces along a rotation path; and a flexible tab extending into the rotation path of the ribs, the flexible tab being configured and arranged to:

in response to one of the ribs being rotated with the dial into contact with the flexible tab, flex from a relaxed position into a flexed position, and in response to the one of the ribs being further rotated with the dial to a position in which the rib moves out of contact with the flexible tab, snap back to the relaxed position and generating an audible noise indicating that rib has moved past the flexible tab.

2. The apparatus of claim 1, wherein the gear is configured to interact with a fixed component of the apparatus to selectively dispense fluid from the fluid supply channel or to prevent the fluid from dispensing from the fluid supply channel.

3. The apparatus of claim 1, wherein the flexible tab includes:

a fixed end that is fixed in place relative to the dial, and a free end that contacts the ribs as they are rotated into the flexible tab, and that flexes to the flexed position while the fixed end remains fixed in place.

4. The apparatus of claim 3, further including a spray cap configured to couple to an aerosol can for receiving fluid into the fluid supply channel, and wherein the fixed end is anchored to a portion of the spray cap that remains fixed in place relative to the dial as the dial is rotated.

5. The apparatus of claim 1, further including a second flexible tab extending into the rotation path, the second flexible tab being configured and arranged to:

in response to one of the cogs being rotated with the dial into contact with the second flexible tab, flex from a relaxed position into a flexed position and apply resistance to rotation of the dial via contact with the one of the cogs, and in response to the one of the cogs being further rotated with the dial to a position in which the cog moves out of contact with the second flexible tab, return to the relaxed position in which the flexible tab resides between the one of the cogs and another one of the cogs.

6. The apparatus of claim 5, wherein the second flexible tab includes:

a fixed end that is fixed in place relative to the dial, and a free end that contacts the cogs of the dial as they are rotated into the second flexible tab, and that flexes to the flexed position while the fixed end remains fixed in place.

7. The apparatus of claim 6, further including a spray cap configured to couple to an aerosol can for receiving fluid into the fluid supply channel, and wherein the fixed end is anchored to a portion of the spray cap that remains fixed in place relative to the dial as the dial is rotated.

8. The apparatus of claim 5, wherein the spaces defined by the cogs have a consistent width, and wherein the second flexible tab has a width corresponding to the consistent width such that the second flexible tab resides in the space between two of the cogs when aligned to the space with one of the plurality of nozzles aligned to the fluid supply channel.

9. The apparatus of claim 8, wherein the second flexible tab is configured to apply a force to the cogs that resists rotation of the dial, by engaging edges of the second flexible tab with the cogs adjacent the second flexible tab when the flexible tab is aligned to the space, therein facilitating alignment of the nozzles to the fluid supply channel.

10. The apparatus of claim 1, wherein the dial, fluid supply channel, gear and flexible tab are configured to operate in a dispensing mode in which fluid is dispensed from the fluid supply channel through the nozzles, by moving collectively together in response to pressure applied to the apparatus in a downward direction parallel to the planar surface of the dial.

11. The apparatus of claim 1, wherein the gear is configured to:

prevent passage of fluid from the fluid supply channel when the dial is positioned with the nozzles out of alignment with the channel; and facilitate dispensing of fluid from the fluid supply channel through one of the nozzles when the dial is positioned such that the fluid channel of the one of the nozzles is aligned with the fluid supply channel.

12. The apparatus of claim 11, further including a mechanical stop configured and arranged with the gear to facilitate:

engaging of one of the cogs with the mechanical stop to prevent the passage of the fluid from the fluid supply channel when the dial is positioned with the nozzles out of alignment with the channel; and aligning one of the spaces between the cogs with the mechanical stop to facilitate the dispensing of the fluid from the fluid supply channel through the one of the nozzles when the dial is positioned such that the fluid channel of the one of the nozzles is aligned with the fluid supply channel.

13. The apparatus of claim 12, further including an actuator coupled to the dial to facilitate the dispensing of the fluid from the fluid supply channel through the one of the nozzles via movement of the actuator and dial for dispensing the fluid, when the cogs are aligned such that one of the spaces between the cogs is engaged with the mechanical stop.

14. The apparatus of claim 1, wherein the fluid supply channel includes a portion extending in the vertical direction and another portion extending horizontally aligned to the nozzles, and is configured to move vertically with the dial in response to force applied thereto for spraying fluid through one of the nozzles in the horizontal direction.

15. The apparatus of claim 1, including an actuator configured and arranged to actuate a valve to release propelled liquid through the fluid supply channel into one of the nozzles aligned to the fluid supply channel, wherein the fluid supply channel includes a portion extending in the vertical direction and another portion extending horizontally aligned to the nozzles, and is configured to move vertically with the dial in response to force applied thereto via the actuator for actuating the valve and releasing the propelled liquid.

16. An apparatus comprising:

a dial having a plurality of nozzles and a gear, the dial being configured to rotate for selectively aligning each of the respective nozzles for receiving fluid to be dispensed via the nozzles, the gear having a plurality of cogs coupled to a rib, each cog and rib being separated by spaces along a rotation path; and a flexible tab extending into the rotation path of the ribs, the flexible tab being configured and arranged to:

in response to one of the ribs being rotated with the dial into contact with the flexible tab, flex from a relaxed position into a flexed position, and in response to the one of the ribs being further rotated with the dial to a position in which the rib moves out of contact with the flexible tab, snap back to the relaxed position and generate an audible noise indicating that rib has moved past the flexible tab.

17. The apparatus of claim 16, wherein the dial has a planar surface, and each of the nozzles has a fluid channel extending in a direction that is aligned in parallel with the fluid channels of the other nozzles for spraying fluid from the planar surface in a direction perpendicular thereto.

18. The apparatus of claim 16, further including a spray cap, the dial being coupled to the spray cap via an interface that facilitates rotation of the dial relative to the spray cap, the flexible tab being anchored to the spray cap and extending therefrom into the rotation path of the ribs with the dial coupled to the spray cap, the spray cap including:

a fluid supply channel to supply the fluid, including a horizontal portion extending in parallel with the nozzles and a vertical portion feeding the horizontal portion, the dial being configured to selectively align each of the respective nozzles to the horizontal portion for receiving the fluid, and an actuator for moving the dial, flexible tab and fluid supply channel in the vertical direction in response to pressure applied thereto, for dispensing fluid via one of the nozzles aligned to the horizontal portion of the fluid supply channel.

19. The apparatus of claim 18, wherein the cogs are configured to:

in response to one of the nozzles being aligned to receive fluid from the fluid supply channel, permit movement of the dial, flexible tab and fluid supply channel via the actuator for dispensing the fluid, and in response to none of the nozzles being aligned to receive fluid from the fluid supply channel, prevent movement of the dial, flexible tab and fluid supply channel via the actuator and therein preventing fluid from being dispensed via the nozzles.

20. The apparatus of claim 19, wherein the spray cap includes a mechanical stop configured to interface with the cogs such that:

when one of the nozzles is aligned to receive fluid from the fluid supply channel, a gap between the cogs is aligned to the mechanical stop to permit movement of the dial, flexible tab and fluid supply channel vertically via the actuator, and when one of the cogs is aligned vertically over the mechanical stop, the mechanical stop prevents vertical movement of the dial, flexible tab and fluid supply channel by engaging with the one of the cogs.

* * * * *